US005241237A

United States Patent [19]

Misono et al.

[11] Patent Number: 5,241,237

[45] Date of Patent: Aug. 31, 1993

[54] ELECTRON GUN AND CATHODE-RAY TUBE

[75] Inventors: Masayoshi Misono, Chiba; Satoru Miyamoto, Mobara; Kiyoshi Nakamura, Mobara; Masahiro Miyazaki, Mobara, all of Japan

[73] Assignee: Hitachi, Ltd., Tokyo, Japan

[21] Appl. No.: 649,845

[22] Filed: Jan. 30, 1991

[30] Foreign Application Priority Data

Feb. 8, 1990 [JP] Japan ..... 2-27172

[51] Int. Cl.[5] ..... G09G 1/04; H01J 29/58; H01J 29/46; H01J 29/50

[52] U.S. Cl. ..... 315/382; 313/414; 315/15

[58] Field of Search ..... 315/382, 15; 313/414

[56] References Cited

U.S. PATENT DOCUMENTS

| | | | |
|---|---|---|---|
| 3,887,834 | 6/1975 | Himmelbauer | 315/382 |
| 4,641,058 | 2/1987 | Koshigoe et al. | 313/449 |
| 4,764,704 | 8/1988 | New et al. | 313/414 |
| 4,877,998 | 10/1989 | Maninger et al. | 315/15 |

*Primary Examiner*—Gregory C. Issing

*Attorney, Agent, or Firm*—Antonelli, Terry, Stout & Kraus

[57] ABSTRACT

An electron gun in which at least two of a plurality of electrodes constituting the electron gun are endowed with structures for generating rotationally-asymmetric electric fields, in electron-beam apertures of the electrodes or around the electron-beam apertures, and a cathode-ray tube which comprises the electron gun can enhance focus characteristics and attain favorable resolutions over the whole area of a screen and in all the current ranges of electron beams, and they do not give rise to moire in the small current range of the electron beams, without supplying a dynamic focus voltage.

13 Claims, 55 Drawing Sheets

FIG. 21

| G1 | | G2 | | G3 | | G4 | | G5 | | G6 | |
|---|---|---|---|---|---|---|---|---|---|---|---|
| 1a | 1b | 2a | 2b | 3a | 3b | 4a | 4b | 5a | 5b | 6a | 6b |
| O | O | | | O | | | | | | | |
| | | O | O | O | | | | | | | |
| O | O | | O | O | | | | | | | |
| | O | | | O | | | | | | | |
| | | O | | O | | | | | | | |
| | | | O | O | | | | | | | |
| | O | | | | O | | | | | | |
| | | O | | | O | | | | | | |
| | | | O | | O | | | | | | |
| | O | | | | | | | O | | | |
| | | O | | | | | | O | | | |
| | | | O | | | | | O | | | |
| | | | O | O | O | | | | | | |
| | | | O | O | | | O | | | | |
| | | | O | O | | O | | | | | |
| | | | O | O | | | | O | | | |
| | | | | O | | | | O | O | | |
| | | | | O | | | | | O | O | |
| | | | | | O | | | | O | O | |
| | | | | | | | | O | O | O | |
| | | | O | O | | | | | O | O | |
| | | O | | O | | | | | O | O | |
| | | | O | | O | | | | O | O | |
| | | | O | O | O | | | O | | | |
| | | | O | O | O | O | | | | | |
| | | | O | O | | | O | O | | | |
| | | | O | O | O | | | | O | O | |
| | | | O | | O | O | | | O | O | |
| | | | O | | | | O | O | O | O | |
| | | | O | O | O | | | O | O | O | |
| | | | O | O | O | O | | | O | O | |
| | | | O | O | | | O | O | O | O | |

BPF

UPF

HI-FO

HI-UPF

B-U

TPF

FIG. 24

○:Effective ◎:Great effective

| A kind of electron gun | Excepting main lens | Including main lens | G1 | | G2 | | G3 | | G4 | | G5 | | G6 |
|---|---|---|---|---|---|---|---|---|---|---|---|---|---|
| | | | 1a | 1b | 2a | 2b | 3a | 3b | 4a | 4b | 5a | 5b | 6a |
| BPF | ● | | ◎ | ◎ | ◎ | ◎ | ◎ | | | – | – | – | – |
| | | ● | ◎ | ◎ | ◎ | ◎ | ◎ | ◎ | ◎ | – | – | – | – |
| | Suitable combination | | 2b+3a, 1a+1b+3a, 2a+2b+3a, 1a+1b+2b+3a | | | | | | | | | | |
| Hi-FO | ● | | ◎ | ◎ | ◎ | ◎ | ◎ | | | – | – | – | – |
| | | ● | ◎ | ◎ | ◎ | ◎ | ◎ | ◎ | ◎ | – | – | – | – |
| | Suitable combination | | 2b+3a, 1a+1b+3a, 2a+2b+3a, 1a+1b+2b+3a | | | | | | | | | | |
| Hi-UPF | ● | | ○ | ◎ | ◎ | ◎ | ◎ | | | | | – | – |
| | | ● | ○ | ◎ | ◎ | ◎ | ◎ | ○ | ○ | ○ | ○ | – | – |
| | Suitable combination | | 1b+2a, 2b+3a, 1a+1b+2a, 2a+2b+3a | | | | | | | | | | |
| B-U | ● | | ◎ | ◎ | ○ | ◎ | ◎ | | | | | | |
| | | ● | ◎ | ◎ | ○ | ◎ | ◎ | ○ | ○ | ○ | ○ | ○ | ○ |
| | Suitable combination | | 2b+3a, 1a+1b+3a, 2a+2b+3a, 1a+1b+2b+3a | | | | | | | | | | |

na: Position near to cathode
nb: Position near to anode

G1 ENTRANCE

G1 EXIT

G2 ENTRANCE

TO FIG. 41(d)

FROM FIG. 41(c)

G2 EXIT

G3 SLIT ENTRANCE

G3 APERTURE ENTRANCE

TO FIG. 41(g)

FROM FIG. 41(f)

G3 EXIT

G4 ENTRANCE

G5 ENTRANCE

TO FIG. 41(j)

FROM FIG. 41(i)

G5 MID POINT

G6 ENTRANCE

ELECTRON GUN AND CATHODE-RAY TUBE

BACKGROUND OF THE INVENTION

The present invention relates to cathode-ray tubes. More particularly, it relates to an electron gun which can enhance focus characteristics in the whole area of a fluorescent screen and in all the current ranges of an electron beam, thereby to attain a favorable resolution, and a cathode-ray tube which includes the electron gun.

In a cathode-ray tube which has, at least, an electron gun configured of a plurality of electrodes, a deflection device and a fluorescent screen, techniques as stated below have heretofore been known as expedients for obtaining a good reproduced picture in the area of the fluorescent screen from the central part to the marginal part thereof.

The techniques are, for example, one wherein an astigmatic lens is disposed within the region of electrodes (a second electrode and a third electrode) which form a focusing lens (Official Gazette of Japanese Patent Laid-open No. 18866/1978); one wherein the electron-beam apertures of the first and second electrodes of an in-line 3-beam electron gun are made vertically long, and the shapes of these electrodes are made different, or the aspect ratio of a center electron gun is set smaller than that of a side electron gun (Official Gazette of Japanese Patent Laid-open No. 64368/1976); and one wherein a rotationally-asymmetric lens is formed by a slit which is provided in the cathode side of the third electrode of an in-line arrayal electron gun, and a fluorescent screen is bombarded with an electron beam through the rotationally-asymmetric lens in at least one place, in which the depth of the slit in the axial direction of the electron gun is made greater for a center beam than for a side beam (Official Gazette of Japanese Patent Laid-open No. 81736/1985).

SUMMARY OF THE INVENTION

The requirements of focus characteristics in a cathode-ray tube are that resolutions in all the current ranges of an electron beam are favorable over the whole area of a screen, that moiré does not appear in the low current range, and that the resolutions of the whole screen in all the current ranges are uniform. High degrees of skills are necessitated for the design of an electron gun which satisfies a plurality of such features at the same time.

Researches by the inventors of the present invention have revealed that the combination between a lens with astigmatism and a main lens of large aperture is indispensable to endowing the cathode-ray tube with the above several features.

With any of the prior-art techniques, however, the electrodes for forming the astigmatic lens or the rotationally-asymmetric lens in the electron gun are employed, and a contrivance such as the application of a dynamic focus voltage to the focusing electrode of the electron gun is needed for attaining the favorable resolution over the whole area of the screen. It is not considered that a plurality of astigmatic lenses are employed to utilize the synergy thereof, or that the rotationally-asymmetric lens is formed of an increased number of electrodes so as to improve the overall focus characteristics under the composite action of the characteristics of the individual electrodes, thereby to obtain a reproduced picture having the favorable resolution in the whole area of the screen.

By way of example, FIGS. 53A and 53B are a general side view and a partial sectional view of essential portions for explaining an electron gun (of the EA-UB type), respectively. As shown in the figures, the electron gun has a first electrode 1 (G1), a second electrode 2 (G2), a third electrode 3 (G3), a fourth electrode 4 (G4), a fifth electrode 5 (G5) and a sixth electrode 6 (G6) as reckoned from the side of the cathode of this electron gun. In the electron gun, all of electric fields based on the lengths of the individual electrodes, the diameters of electron-beam apertures provided in them, etc. exert different influences on electron beams. More specifically, the shape of the electron-beam aperture of the first electrode 1 nearest to the cathode governs the spot shape of the electron beam in a small current range, and the shape of the electron-beam aperture of the second electrode 2 governs the spot shapes of the electron beams in the small current range to a large current range. Further, in a case where a main lens is formed between the fifth electrode 5 and the sixth electrode 6 by applying an anode voltage to the sixth electrode 6, the shapes of the electron-beam apertures of the fifth electrode 5 and sixth electrode 6 constituting the main lens are greatly influential on the spot shape of the electron beam in the large current range, but their influences on the spot shape of the electron beam in the small current range are less than in the large current range. Besides, the length of the fourth electrode 4 of the electron gun in the axial direction of a cathode-ray tube influences the magnitude of the optimum focus voltage and conspicuously influences the difference between the respective optimum focus voltages in the small current mode and the large current mode, but variation in the length of the fifth electrode 5 in the axial direction of the cathode-ray tube influences them much less than variation in the length of the fourth electrode 4. For optimizing the individual characteristic values of the electron beams, accordingly, it is necessary to rationalize the structures of the electrodes which act on the respective characteristics most effectively.

Meanwhile, in case of narrowing the pitch of a shadow mask in a direction orthogonal to the electron-beam scanning of the cathode-ray tube or increasing the density of electron-beam scanning lines in order to enhance the resolution in the direction orthogonal to the electron-beam scanning, the electron beam and the shadow mask incur optical interference particularly in the small current range of the electron beam, and hence, a moiré contrast needs to be made appropriate.

An object of the present invention is to eliminate the problems of the prior-art techniques, and to provide an electron gun having a construction which can enhance focus characteristics over the whole area of a screen and in all the current ranges of electron beams, can attain a favorable resolution and can reduce moire in the small current range without especially supplying a dynamic focus voltage, and a cathode-ray tube including this electron gun.

Another object of the present invention is to provide an electron gun which can enhance the focus characteristics and can simultaneously prevent the increase of loading on a cathode, and a cathode-ray tube including this electron gun.

The first-mentioned object is accomplished by including, among a plurality of electrodes constitutive of an electron gun, an electrode for forming an electrostatic lens exhibiting focus characteristics by which the spot of an electron beam in a large current range at the central part of a fluorescent screen is shaped to be substantially circular, and according to which an appropriate focus voltage acting in the specified scanning direction of the electron beam, for example, in the horizontal scanning direction thereof is higher than an appropriate focus voltage acting in a direction orthogonal to the scanning direction, for example, in the vertical scanning direction of the electron beam, and an electrode for forming an electrostatic lens exhibiting focus characteristics by which the spot of an electron beam in a small current range at the central part of the fluorescent screen is shaped to be substantially circular or to have a larger diameter in the direction orthogonal to the horizontal scanning direction (in the vertical scanning direction) than in the horizontal scanning direction, and according to which the appropriate focus voltage acting in the horizontal scanning direction is higher than the appropriate focus voltage acting in the vertical scanning direction.

By way of example, in an electron gun of the so-called U-B type (the UPF-BPF hybrid type) wherein a first electrode, a second electrode, a third electrode, a fourth electrode, a fifth electrode and a sixth electrode are arranged in this order as reckoned from the cathode side and wherein at least the second and fourth electrodes have control voltages applied thereto, while at least the third and fifth electrodes have focus voltages applied thereto, the first-mentioned object is accomplished by endowing at least two of the plurality of electrodes with structures which generate rotationally-asymmetric electric fields.

Further, when besides the above electrode construction, the electron-beam aperture of at least one of the electrodes near to the cathode of the electron gun (for example, the first and second electrodes) is so shaped as to have a smaller diameter in a direction (for example, the vertical scanning direction of an electron beam) orthogonal to the scanning direction of the electron beam, than in this scanning direction (the horizontal scanning direction), focus characteristics are more enhanced especially in a small current range.

In addition, in a case where the increase of loading on the cathode attendant upon the reduction of the diameter of the electron-beam aperture of the first electrode needs to be relieved, the diameter of the electron-beam aperture of the first electrode in the horizontal scanning direction may be enlarged in correspondence with the extent of the diameter thereof made smaller in the vertical scanning direction, so as to avoid diminishing the open area of the electron-beam aperture.

In accordance with the present invention, at least two of electric fields which are established by a plurality of electrostatic lenses formed by the plurality of electrodes constituting the electron gun are set as the rotationally-asymmetric electric fields, thereby to form the electrostatic lens exhibiting the focus characteristics by which the spot of the electron beam in the large current range at the central part of the fluorescent screen is shaped to be substantially circular, and according to which the appropriate focus voltage acting in the scanning direction of the electron beam is higher than the appropriate focus voltage acting in the direction orthogonal to the scanning direction, and the electrostatic lens exhibiting the focus characteristics by which the spot of the electron beam in the small current range at the central part of the fluorescent screen is shaped to have the diameter in the direction orthogonal to the scanning direction, adapted to the pitch of a shadow mask and the density of scanning lines in the direction orthogonal to the scanning direction, and according to which the appropriate focus voltage acting in the scanning direction is higher than the appropriate focus voltage acting in the direction orthogonal to the scanning direction. The lenses based on the rotationally-asymmetric electric fields bring forth the preferable focus characteristics which afford good resolutions without moiré in the whole area of the fluorescent screen and in all the current ranges of the electron beam.

Moreover, the diameter of the electron-beam aperture of the electrode near to the cathode (for example, the first electrode or second electrode) in the direction orthogonal to the scanning direction is made smaller, whereby an image at a crossover point formed in the vicinity of a prefocusing lens near to the cathode can be controlled at will, and the reduction of the diameter of the spot of the electron beam in the direction orthogonal to the scanning direction becomes remarkably effective especially in the small current range.

Furthermore, the diameter of the electron-beam aperture of the first electrode in the scanning direction is enlarged to prevent the loading on the cathode from increasing, whereby the shortening of the lifetime of a cathode-ray tube including the electron gun can be suppressed.

Incidentally, the expression "rotationally asymmetric" used in the present invention signifies any shape other than shapes such as a circle, each of which is depicted by the locus of points equally distant from the center of rotation. For example, a "rotationally-asymmetric" beam spot is a noncircular beam spot.

BRIEF DESCRIPTION OF THE DRAWINGS

FIG. 21 is a diagram for explaining the combinations of the electrodes of an electron gun for forming rotationally-asymmetric lenses according to the present invention;

FIG. 24 is a diagram for explaining the combinations of electrodes for forming rotationally-asymmetric electric fields in the case where the present invention is applied to electron guns of typical types;

FIG. 4 is a schematic view for explaining a color cathode-ray tube of the shadow mask type which has an in-line type electron gun;

DESCRIPTION OF THE PREFERRED EMBODIMENTS

First of all, there will be described mechanisms in which the focus characteristics and resolution of a cathode-ray tube are enhanced on the basis of the adoption of an electron gun according to the present invention.

Figure 42:
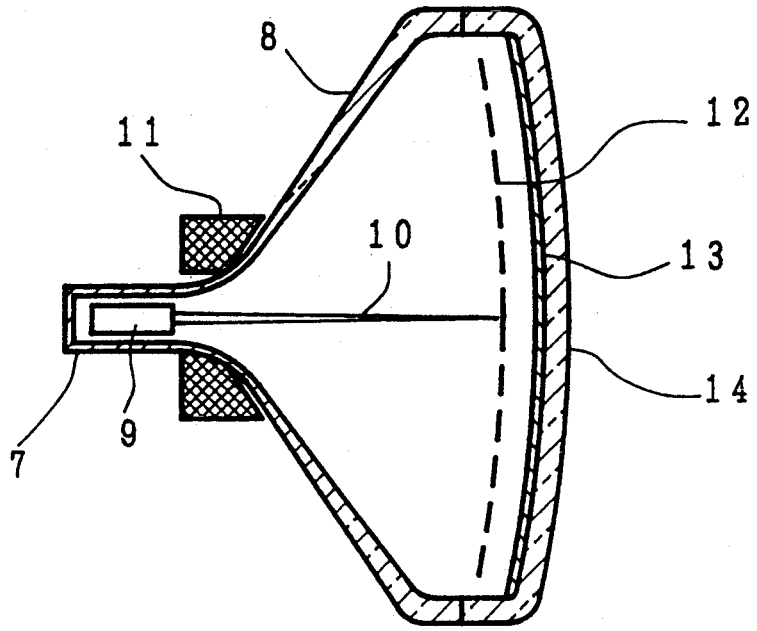

FIG. 42 is a schematic view for explaining the section of a shadow mask type color cathode-ray tube which includes an in-line type electron gun. In the figure, numeral 7 designates a neck, numeral 8 a funnel, numeral 9 the electron gun accommodated in the neck 7, numeral 10 an electron beam, numeral 11 a deflection yoke, numeral 12 a shadow mask, numeral 13 a fluorescent film, and numeral 14 a panel (screen).

Referring to the figure, with the cathode-ray tube of this type, while being deflected in horizontal and vertical directions by the deflection yoke 11, the electron beam 10 projected from the electron gun 9 is passed through the shadow mask 12, thereby causing the fluorescent film 13 to fluoresce, and a pattern based on the fluorescence is observed as a picture from the side of the panel 14.

Figure 43:
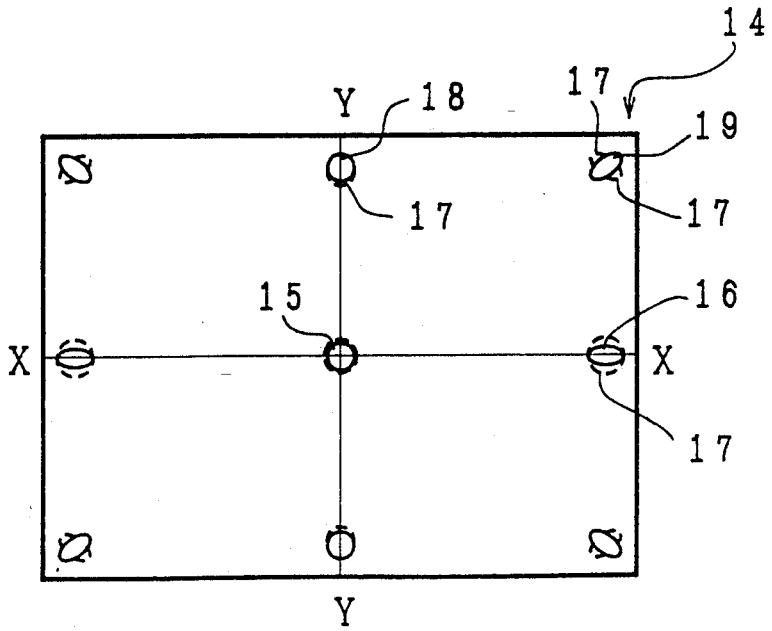
FIG. 43 is a view for explaining electron-beam spots in the case where the marginal parts of a screen are caused to fluoresce with an electron beam which forms a circular spot at the central part of the screen.

FIG. 43 is a view for explaining electron-beam spots in the case where the marginal parts of a screen are caused to fluoresce by an electron beam whose spot becomes circular at the central part of the screen. In the figure, numeral 14 designates the screen, numeral 15 the beam spot formed at the central part of the screen, numeral 16 the beam spot formed at the end of the screen in the horizontal direction (X—X direction) thereof, numeral 17 each halo, numeral 18 the beam spot formed at the end of the screen in the vertical direction (Y—Y direction) thereof, and numeral 19 the beam spot formed at the end of the screen in the diagonal direction thereof (at the corner part of the screen).

In order to simplify convergence adjustments, the recent color cathode-ray tube employs an inhomogeneous magnetic-field distribution wherein a horizontal deflecting field is in the shape of a pincushion, while a vertical field is in the shape of a barrel. The shape of the fluorescent spot based on the electron beam 10 in FIG. 42 becomes noncircular at the marginal part of the screen for the reasons that the magnetic field distribution is as stated above, that the electron beam 10 has different orbits for the central part of the fluorescent screen and the marginal part thereof, and that the electron beam 10 impinges obliquely against the fluorescent film 13 at the marginal part of the screen. As shown in FIG. 43, the spot 16 at the horizontal end becomes laterally long unlike the circular spot 15 at the central part and undergoes the halo 17. Consequently, the size of the spot 16 at the horizontal end enlarges, and the contour of the spot 16 becomes unclear due to the appearance of the halo 17, so that the resolution degrades to drastically lower the picture quality. Further, in a case where the current of the electron beam 10 is small, the diameter of the electron beam 10 in the vertical direction contracts excessively, and the electron beam 10 optically interferes with the pitch of the shadow mask 12 in the vertical direction, to present the moire phenomenon and to incur the lowering of the picture quality.

Meanwhile, since the electron beam 10 is converged in the vertical direction by the vertical deflecting field, the spot 18 at the vertical end of the screen presents a shape of lateral collapse and undergoes the halo 17 to incur the lowering of the picture quality.

The electron-beam spot 19 at the corner part of the screen becomes laterally long like the spot 16 and laterally collapsing like the spot 18 under a synergetic action. Moreover, it involves the rotation of the electron beam 10. Accordingly, not only the haloes 17 appear, but also the diameter of the fluorescent spot itself enlarges, so that the picture quality is drastically lowered.

Figure 44:
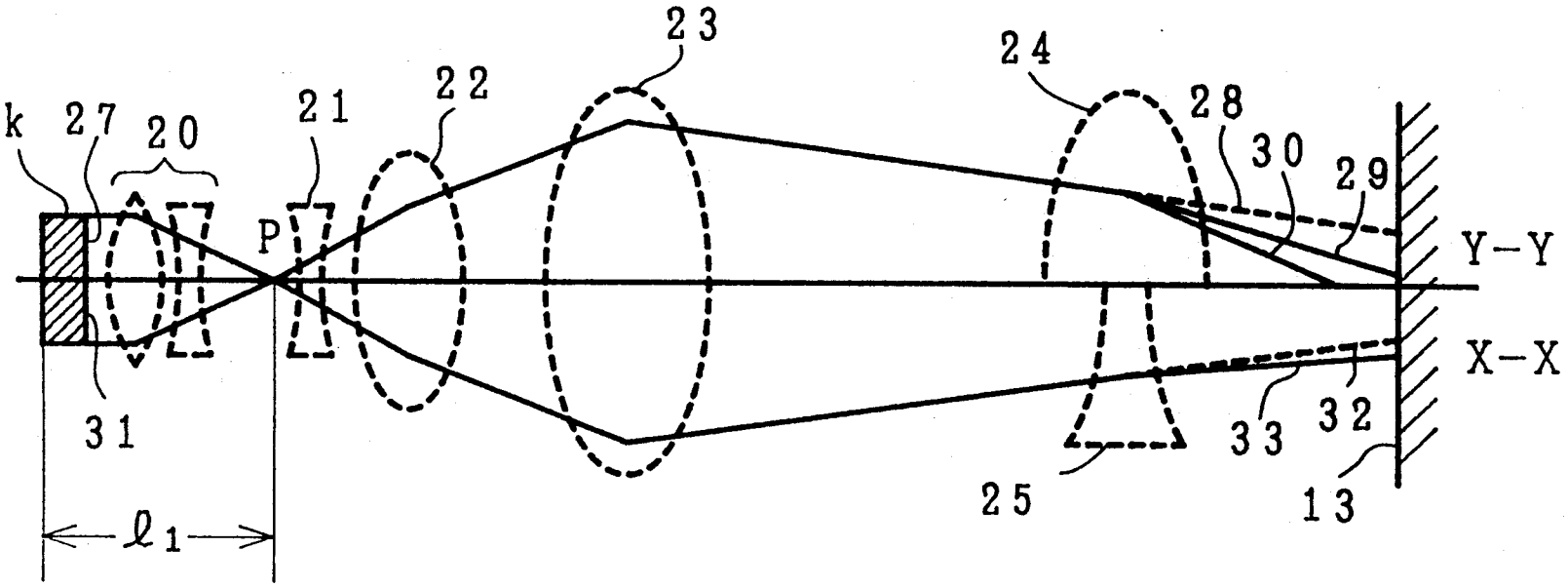
FIG. 44 is a schematic view of the electron-optical system of an electron gun for explaining the changes of the electron-beam spot shapes in FIG. 43.

FIG. 44 is a schematic view of the electron-optical system of the electron gun for explaining the changes of the electron-beam spot shapes stated above. In the figure, the foregoing system is replaced with the optical system in order to facilitate understanding.

In FIG. 44, the upper half shows the vertical (Y—Y) section of the screen, and the lower half the horizontal (X—X) section thereof.

Herein, numerals 20 and 21 indicate prefocusing lenses, numeral 22 indicates a preceding-stage main lens, and numeral 23 indicates a main lens. These lenses constitute the electron-optical system which corresponds to the electron gun 9 in FIG. 42. Another lens 24 is formed by the vertical deflecting field. Numeral 25 denotes an equivalent lens which takes into account a lens formed by the horizontal deflecting field, and the fact that the electron beam 10 is apparently stretched in the horizontal direction because it impinges obliquely against the fluorescent film 13 on the basis of the deflection.

Referring to FIG. 44, an electron beam 27 which has been emitted from a cathode K and whose section is taken in the vertical direction of the screen forms a crossover P at a distance (1 from the cathode K between the prefocusing lenses 20 and 21, and it is thereafter converged toward the fluorescent film 13 by the preceding-stage main lens 22 as well as the main lens 23. At the central part of the screen where the deflection is null, the electron beam 27 impinges on the fluorescent film 13 along an orbit 28, but at the marginal part of the screen, it is turned into the laterally-collapsing beam spot along an orbit 29 under the action of the lens 24 which is formed by the vertical deflecting field. Further, since the main lens 23 has spherical aberration, part of the electron beam 27 focuses before reaching the fluorescent film 13 as indicated by an orbit 30. These are the reasons for the appearances of the halo 17 of the spot 18 at the vertical end of the screen and the haloes 17 of the spot 19 at the corner part as shown in FIG. 43.

On the other hand, an electron beam 31 which has been emitted from the cathode K and whose section is taken in the horizontal direction of the screen is converged by the prefocusing lenses 20, 21, preceding-stage main lens 22 and main lens 23 likewise to the electron beam 27 taken as the vertical section, until it impinges on the fluorescent film 13 along an orbit 32 at the central part of the screen where the action of the deflecting magnetic field is null. Even in the region where the deflecting magnetic field acts, no halo appears in the horizontal direction owing to the diverging action of the lens 25 formed by the horizontal deflecting field though the electron beam 31 forms the laterally-long spot along an orbit 33. In this region, however, the distance between the main lens 23 and the fluorescent film 13 becomes longer than at the central part of the screen. Therefore, even at the horizontal end 16 in FIG. 43 where no deflecting action in the vertical direction is involved, part of the electron beam focuses before reaching the fluorescent film 13 in the vertical section, so that the halo 17 appears. In this manner, when the spot shape of the electron beam at the central part of the screen is made circular by the rotationally-symmetric lens system of the structure in which the lens systems of the electron gun are the same in both the horizontal and vertical directions, the spot shapes of the electron beam at the marginal parts of the screen become distorted to drastically lower the picture quality.

Figure 45:
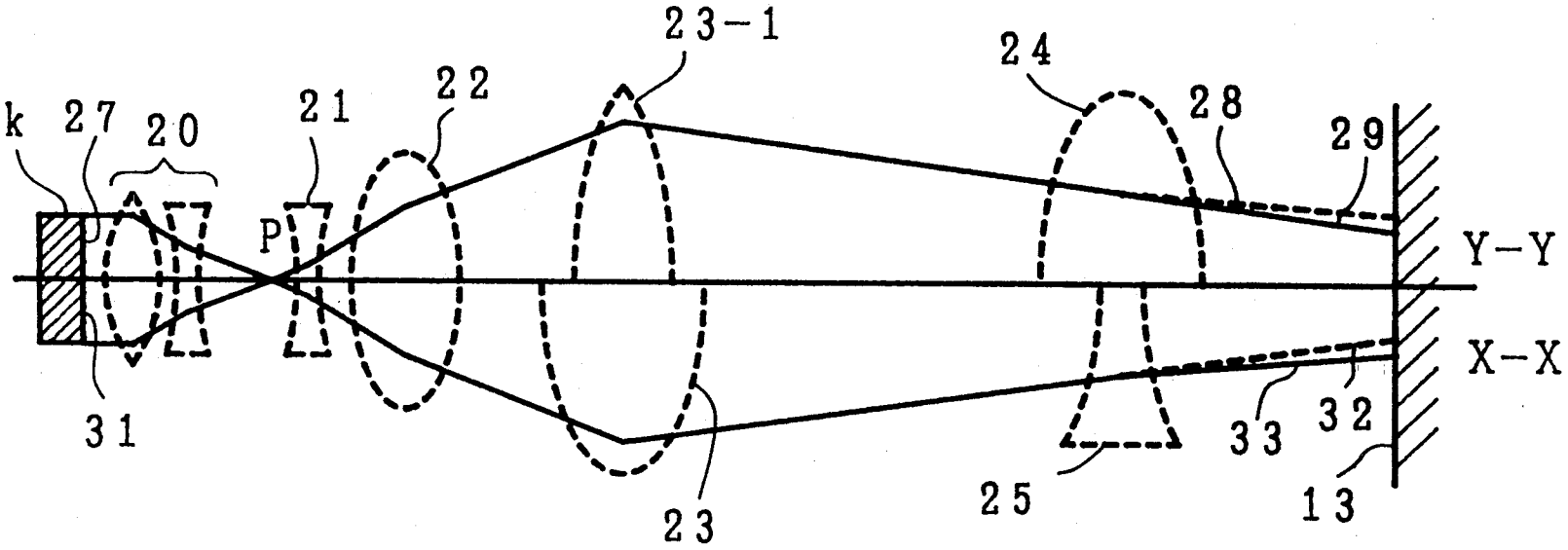
FIG. 45 is a view for explaining means for suppressing the degradations of a picture quality at the marginal parts of the screen as illustrated in FIG. 44.

FIG. 45 is an explanatory view of means for suppressing that lowering of the picture quality at the marginal parts of the screen which has been elucidated with reference to FIG. 44.

As illustrated in FIG. 45, the converging action of a main lens 23-1 in the vertical (Y—Y) section of the screen is rendered weaker than that of a main lens 23 in the horizontal (X—X) section. Thus, even after the electron beam has passed through a lens 24 formed by the vertical deflecting field, it proceeds along an orbit 29 depicted in the figure, so that the extreme lateral collapse as shown in FIG. 44 does not occur, and the haloes are less prone to appear. However, an orbit 28 at the central part of the screen shifts in the direction of enlarging the spot diameter of the electron beam.

Figure 46:
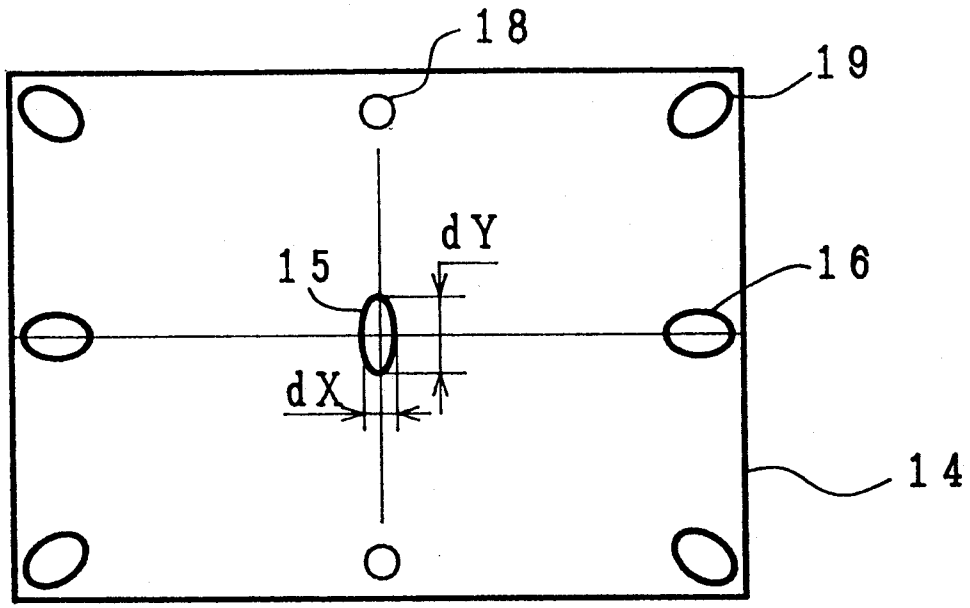
FIG. 46 is a schematic view for explaining electron-beam spot shapes on a fluorescent screen in the case where a lens system shown in FIG. 45 is employed.

FIG. 46 is a schematic view for explaining electron-beam spot shapes on the fluorescent screen 14 in the case of employing the lens system shown in FIG. 45. The haloes are suppressed in the spot 16 at the horizontal end, the spot 18 at the vertical end and the spot 19 at the corner part, in other words, in the spots at the marginal parts of the screen, so that the resolutions at these parts are enhanced. The spot 15 at the central part of the screen, however, has its vertical diameter dY made larger than its horizontal diameter dx, so that the resolution in the vertical direction lowers. Accordingly, with the rotationally-asymmetric electric-field system of the structure in which the converging effects of the main lens 23 in the vertical and horizontal directions of the screen are different, no fundamental solution is given in view of the object of simultaneously enhancing the resolutions over the whole screen.

Figure 47:
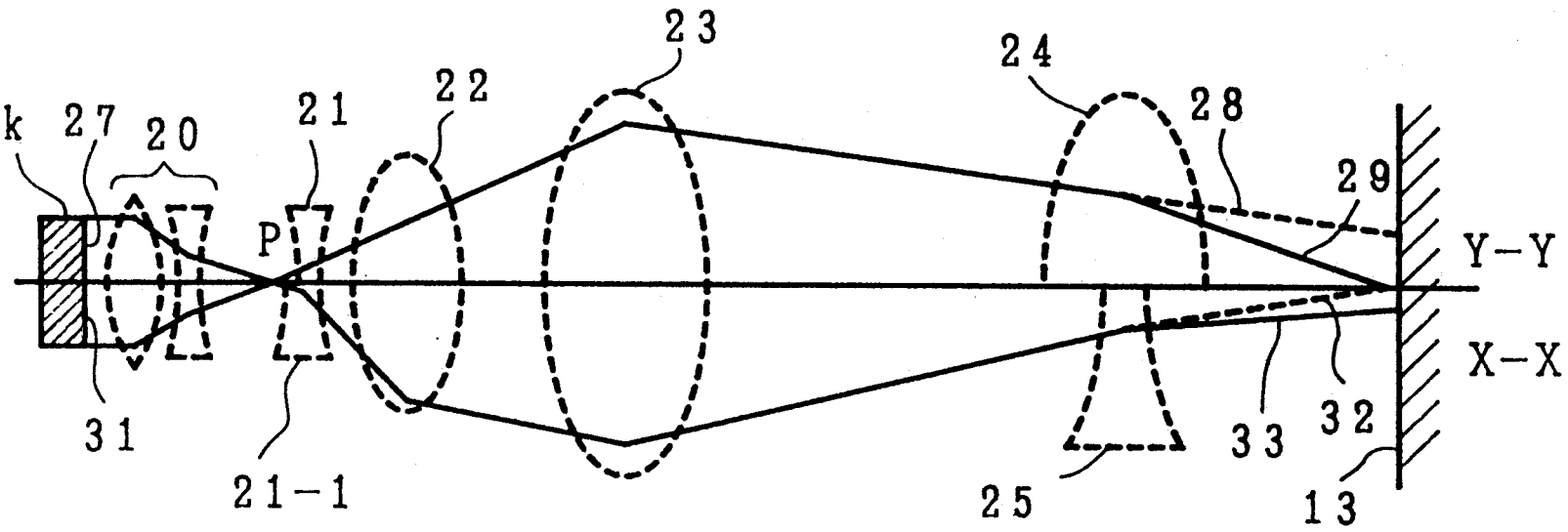
FIG. 47 is a schematic view of the electron-optical system of an electron gun in which the horizontal lens intensity of a prefocusing lens is heightened instead of rendering the lens intensity of a main lens rotationally asymmetric.

FIG. 47 is a schematic view of the electron-optical system of the electron gun in which the horizontal (X—X) lens intensity of a prefocusing lens is heightened instead of putting the lens intensity of a main lens 23 into the rotational asymmetry. More specifically, the intensity of a horizontal prefocusing lens 21-1 for diverging the image of a crossover point P is rendered higher than that of a vertical prefocusing lens 21, to increase the angle of incidence of an electron beam 31 on a preceding-stage main lens 22 and to enlarge the diameter of the electron beam passing through the main lens 23, whereby the spot diameter of the electron beam in the horizontal direction can be reduced on the fluorescent film 13. Since, however, electron-beam orbits in the vertical direction of the screen are the same as shown in FIG. 44, the effect of suppressing the haloes is not produced.

Figure 48:
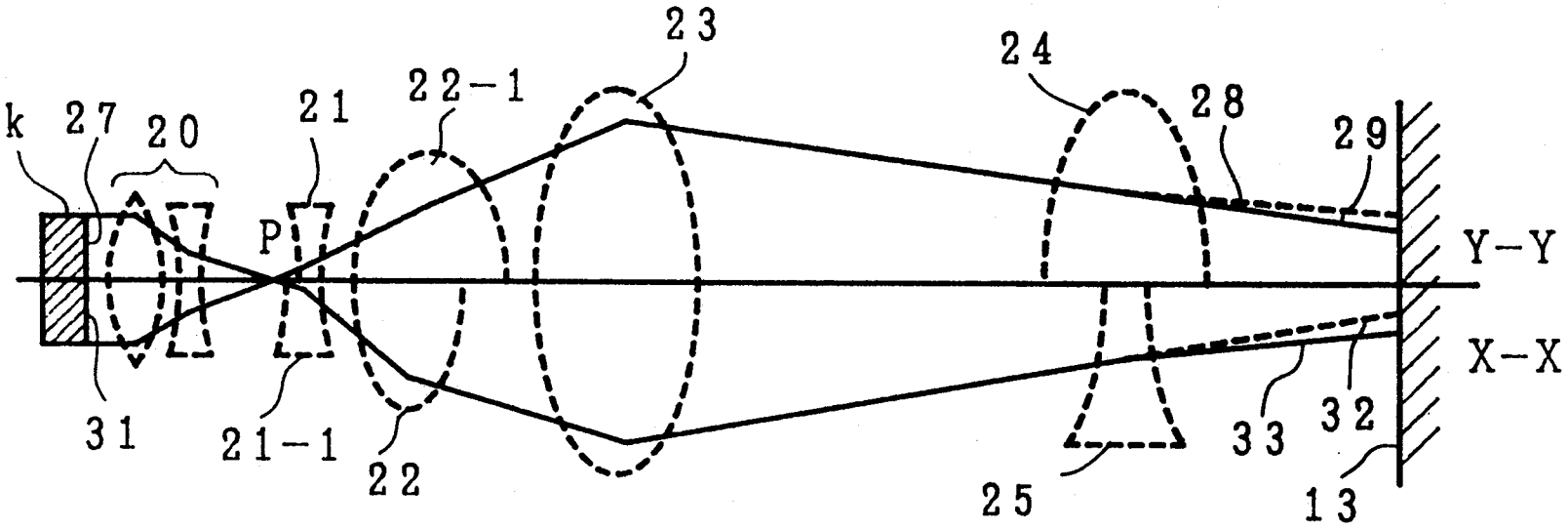
FIG. 48 is a schematic view of the electron-optical system of an electron gun in which the effect of suppressing haloes is added to the construction of FIG. 47.

FIG. 48 is a schematic view of the electron-optical system of the electron gun in which the above construction in FIG. 47 is endowed with the effect of suppressing the haloes. A preceding-stage main lens has its vertical (Y—Y) lens intensity heightened as shown at symbol 22-1, whereby the electron-beam orbit of the main lens 23 in the vertical direction is brought nearer to an optical axis, to construct a focusing system of great focal depth. Accordingly, the haloes 28 become less offensive to the eye, and the resolution is enhanced.

Figure 49:
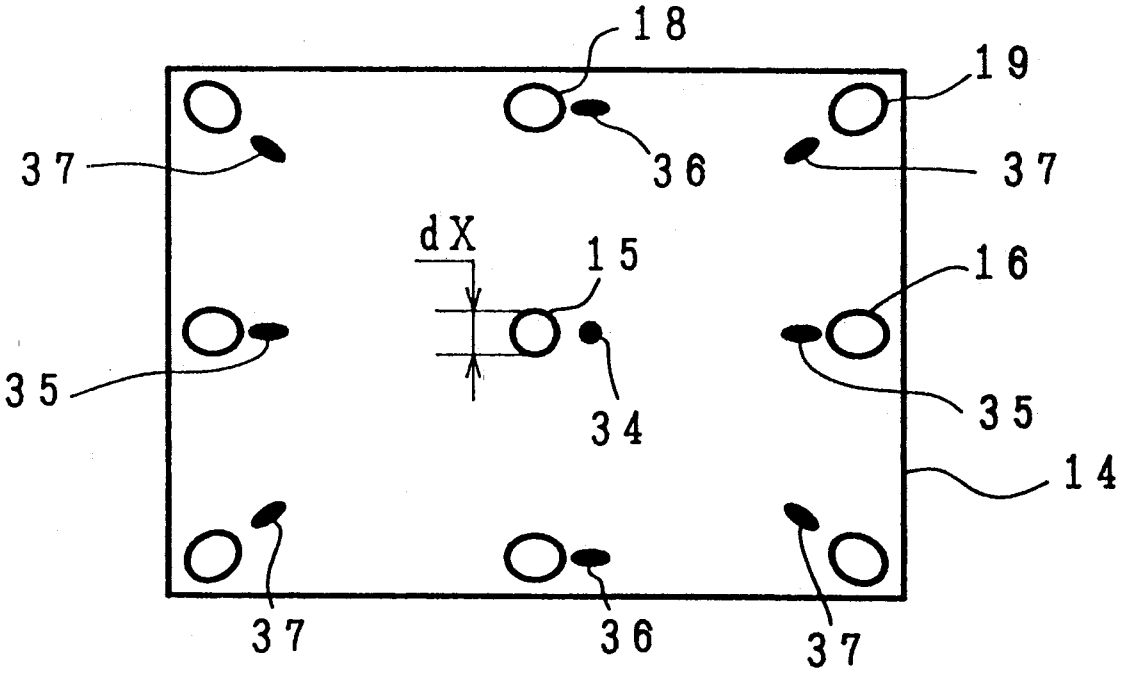
FIG. 49 is a schematic view for explaining the spot shapes of electron beams on a screen in the case where the lens system of FIG. 48 is employed.

FIG. 49 is a schematic view for explaining the spot shapes of electron beams on the screen 14 in the case where the lens system in FIG. 48 is employed. A situation where a favorable resolution involving no halo is attained over the whole screen, is seen from FIG. 49.

Thus far, there have been described the electron-beam spot shapes in the case (a large current range) where the amounts of currents of the electron beams are comparatively large. However, in a case (a small current range) where the amounts of currents of electron beams are small, the orbits of the electron beams pass only near the axis of the focusing system, and hence, the differences between the lens intensities of the large-aperture lenses 21, 22 and 23 in the horizontal direction and the vertical direction exert little influences. As shown at numerals 34, 35, 36 an 37 in FIG. 49, accordingly, the spots of the electron beams become circular at the central part of the screen and laterally long (long in the horizontal direction) at the marginal parts of the screen, to form a cause for the appearance of moire, and to lower the resolution due to increases in the lateral diameters (diameters in the horizontal direction) of the beam spots. As a countermeasure, the circumstances need to be coped with by a lens which has a small aperture and which is so located that the rotational asymmetry of its lens intensity influences even the vicinity of the axis of the focusing system.

Figure 50:
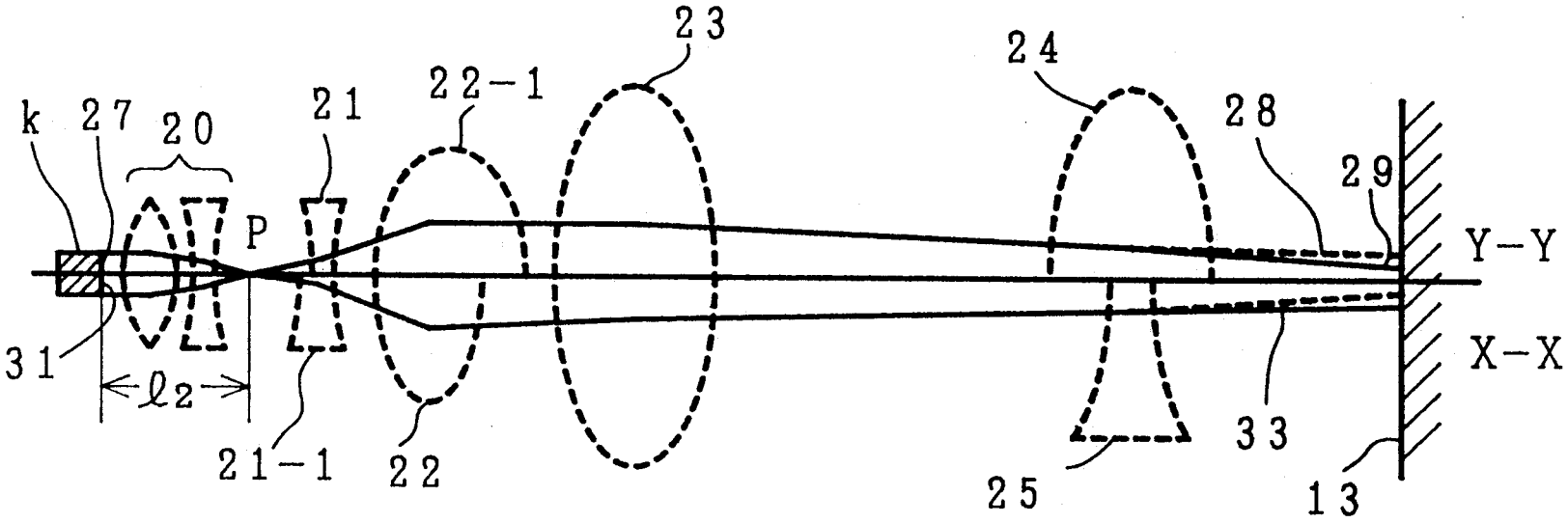
FIG. 50 is a schematic view for explaining the orbits of electron beams in a small current mode.

FIG. 50 is a schematic view for explaining the orbits of the electron beams in the small current mode. In this case, a distance $l_2$ from the cathode K to the crossover point P becomes shorter than the corresponding distance $l_1$, in FIG. 44.

Figure 51:
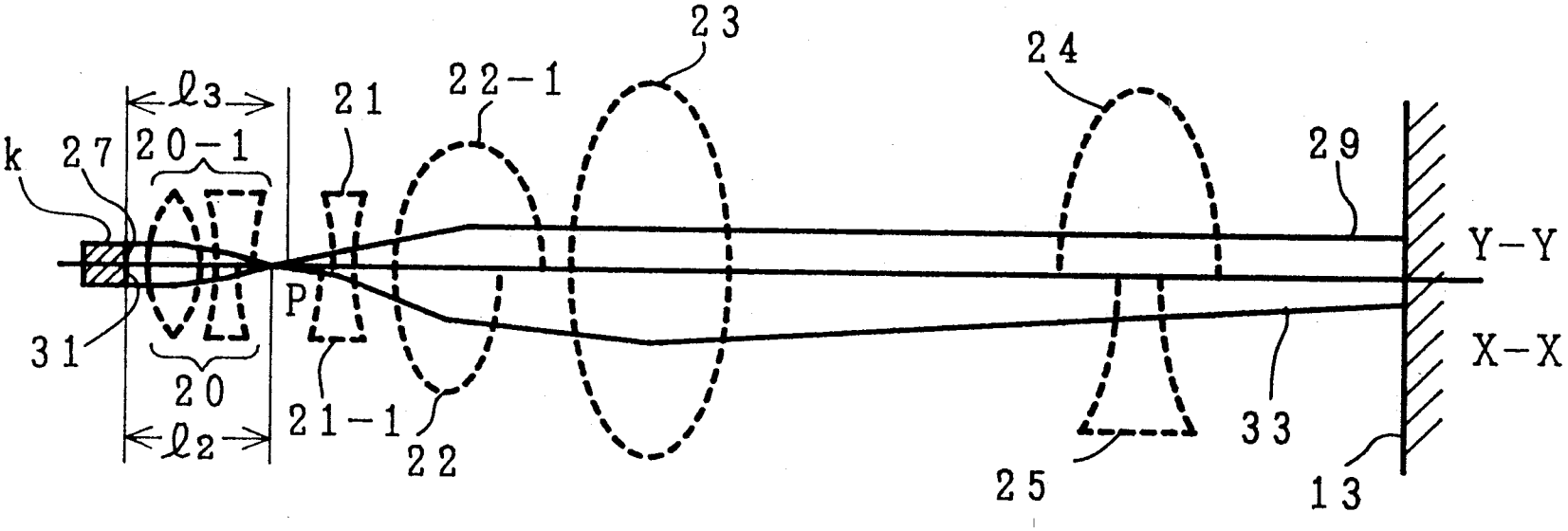
FIG. 51 is a schematic view showing the optical system of an electron gun in the case where a divergent lens in a prefocusing lens has its lens intensity heightened in the vertical direction of a screen.

FIG. 51 is a schematic view showing the optical system of the electron gun in the case where the lens intensity in the vertical direction (Y—Y) of the screen is heightened on the side of the diverging lens within the prefocusing lens. More specifically, the vertical intensity of the diverging lens constituting the prefocusing lens 20 is increased, whereby the distance $l_3$ of the crossover point P from the cathode K becomes longer than the aforementioned distance $l_2$. Consequently, the position at which the electron beam 27 in the vertical section enters the prefocusing lens 21 becomes still nearer to the optical axis than in the case of FIG. 50, and the lens effects of the lenses 21, 22-1 and 23 decrease, to construct a focusing system whose focal depth is great in the vertical direction of the screen. However, the influences of the individual lenses in the large current mode and the small current mode are not perfectly independent, but the lens effect of the vertical prefocusing lens 20-1 shown in FIG. 51 influences the spot shape of the electron beam in the large current mode. Therefore, a system which is balanced as a whole needs to be constructed by exploiting the characteristics of the respective lenses. In particular, the structure of the main lens, the specified item of the picture quality to be enhanced more, etc. differ depending upon the intended use of the cathode-ray tube, so that the position of the rotationally-asymmetric lens and the lens intensities of the individual lenses are not uniquely determined. Moreover, as stated before, in the ordinary use of the cathode-ray tube, the lenses which form the rotationally-asymmetric electric fields at the separate parts in the large current range and the small current range need to be disposed for enhancing the resolutions in both the current ranges. In addition, the change of an electric field intensity by the rotational asymmetry of each lens is limited. Besides, at some lens positions, the increase of the intensity of the rotationally-asymmetric electric field distorts the beam shape extremely and forms a cause for lowering the resolution.

Upon the above consideration, in order to enhance the resolutions over the whole screen in all the current ranges, the electron beam may be passed through the deflecting magnetic fields with its cross section held in the laterally-long state. This necessitates a focusing system (lens system) which has rotationally-asymmetric electric fields in a plurality of places (in, at least, two places, and preferably, in three places) of the electron gun.

Figure 52:
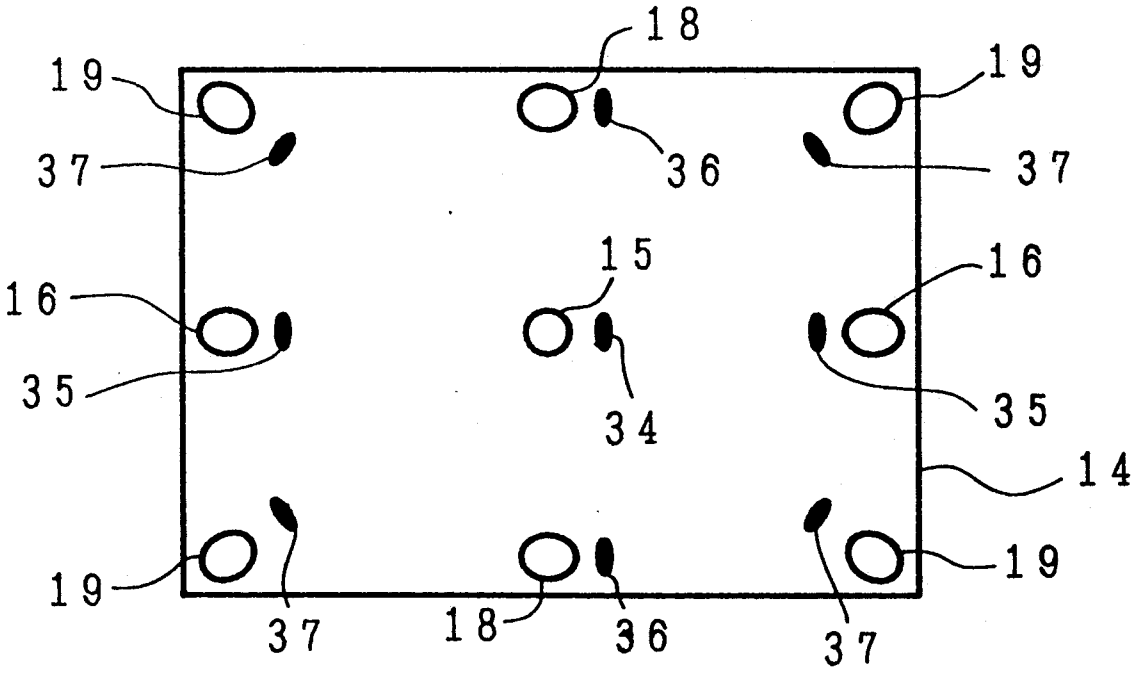
FIG. 52 is a schematic view for explaining the shapes of fluorescent spots on the screen as based on respective electron beams in a large current range and a small current range, in the case where the focusing system shown in FIG. 51 is employed.

FIG. 52 is a schematic view for explaining the shapes of fluorescence spots which are formed on the screen 14 by the respective electron beams in the large current range and the small current range when the focusing system shown in FIG. 51 is employed.

As illustrated in FIG. 52, the electron-beam spots are made substantially circular in the large current range and vertically long in the small current range, whereby both the beam spots (15, 16, 18, 19) in the large current range and the beam spots (34, 35, 36, 37) in the small current range involve neither the spread of the spot shapes nor the haloes, and a picture of enhanced resolution exhibiting good focus characteristics over the whole area of the fluorescent screen can be obtained.

Now, practical embodiments of the present invention will be described with reference to the drawings.

Figure 1A:
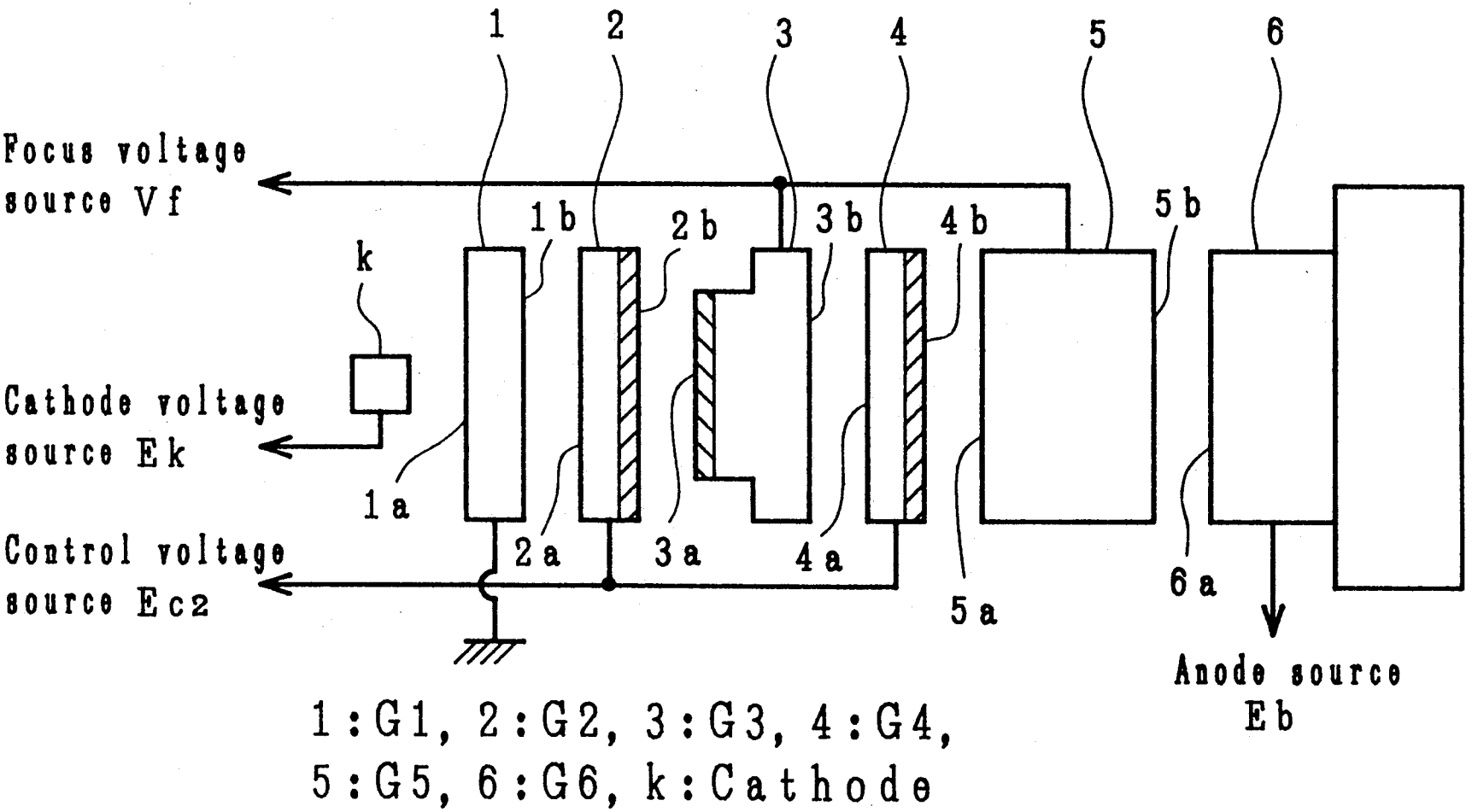
FIGS. 1A to 1E are views for explaining the first embodiment of an electron gun according to the present invention.
Figure 1B:
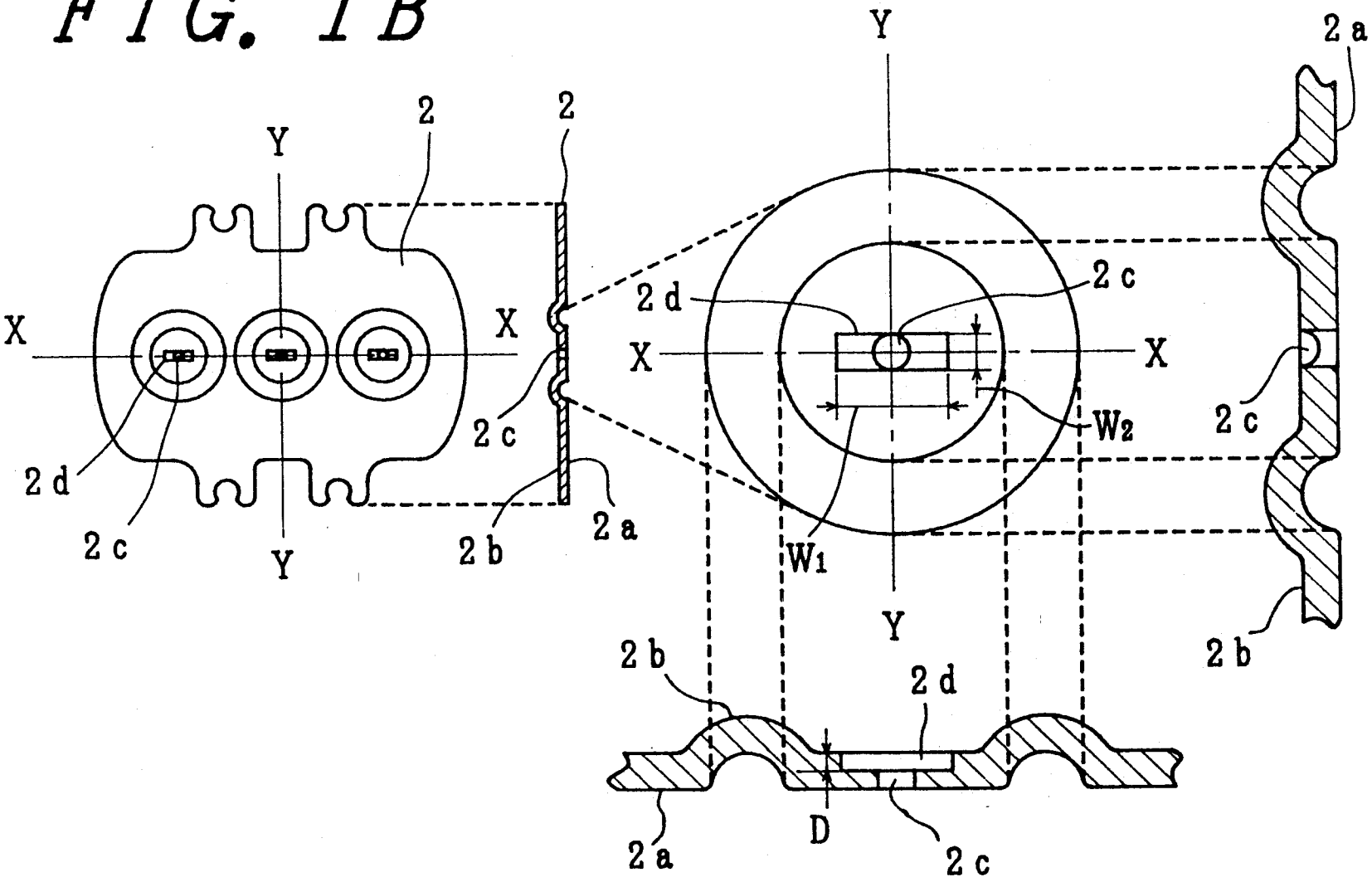
Figure 1C:
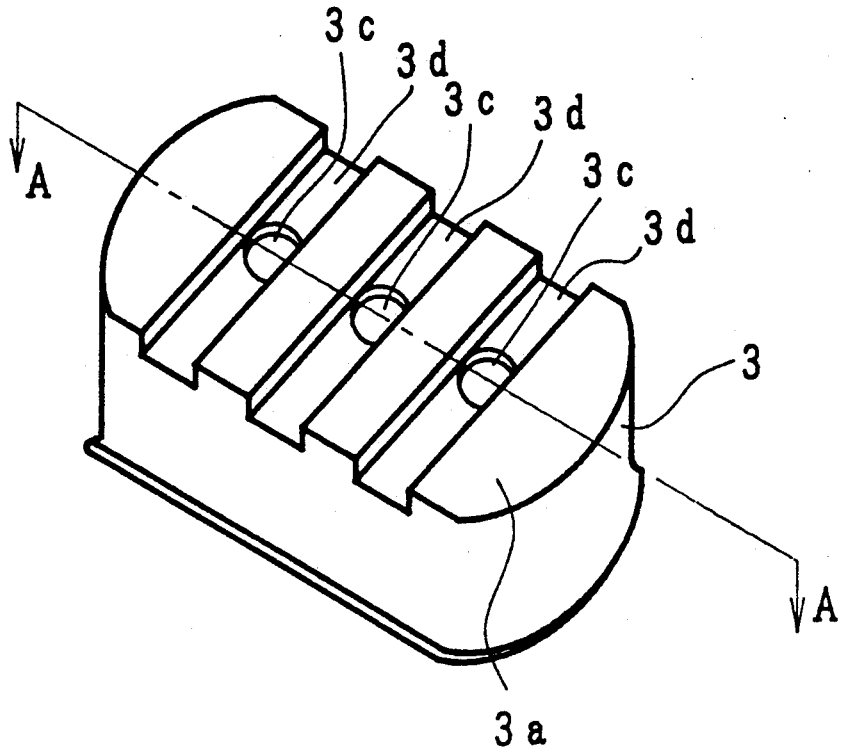
Figure 1D:
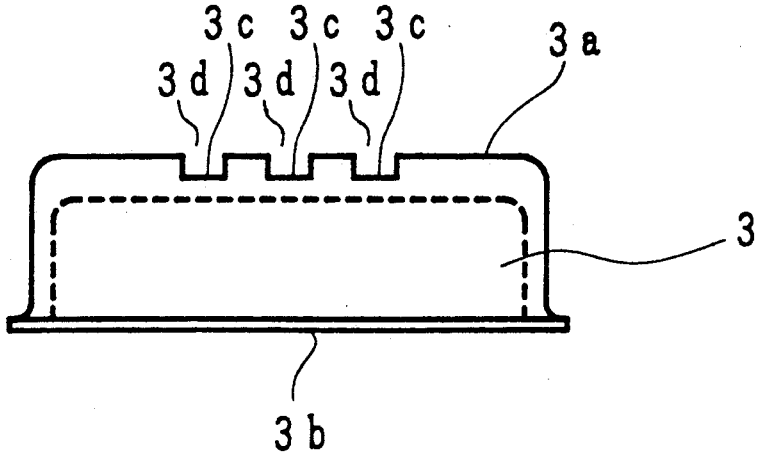
Figure 1E:
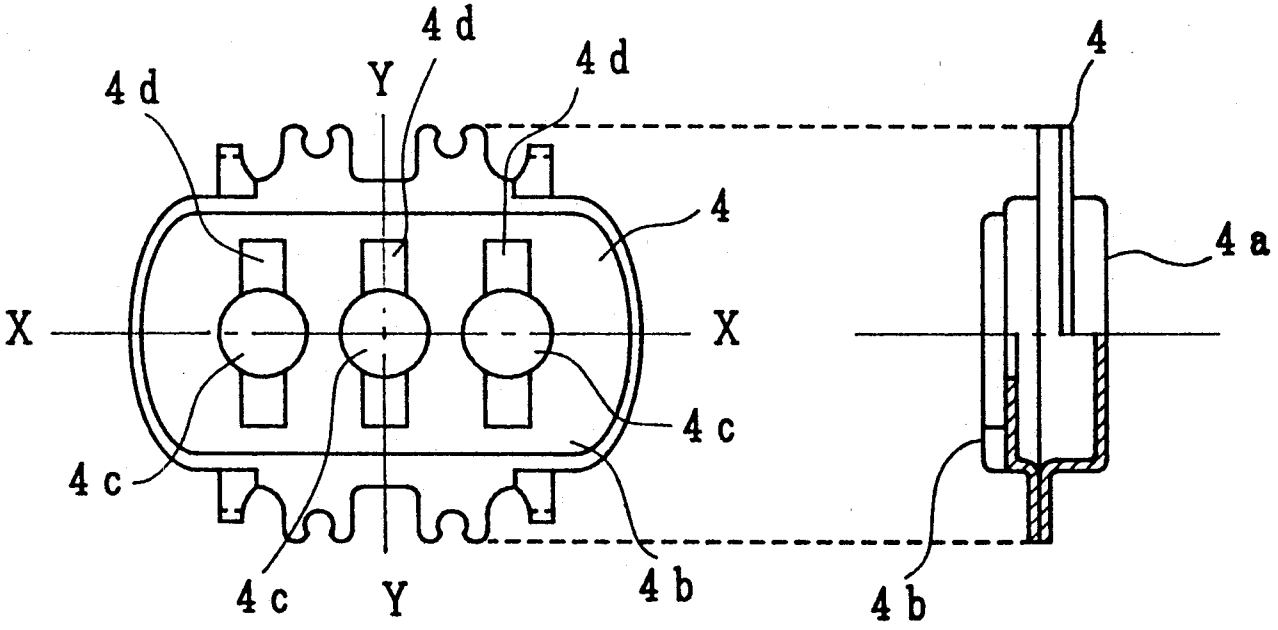

FIGS. 1A to 1E are explanatory views of the first embodiment of an electron gun according to the present invention; in which FIG. 1A is a schematic view showing an electrode scheme, FIG. 1B is a detailed view of a second electrode (G2), FIG. 1C is a perspective view of a third electrode (G3), FIG. 1D is a sectional view of the third electrode (G3), and FIG. 1E is a detailed view of a fourth electrode (G4).

Referring to the figures, numerals 1, 2, 3, 4, 5 and 6 designate a first electrode (G1), the second electrode (G2), the third electrode (G3), the fourth electrode (G4), a fifth electrode (G5) and a sixth electrode (G6), respectively, and letter K denotes a cathode. Herein, the side surface (electron-beam) entrance side) of each electrode closer to the cathode K is indicated by affixing letter a to the No. of the electrode, while the side surface (electron-beam exit side) of each electrode closer to the sixth electrode G6 is indicated by affixing letter b to the No. of the electrode. By way of example, the side surface of the second electrode G2 closer to the cathode K is the entrance *2a*, and the side surface thereof closer to the electrode G6 is the exit *2b*. In addition, the electron-beam aperture of each electrode is indicated by affixing letter c to the No. of the electrode.

In the electrode scheme of FIG. 1A, the electrode G1 is grounded, a control voltage Ec2 is applied to the electrodes G2 and G4, a focus voltage Vf is applied to the electrodes G3 and G5, and an anode voltage Eb is applied to the electrode G6.

In the embodiment shown in FIGS. 1A-1E, as means for establishing electric fields (rotationally-asymmetric electric fields) for forming rotationally-asymmetric lenses, slits are provided around respective electron-beam aperatures *2c*, *3c* and *4c* in the exit *2b* of the electrode G2, the entrance *3a* of the electrode G3 and the exit *4b* of the electrode G4. The electron gun depicted in FIGS. 1A-1E is an electron gun for a color cathode-ray tube having three electron gun portions of in-line arrayal.

FIG. 1B shows the detailed structure of the electrode G2. The slits *2d* each of which has a longer axis parallel to the arrayal direction X—X of the in-line electron gun portions, are provided around the electron-beam apertures *2c* in the exist side *2b* of the electrode G2. The depth D of each slit *2d*, namely, the dimension thereof in the direction of the axis of the cathode-ray tube, and the dimensions W1 and W2 of each slit *2d* in directions orthogonal to the tube axis are determined as specifications which meet the requirements of the overall focus characteristics of the cathode-ray tube including the characteristics of the other electrodes. The specifications meeting the requirements of the overall focus characteristics are not always unique.

FIG. 1C shows the slits *3d* which are provided in the entrance *3a* of the electrode G3 and which surround the electron-beam apertures *3c*. Each of these slits *3d* is a slit which has a longer axis orthogonal to the in-line arrayal direction. (In this example, each slit is provided by forming a recess in the side wall of the cup-shaped electrode G3 closer to the electrode G2. The slit is not restricted to the illustrated shape, but it may well have a shape in which the ends of the longer axis are closed.) As in the case of the electrode G2, the dimensions of the depth and widths of each slit *3d* are determined so as to meet the requirements of the overall focus characteristics of the cathode-ray tube including the focus characteristics of the other electrodes, and they are not unique, either. By the way, the sectional view of FIG. 1D is taken along a line A—A in FIG. 1C.

FIG. 1E shows the detailed structure of the electrode G4, in which the slits *4d* each having a longer axis in a direction (Y—Y) orthogonal to the in-line arrayal direction X—X are provided around the electron-beam apertures *4c* in the exit *4b* of this electrode. Also in this case, likewise to the cases of the electrodes G2 and G3, the dimensions of the depth and widths of each slit *4d* are determined so as to meet the requirements of the overall focus characteristics of the cathode-ray tube including the focus characteristics of the other electrodes, and they are not unique, either.

In the example of FIGS. 1A-1E in which at least three of the plurality of electrodes constituting the electron gun are endowed with electrode structures for forming rotationally-asymmetric electric fields, the rotationally-asymmetric electric field which enhances the shapes of electron-beam spots and the resolution of a picture over the whole screen in a small current range is generated chiefly by the structure of the portions of the electron-beam apertures *2c* in the surface *2b*. The rotationally-asymmetric electric field which enhances the shapes of electron-beam spots and the uniformity of the whole screen in a large current range is generated chiefly by the structure of or around the electron-beam apertures *3c* in the surface *3a*. The structure of or around the electron-beam apertures *4c* in the surface *4b* makes up for the deficiencies of the actions of the above two rotationally-asymmetric electric fields.

Figure 2:
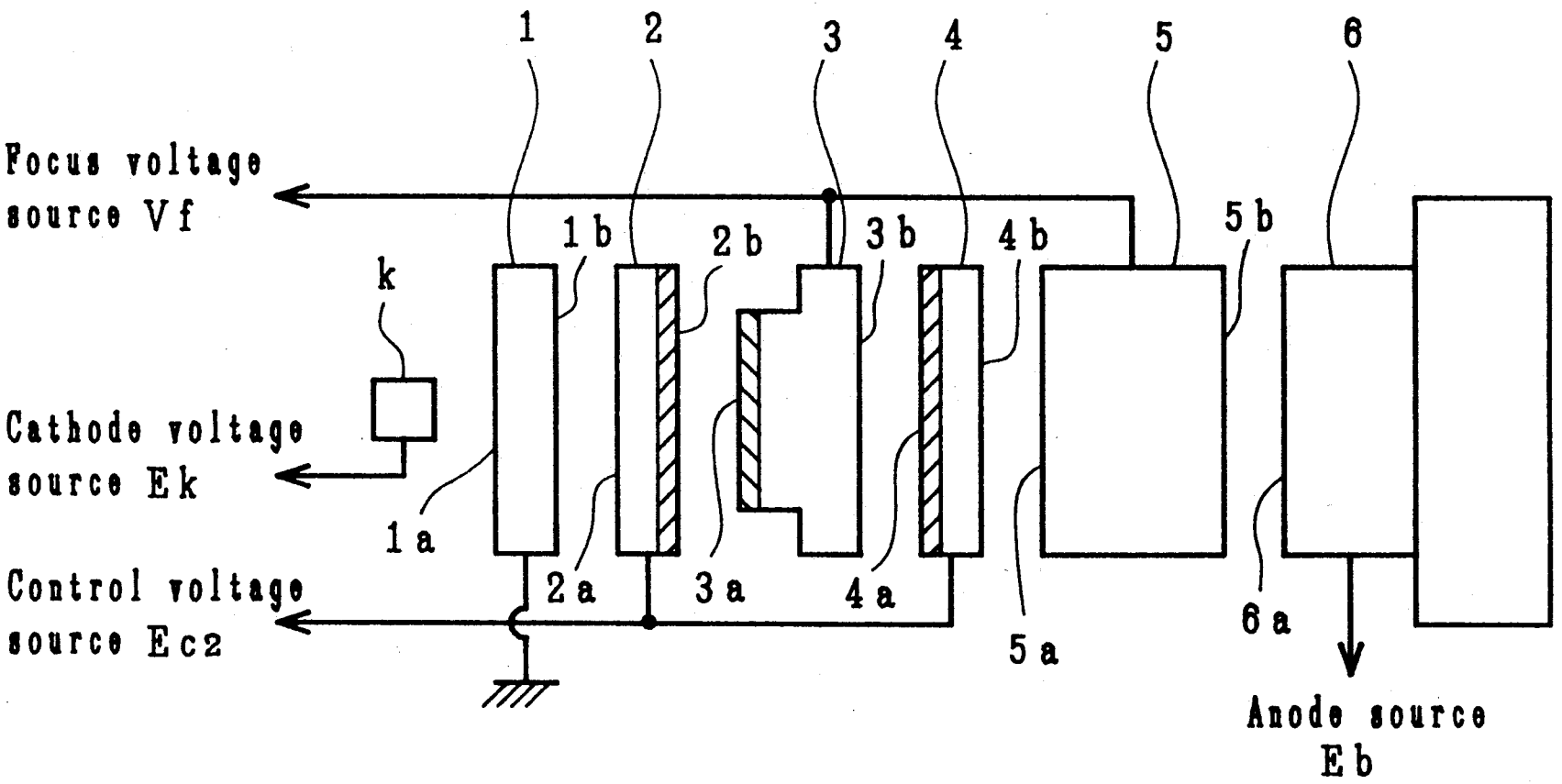
FIG. 2 is a schematic view showing an electrode scheme in the second embodiment of the present invention.

FIG. 2 is a schematic view showing an electrode scheme in the second embodiment of the present invention. In this embodiment, electrode surfaces *2b*, *3a* and *4a* are endowed with structures for forming rotationally-asymmetric electric fields. The effects of the portions *2b* and *3a* are the same as in the embodiment of FIGS. 1A-1E. The portion *4a* contributes to the controls of the spot shapes of electron beams and the controls of the vertical and horizontal diameters of the electron beam at the central part of a screen, in a larger current range than the current range of the structure of the portion *4b* in FIG. 1A.

Figure 3:
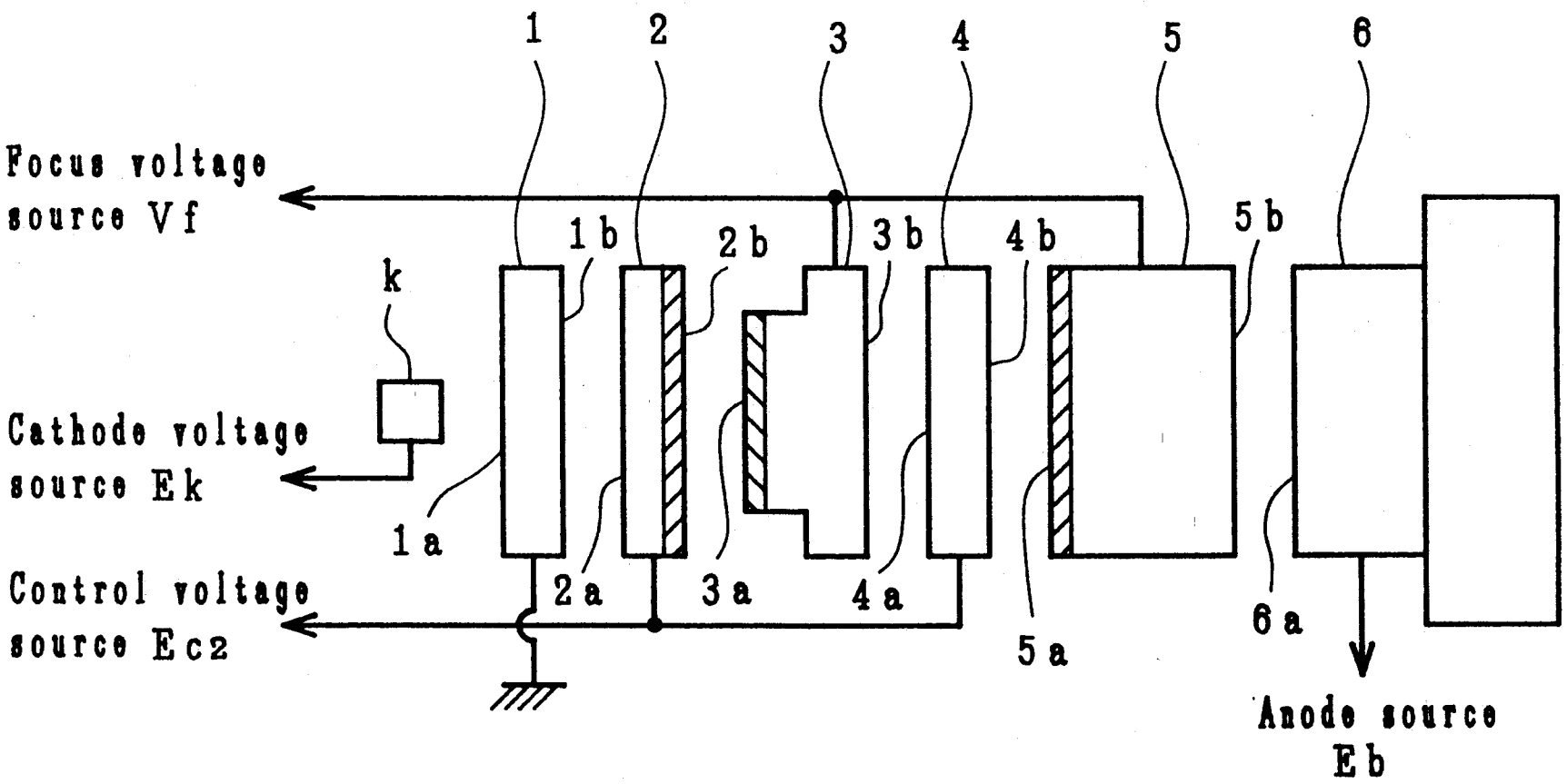
FIG. 3 is a schematic view showing an electrode scheme in the third embodiment of the present invention.

FIG. 3 is a schematic view showing an electrode scheme in the third embodiment of the present invention. In this embodiment, electrode surfaces *2b*, *3a* and *5a* are endowed with structures for forming rotationally-asymmetric electric fields. The effects of the portions *2b* and *3a* are the same as in the embodiment of FIGS. 1A-1E. The portion *5a* realizes the controls of the spot shapes of electron beams in a still larger current range than the current range in the embodiment of FIG. 2, and also realizes precise controls.

Figure 4:
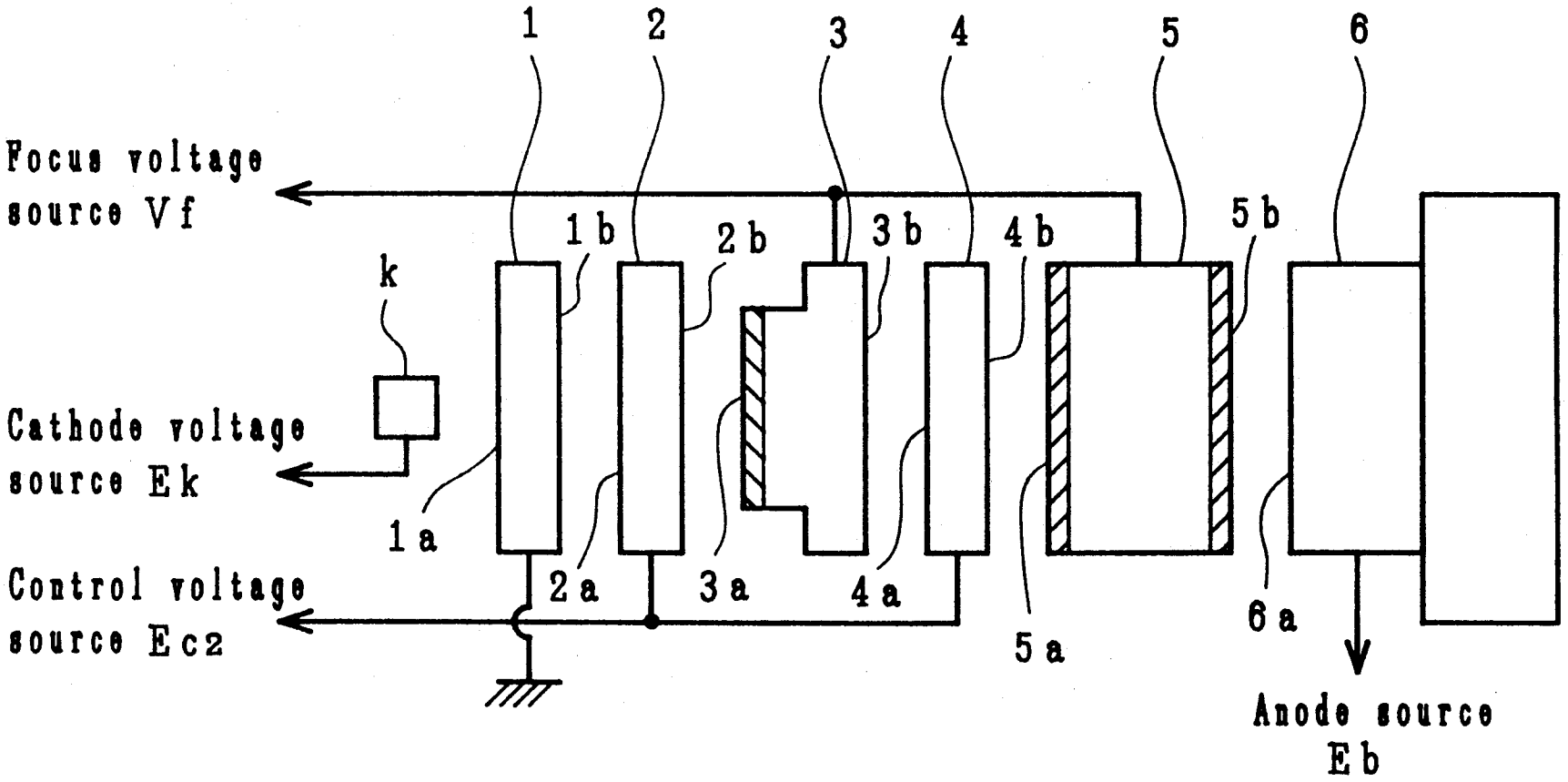
FIG. 4 is a schematic view showing an electrode scheme in the fourth embodiment of the present invention.

FIG. 4 is a schematic view showing an electrode scheme in the fourth embodiment of the present invention. This embodiment has electrode surfaces *3a*, *5a* and *5b* endowed with structures for forming rotationally-asymmetric electric fields, and it is applied to an electron gun in which focus characteristics in a small current range are good even with only a rotationally-symmetric electric field. In the scheme, the effect of the rotationally-asymmetric electric field forming structure provided in the portion 3a is the same as in the embodiment of FIGS. 1A-1E, while the effect of the rotationally-asymmetric electric field forming structure provided in the portion 5a is the same as in the embodiment of FIG. 3. The structure in the portion 5b is adopted in a case where, when the diameter of the spot of an electron beam at the central part of a screen is to be reduced by increasing the aperture of a main lens, the lateral and vertical structures of an electrode G5 cannot help being changed on account of the dimensional limitation of this electrode. On this occasion, the structures of the portions 3a and 5a need to be adapted to the characteristic of the main lens.

Figure 5:
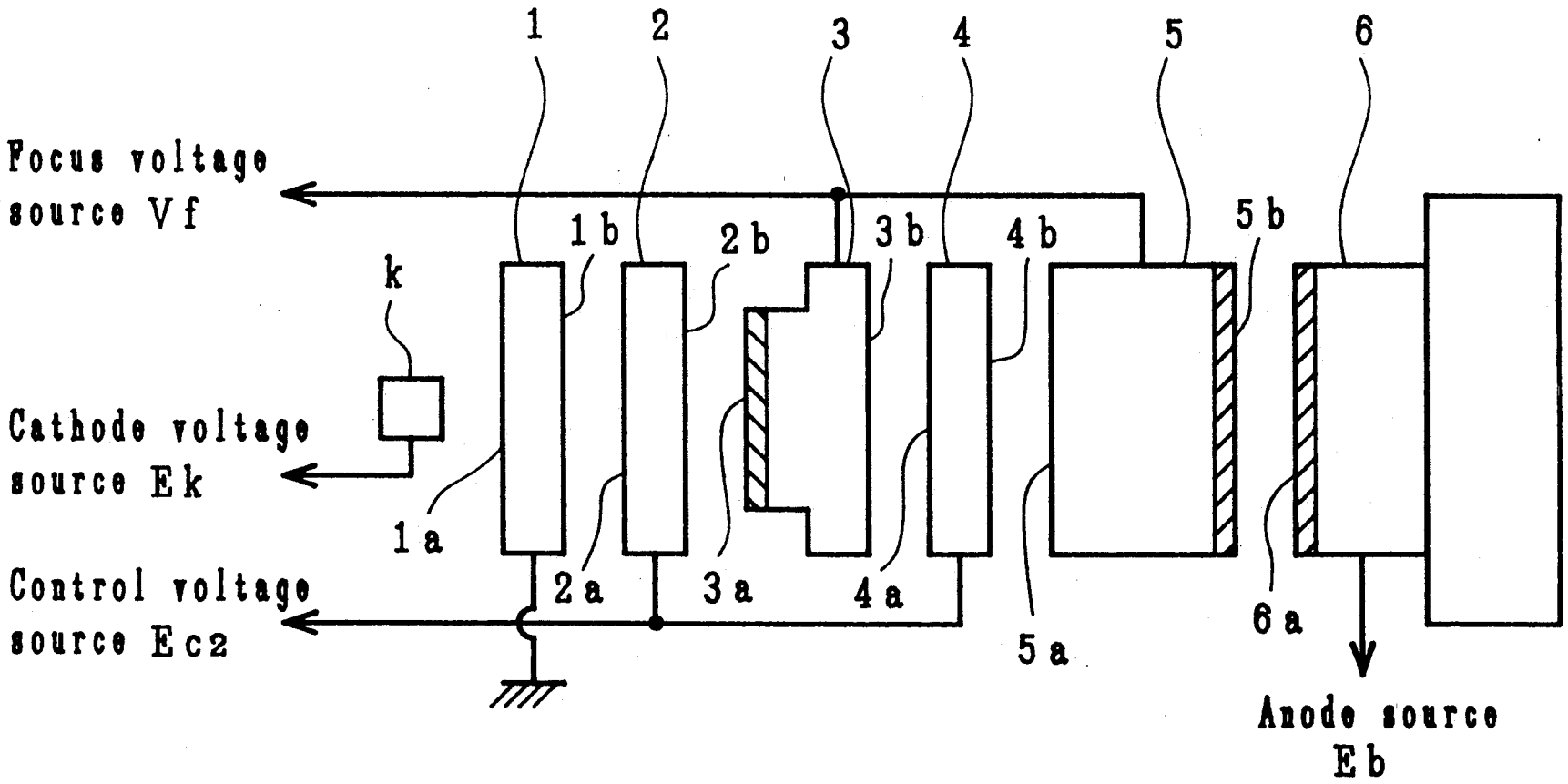
FIG. 5 is a schematic view showing an electrode scheme in the fifth embodiment of the present invention.

FIG. 5 is a schematic view showing an electrode scheme in the fifth embodiment of the present invention. This embodiment has electrode surfaces 3a, 5b and 6a endowed with structures for forming rotationally-asymmetric electric fields, and it is adopted in a case where, in an electron gun in which the effect of the surface 3a of the third electrode G3 and the characteristics in the small current range are the same as those of the embodiment in FIG. 4, the aperture of the main lens is further enlarged.

Figure 6:
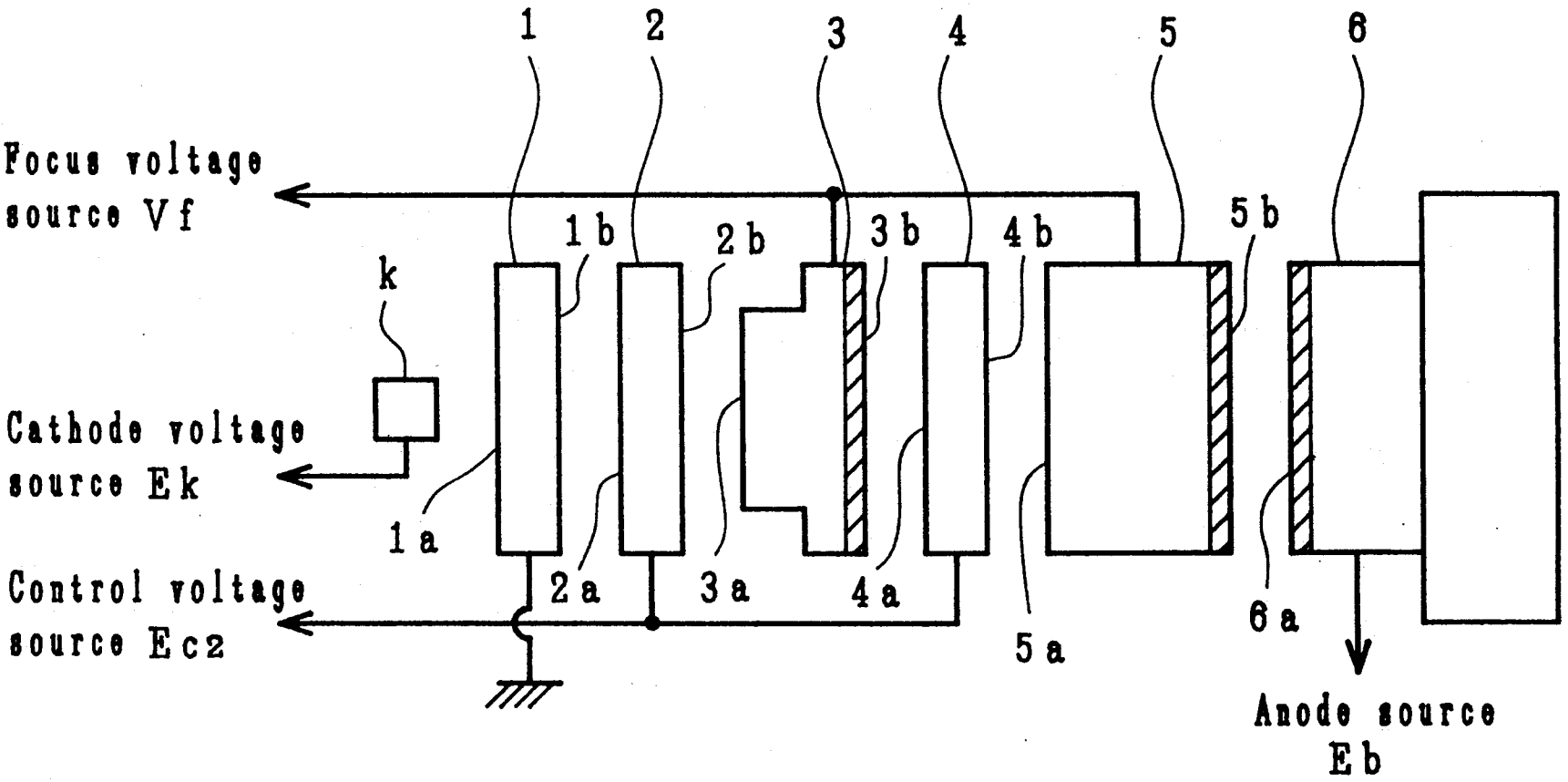
FIG. 6 is a schematic view showing an electrode scheme in the sixth embodiment of the present invention.

FIG. 6 is a schematic view showing an electrode scheme in the sixth embodiment of the present invention. This embodiment has electrode surfaces 3b, 5b and 6a endowed with structures for forming rotationally-asymmetric electric fields, and it is adopted in order to control characteristics in a still larger current range than in the embodiment of FIG. 5.

Figure 7:
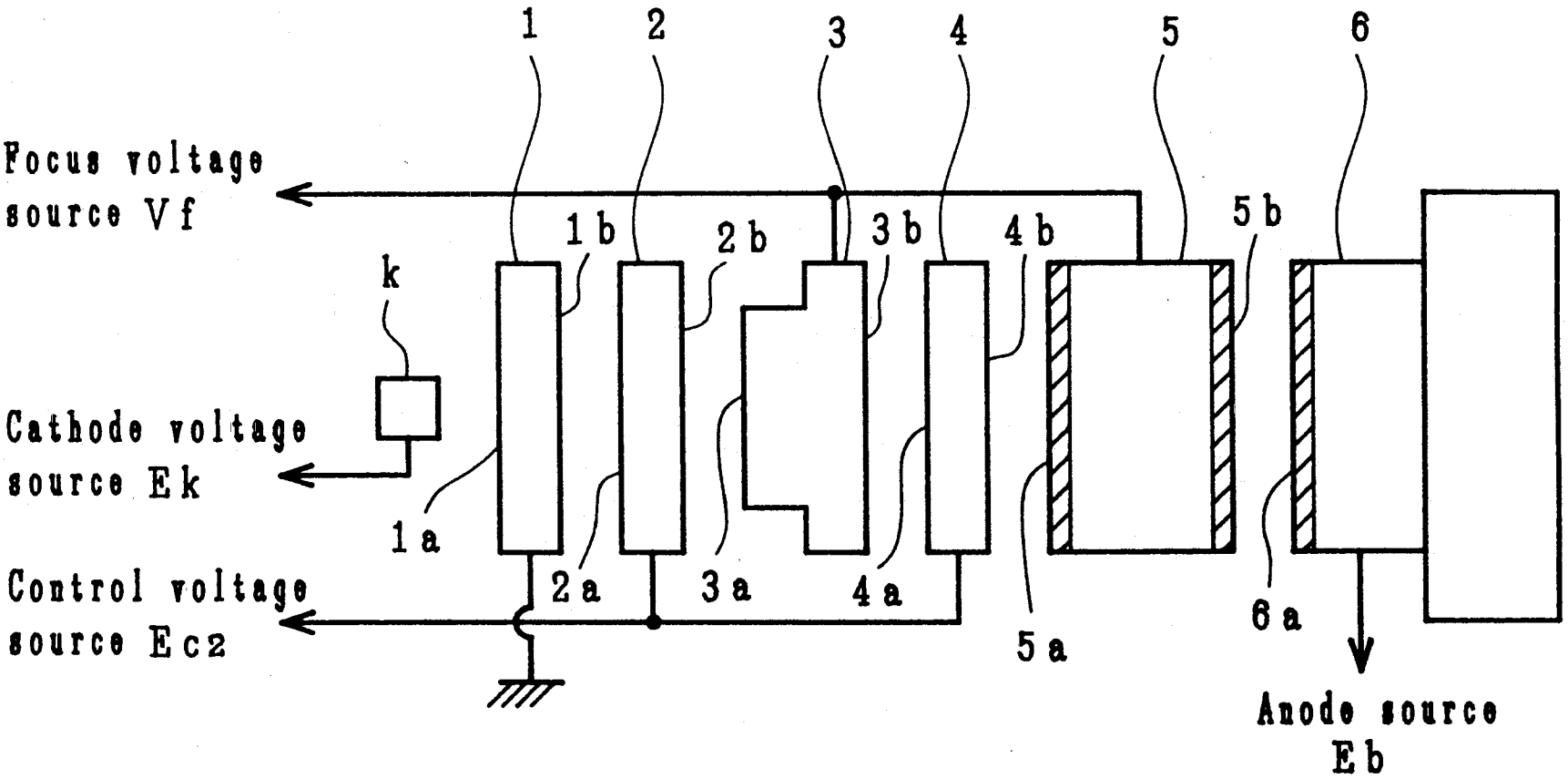
FIG. 7 is a schematic view showing an electrode scheme in the seventh embodiment of the present invention.

FIG. 7 is a schematic view showing an electrode scheme in the seventh embodiment of the present invention. This embodiment has electrode surfaces 5a, 5b and 6a endowed with structures for forming rotationally-asymmetric electric fields, and it is adopted in order to control characteristics in a still larger current range than in the embodiment of FIG. 6.

Figure 8:
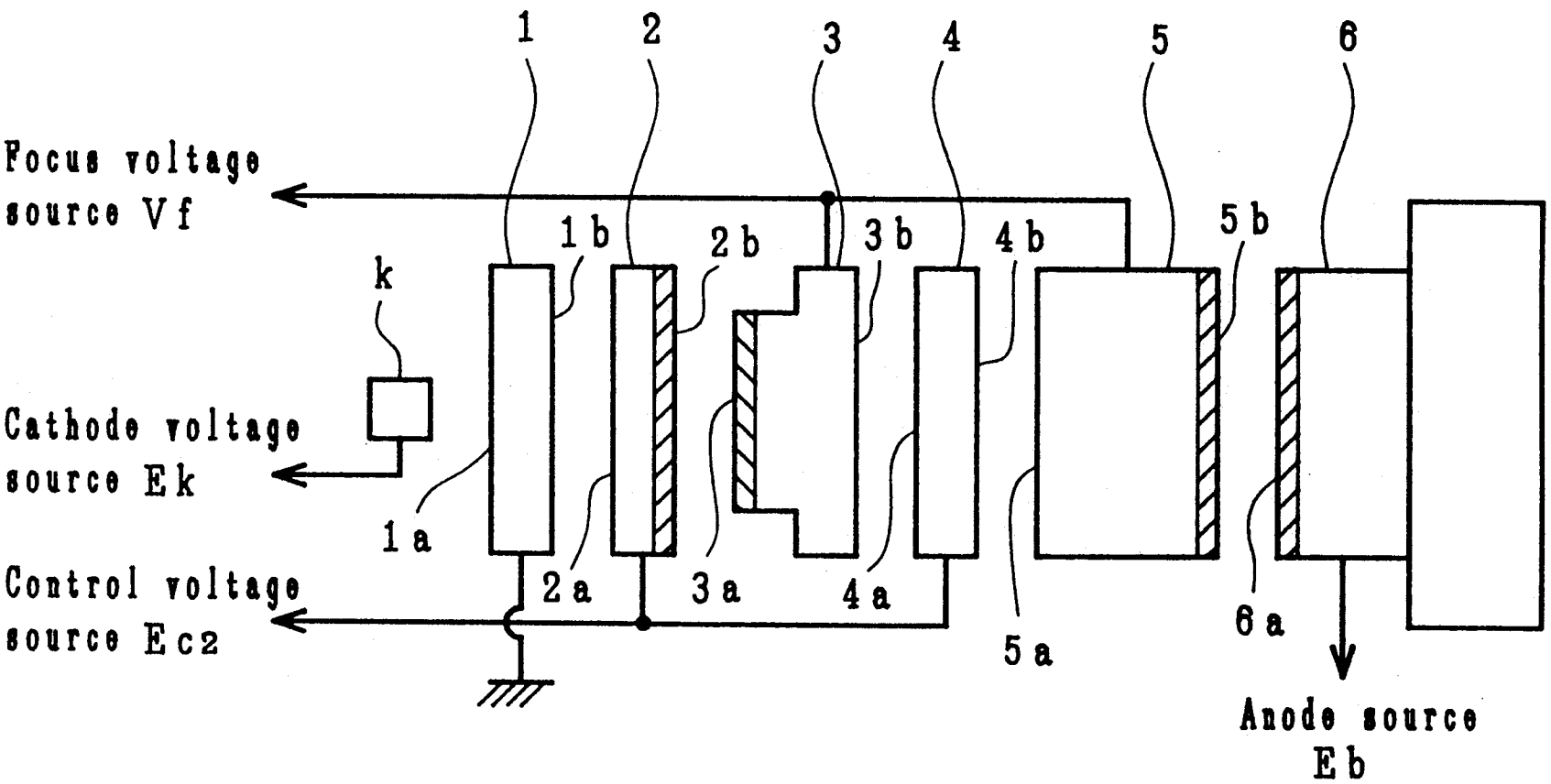
FIG. 8 is a schematic view showing an electrode scheme in the eighth embodiment of the present invention.

FIG. 8 is a schematic view showing an electrode scheme in the eighth embodiment of the present invention. This embodiment has electrode surfaces 2b, 3a, 5b and 6a endowed with structures for forming rotationally-asymmetric electric fields, and it is adopted in a case where focus characteristics are controlled more precisely than in any of the embodiments shown in FIG. 1A through FIG. 7. The scheme forms the rotationally-asymmetric electric fields in, at least, four places (in the four places in the figure).

Figure 9:
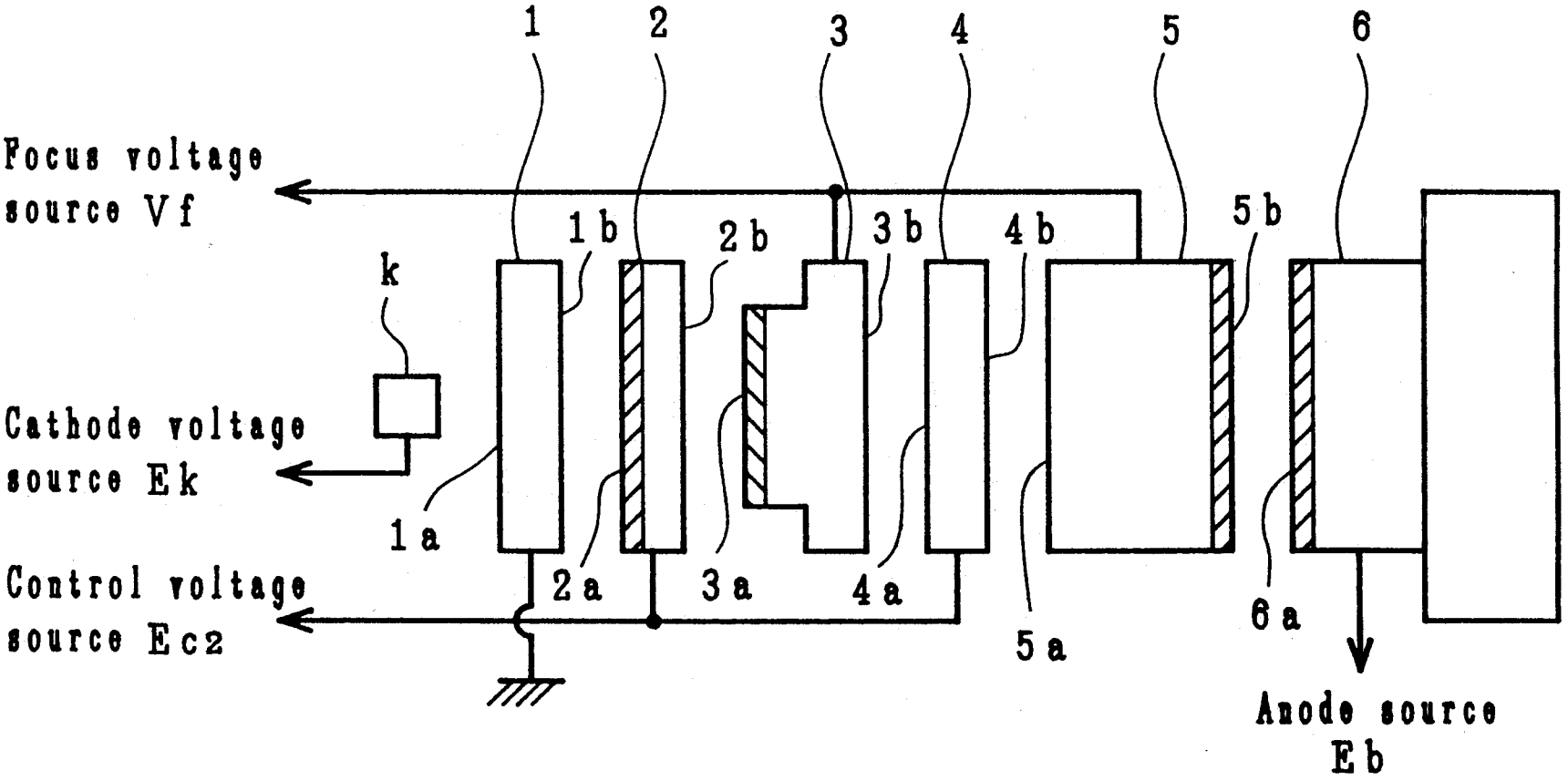
FIG. 9 is a schematic view showing an electrode scheme in the ninth embodiment of the present invention.

FIG. 9 is a schematic view showing an electrode scheme in the ninth embodiment of the present invention. This embodiment has electrode surfaces 2a, 3a, 5b and 6a endowed with structures for forming rotationally-asymmetric electric fields. With this scheme, the diameters of electron-beam apertures 5c and 6c on the respective sides of the electrode surfaces 5b and 6a are enlarged to the utmost, thereby to reduce the spot diameter of the electron beam at the central part of the screen, and the same effect as in FIGS. 1A-1E, of rendering the shapes and sizes of the electron beams uniform over the whole area of the screen is attained by the electrode surfaces 2a and 3a.

Figure 10:
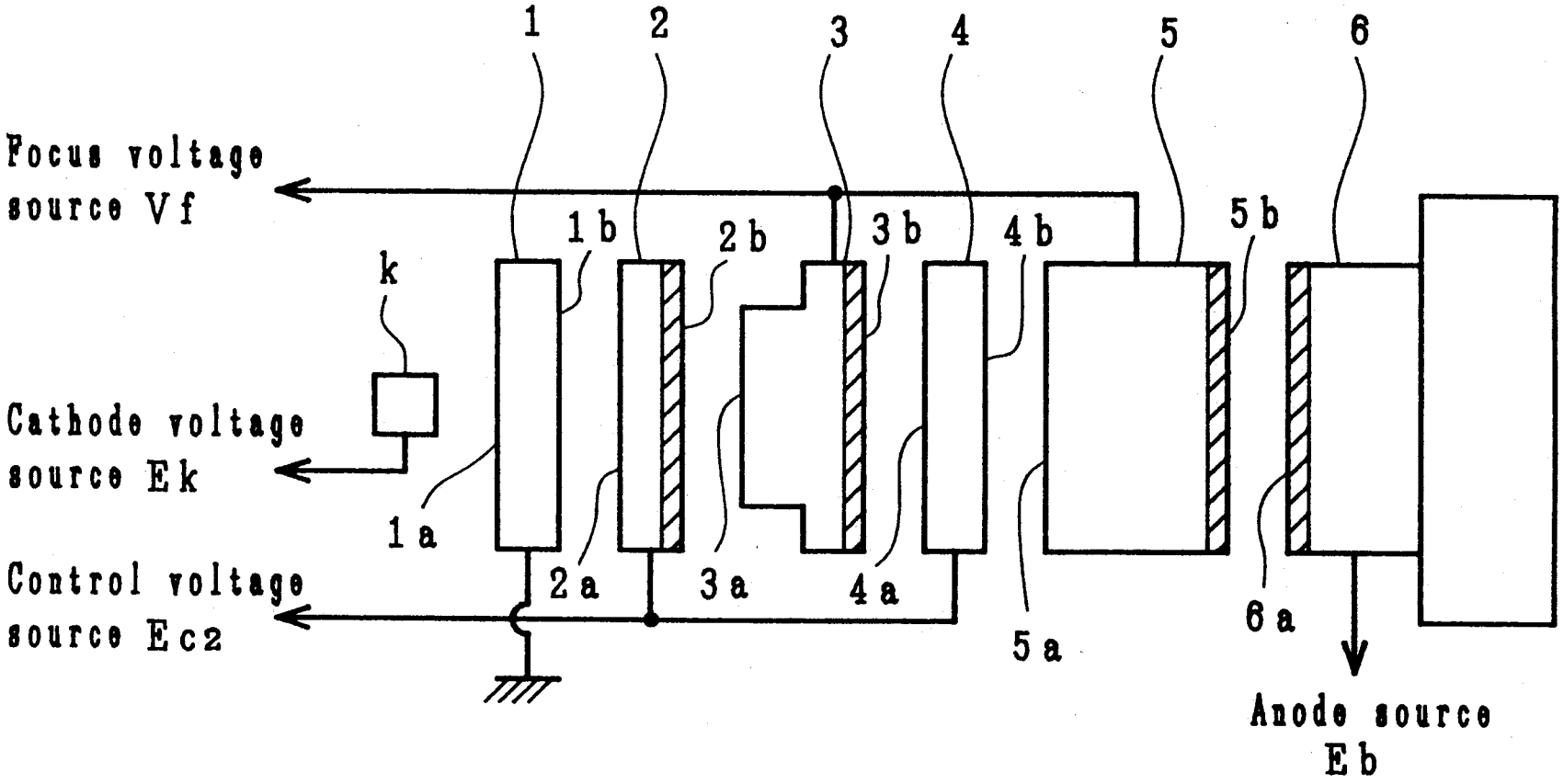
FIG. 10 is a schematic view showing an electrode scheme in the tenth embodiment of the present invention.

FIG. 10 is a schematic view showing an electrode scheme in the tenth embodiment of the present invention. This embodiment has electrode surfaces 2b, 3b, 5b and 6a endowed with structures for forming rotationally-asymmetric electric fields. Thus, in an electron gun in which the position of a crossover point in a small current range is particularly close to a cathode side, the spot shapes of the electron beams and the uniformity in the whole screen in the small current range are controlled, and the same effects as those of the embodiment in FIG. 9 are attained.

Figure 11:
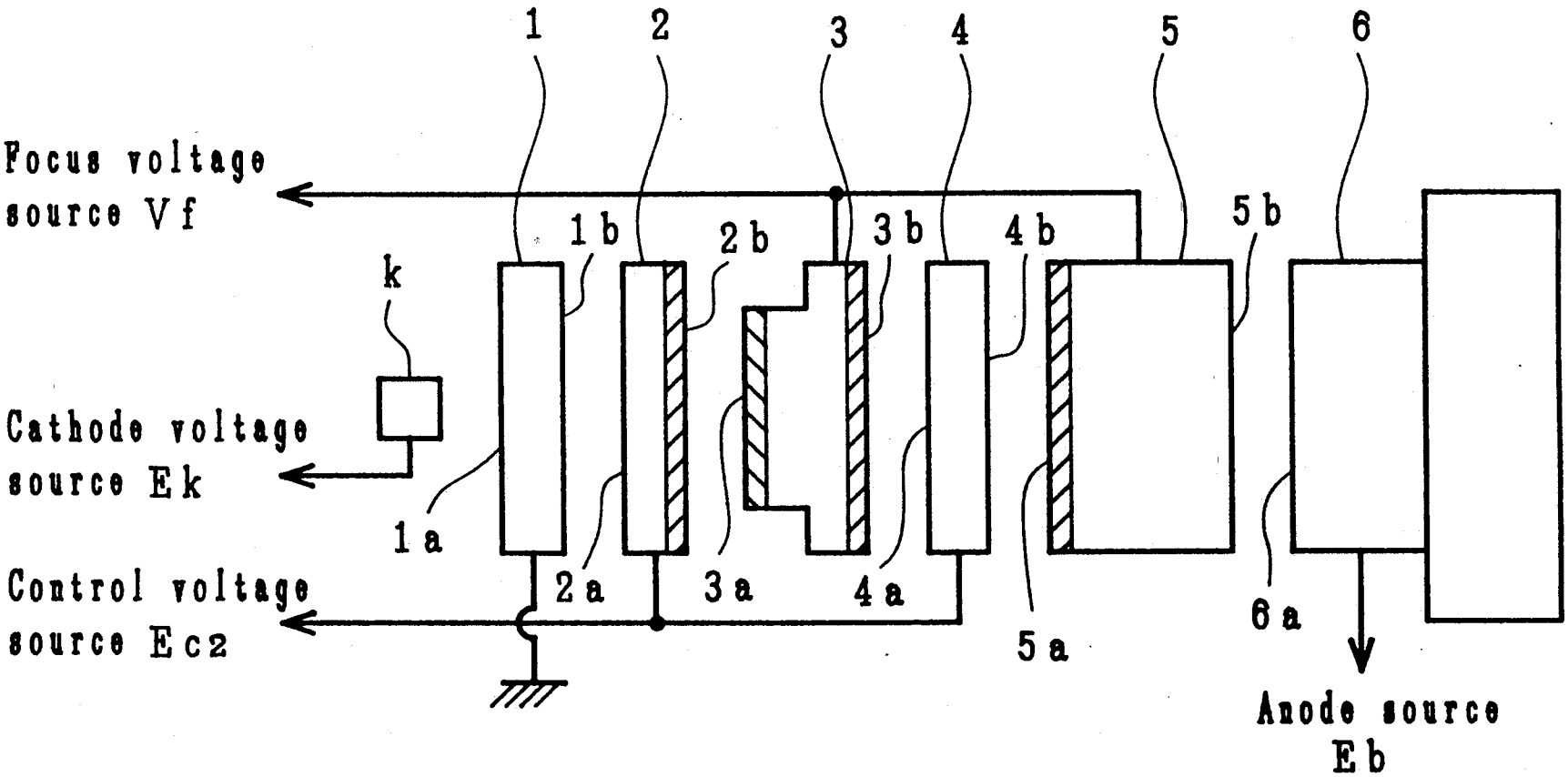
FIG. 11 is a schematic view showing an electrode scheme in the eleventh embodiment of the present invention.

FIG. 11 is a schematic view showing an electrode scheme in the eleventh embodiment of the present invention. This embodiment has electrode surfaces 2b, 3a, 3b and 5a endowed with structures for forming rotationally-asymmetric electric fields. Thus, it enhances the uniformity of the electron-beam spots over the whole screen in a smaller current range than in the electron gun of FIG. 10, and it suppresses the lowering of the resolution while suppressing the appearance of moiré.

Figure 12:
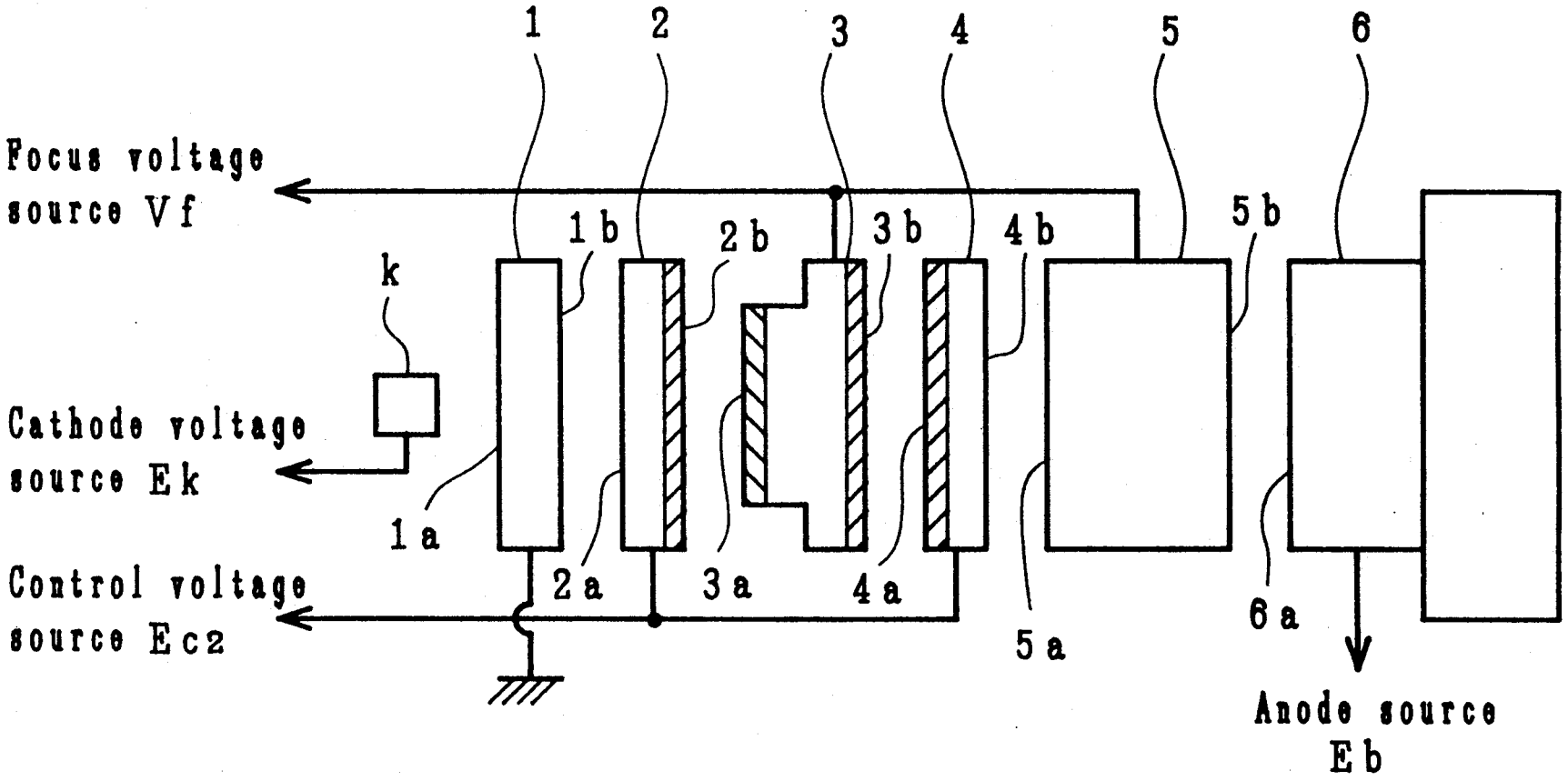
FIG. 12 is a schematic view showing an electrode scheme in the twelfth embodiment of the present invention.

FIG. 12 is a schematic view showing an electrode scheme in the twelfth embodiment of the present invention. This embodiment has electrode surfaces 2b, 3a, 3b and 4a endowed with structures for forming rotationally-asymmetric electric fields. It is effective in a case where, although the aperture of the main lens is sufficient, the uniformities of the electron-beam spots over the whole screen are insufficient in a small current range and a large current range, especially, in a case where the uniformity in the large current range is more insufficient.

Figure 13:
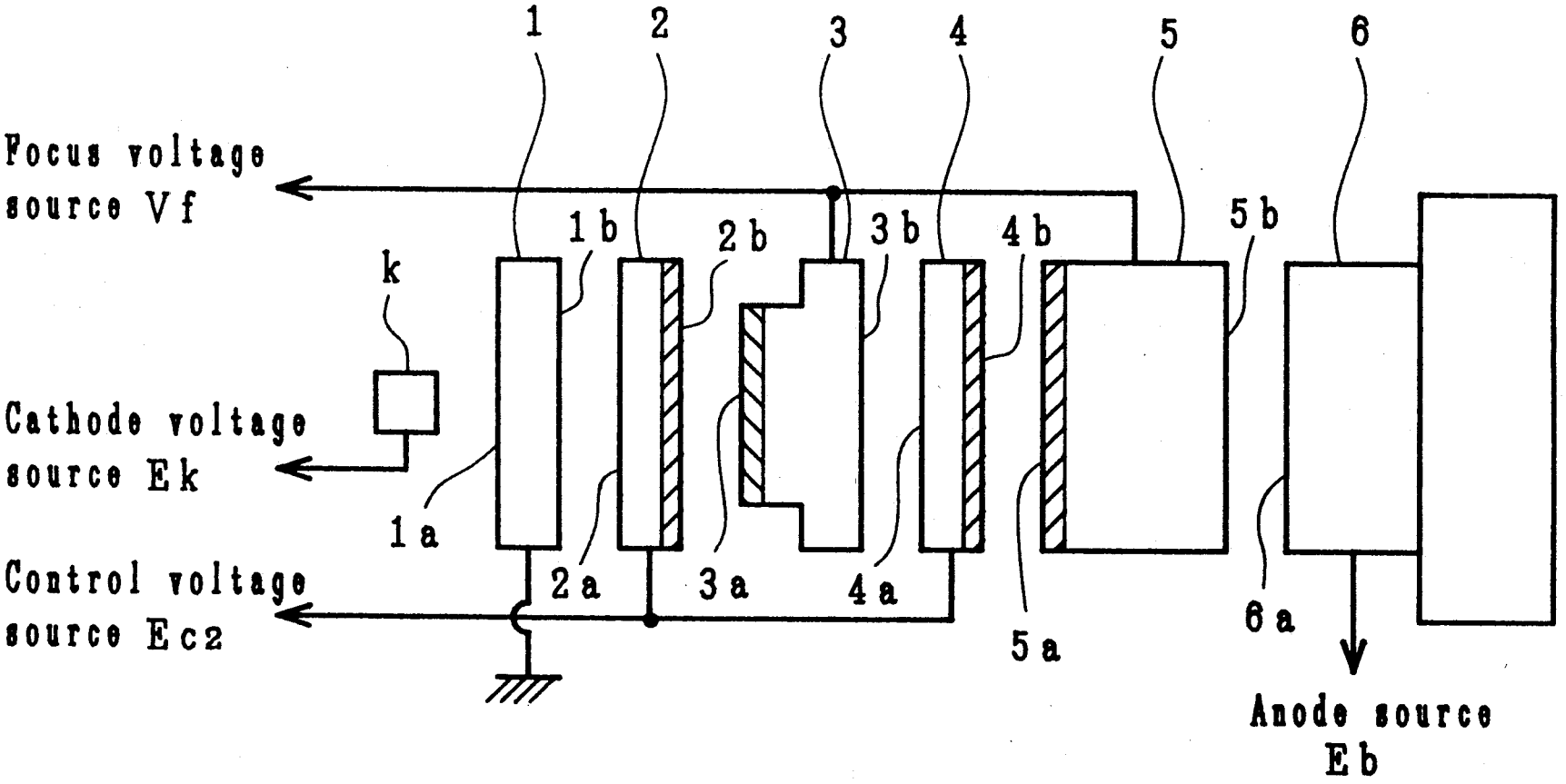
FIG. 13 is a schematic view showing an electrode scheme in the thirteenth embodiment of the present invention.

FIG. 13 is a schematic view showing an electrode scheme in the thirteenth embodiment of the present invention. This embodiment has electrode surfaces 2b, 3a, 4b and 5a endowed with structures for forming rotationally-asymmetric electric fields. It is applied to a case where, although the aperture of the main lens is sufficient, the shapes and uniformity of the electron-beam spots over the whole screen in a larger current range than in the embodiment of FIG. 12 need to be controlled, and besides, the difference between the optimum focus voltages in a large current range and a small current range needs to be controlled.

Figure 14:
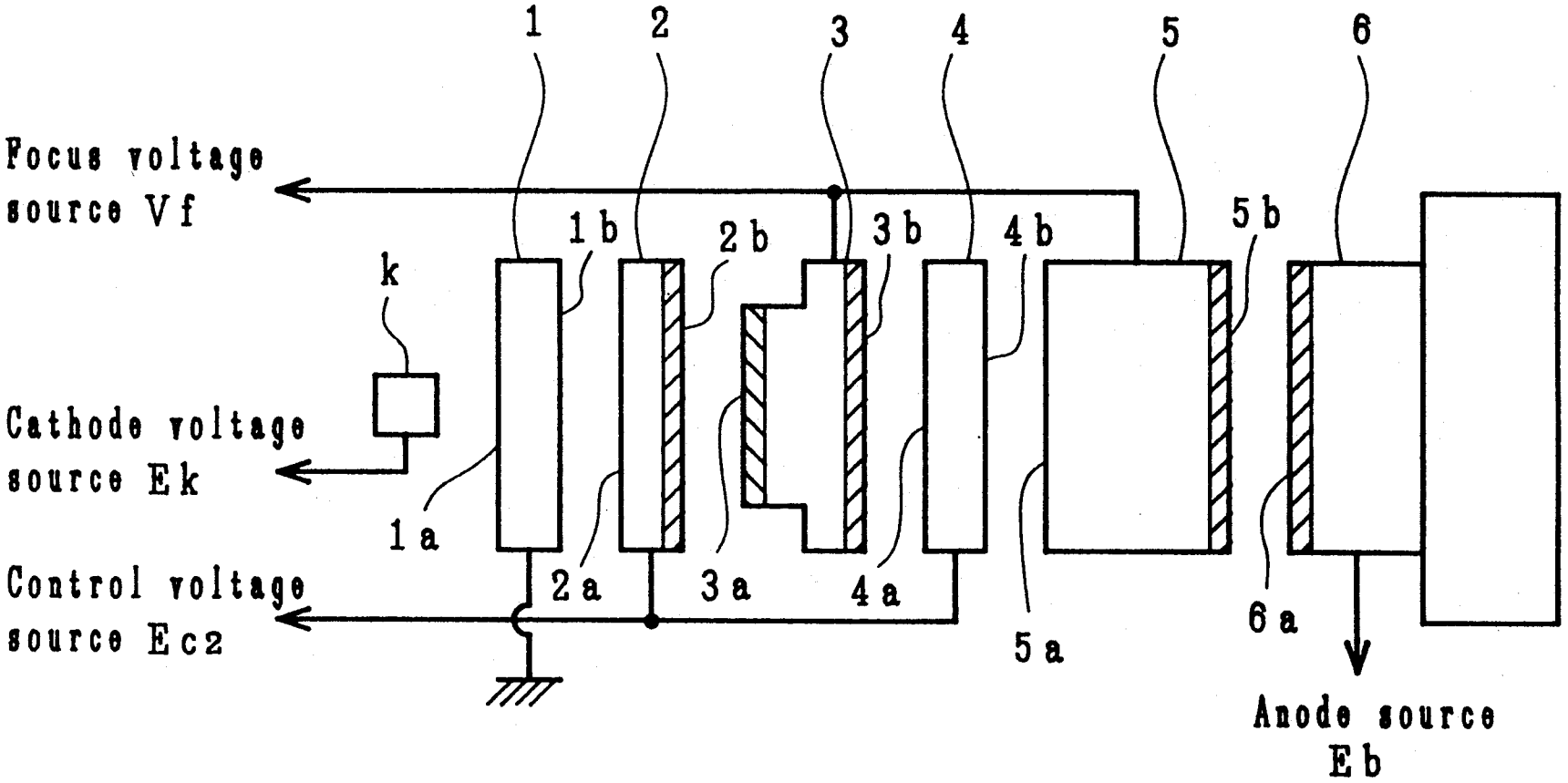
FIG. 14 is a schematic view showing an electrode scheme in the fourteenth embodiment of the present invention.

FIG. 14 is a schematic view showing an electrode scheme in the fourteenth embodiment of the present invention. This embodiment has electrode surfaces 2b, 3a, 3b, 5b and 6a endowed with structures for forming rotationally-asymmetric electric fields. It is applied to a case where, in the embodiment of FIG. 13, the difference between the optimum focus voltages in the large current range and the small current range need not be controlled.

Figure 15:
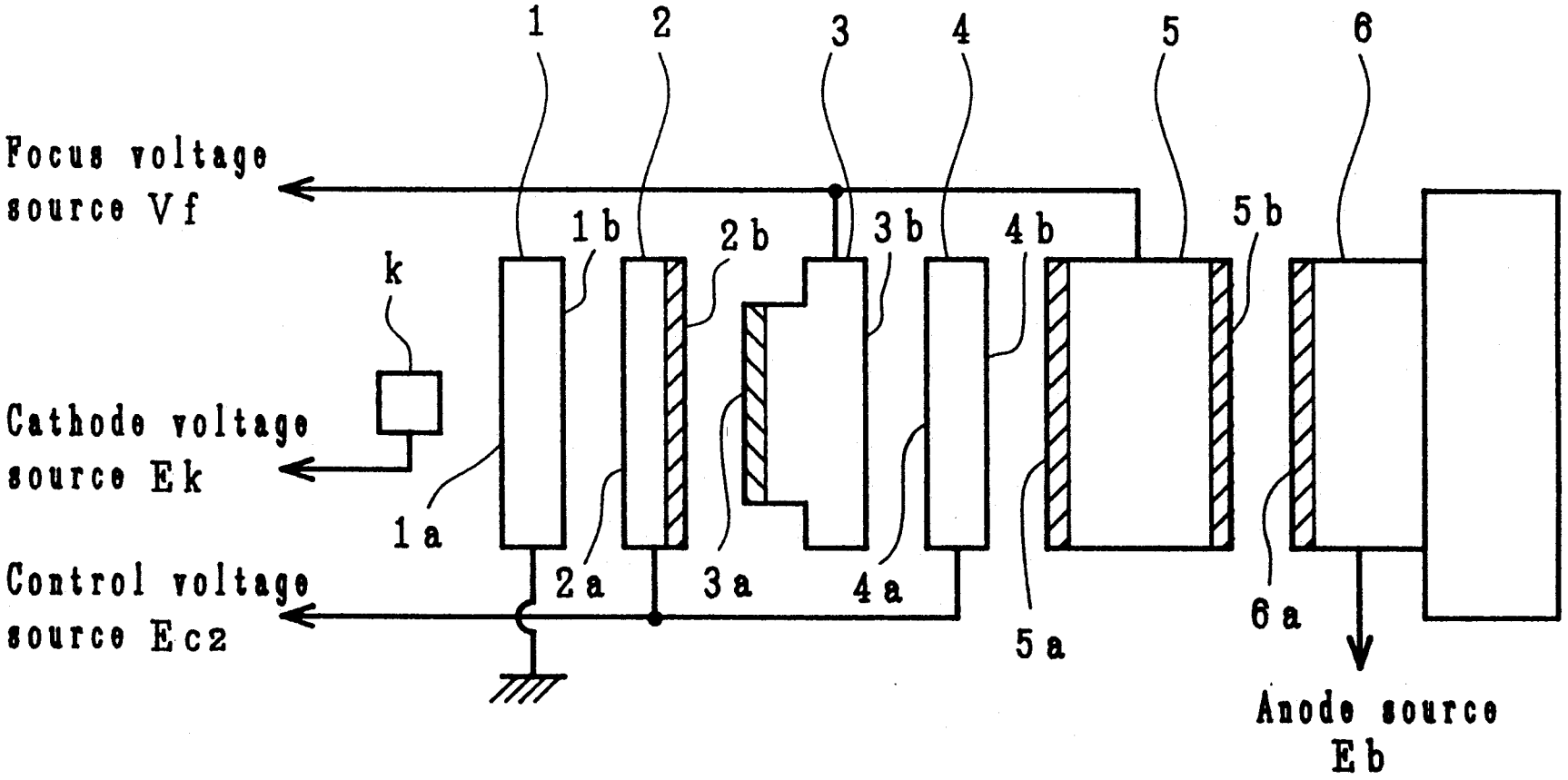
FIG. 15 is a schematic view showing an electrode scheme in the fifteenth embodiment of the present invention.

FIG. 15 is a schematic view showing an electrode scheme in the fifteenth embodiment of the present invention. This embodiment has electrode surfaces 2b, 3a, 5a, 5b and 6a endowed with structures for forming rotationally-asymmetric electric fields. It is applied to a case where, in any of the embodiments of FIGS. 8 through 14, the optimum focus characteristics are controlled more finely.

Figure 16:
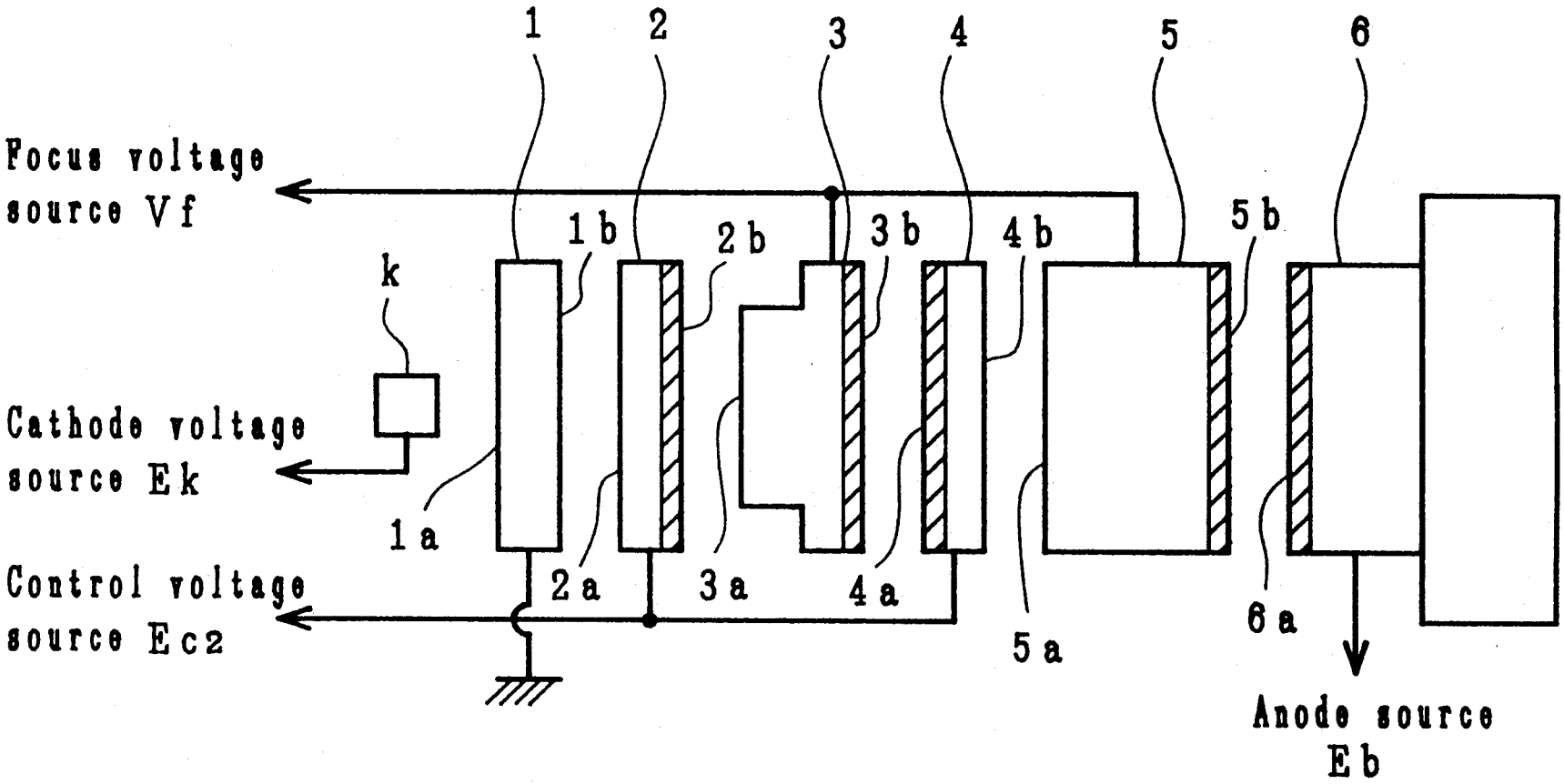
FIG. 16 is a schematic view showing an electrode scheme in the sixteenth embodiment of the present invention.

FIG. 16 is a schematic view showing an electrode scheme in the sixteenth embodiment of the present invention. This embodiment has electrode surfaces 2b, 3b, 4a, 5b and 6a endowed with structures for forming rotationally-asymmetric electric fields. It is applied to a case where, when the main lens itself is rendered rotationally asymmetric in order to increase the aperature of the main lens; the spot shapes of the electron beams are controlled in a small current range and a large current range, and also the uniformity over the whole screen is controlled, and where importance is attached particularly to the control in the large current range.

Figure 17:
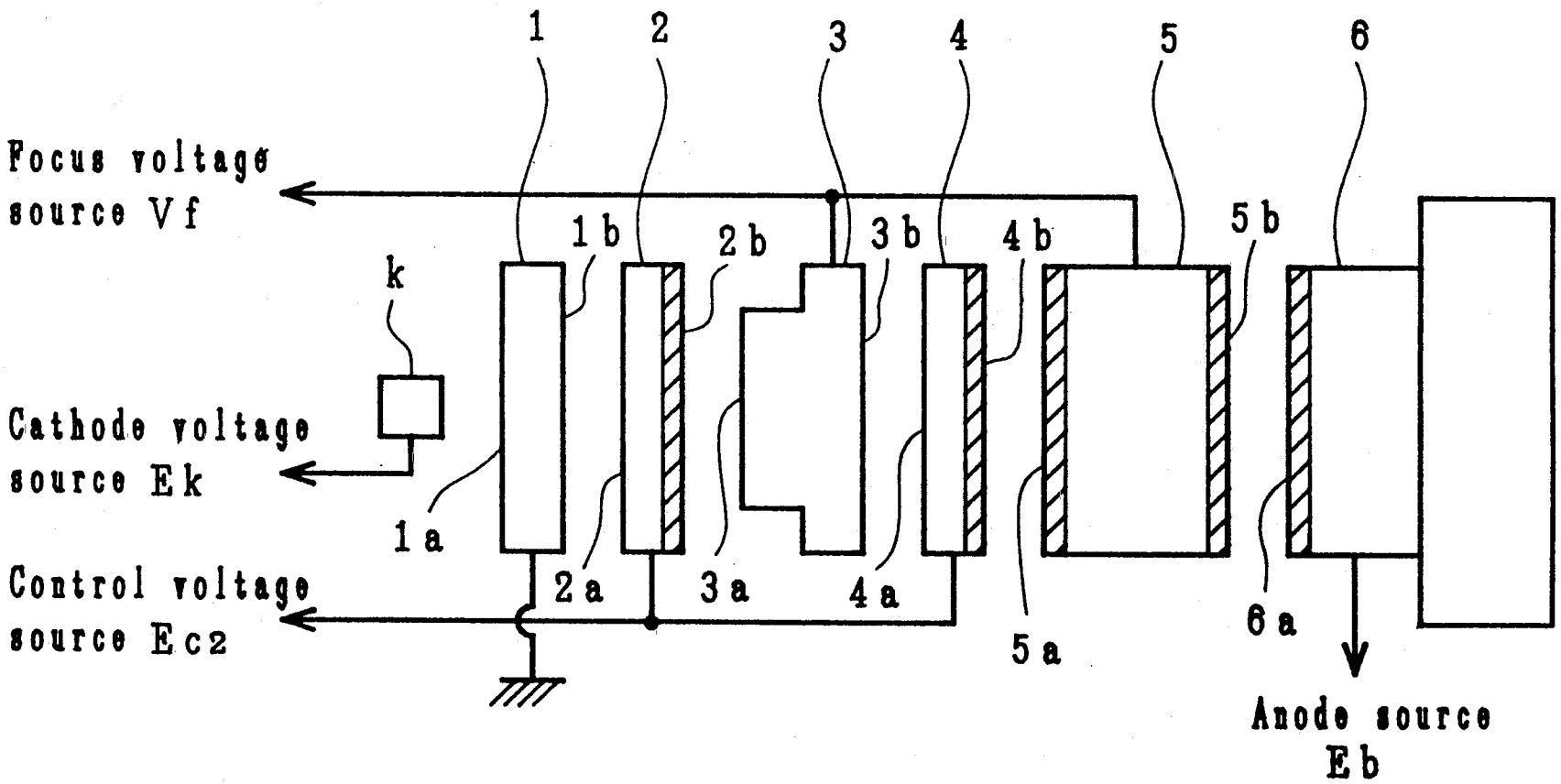
FIG. 17 is a schematic view showing an electrode scheme in the seventeenth embodiment of the present invention.

FIG. 17 is a schematic view showing an electrode scheme in the seventeenth embodiment of the present invention. This embodiment has electrode surfaces 2b, 4b, 5a, 5b and 6a endowed with structures for forming rotationally-asymmetric electric fields. It is applied to a case where, in the embodiment of FIG. 16, importance is attached to the control of focus characteristics in a still larger current range.

Figure 18:
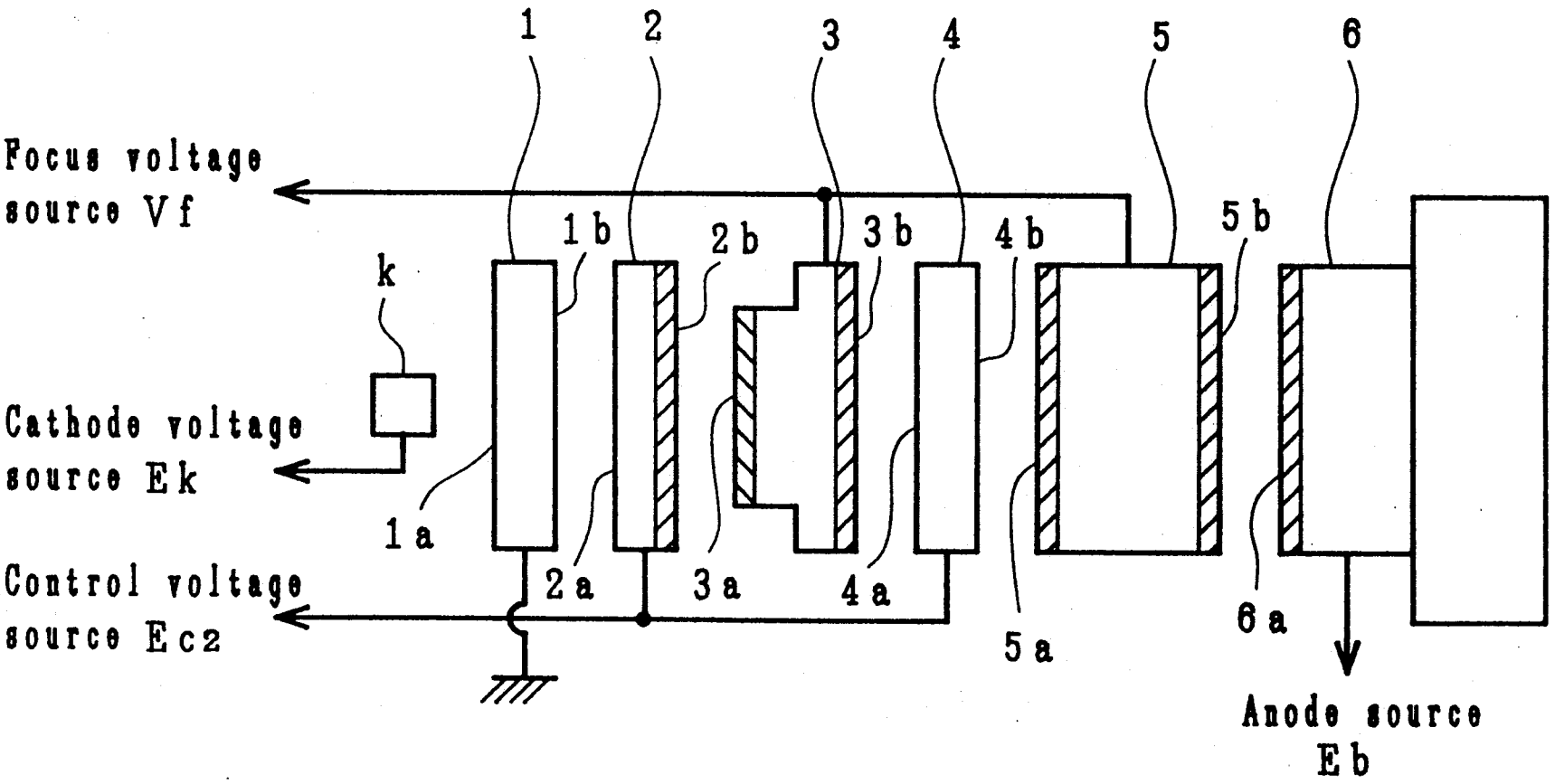
FIG. 18 is a schematic view showing an electrode scheme in the eighteenth embodiment of the present invention.

FIG. 18 is a schematic view showing an electrode scheme in the eighteenth embodiment of the present invention. This embodiment has electrode surfaces 2b, 3a, 3b, 5a, 5b and 6a endowed with structures for forming rotationally-asymmetric electric fields. It is applied to a case where, in the embodiment of FIG. 17, the difference between the optimum focus voltages in a small current range and a large current range is also controlled.

Figure 19:
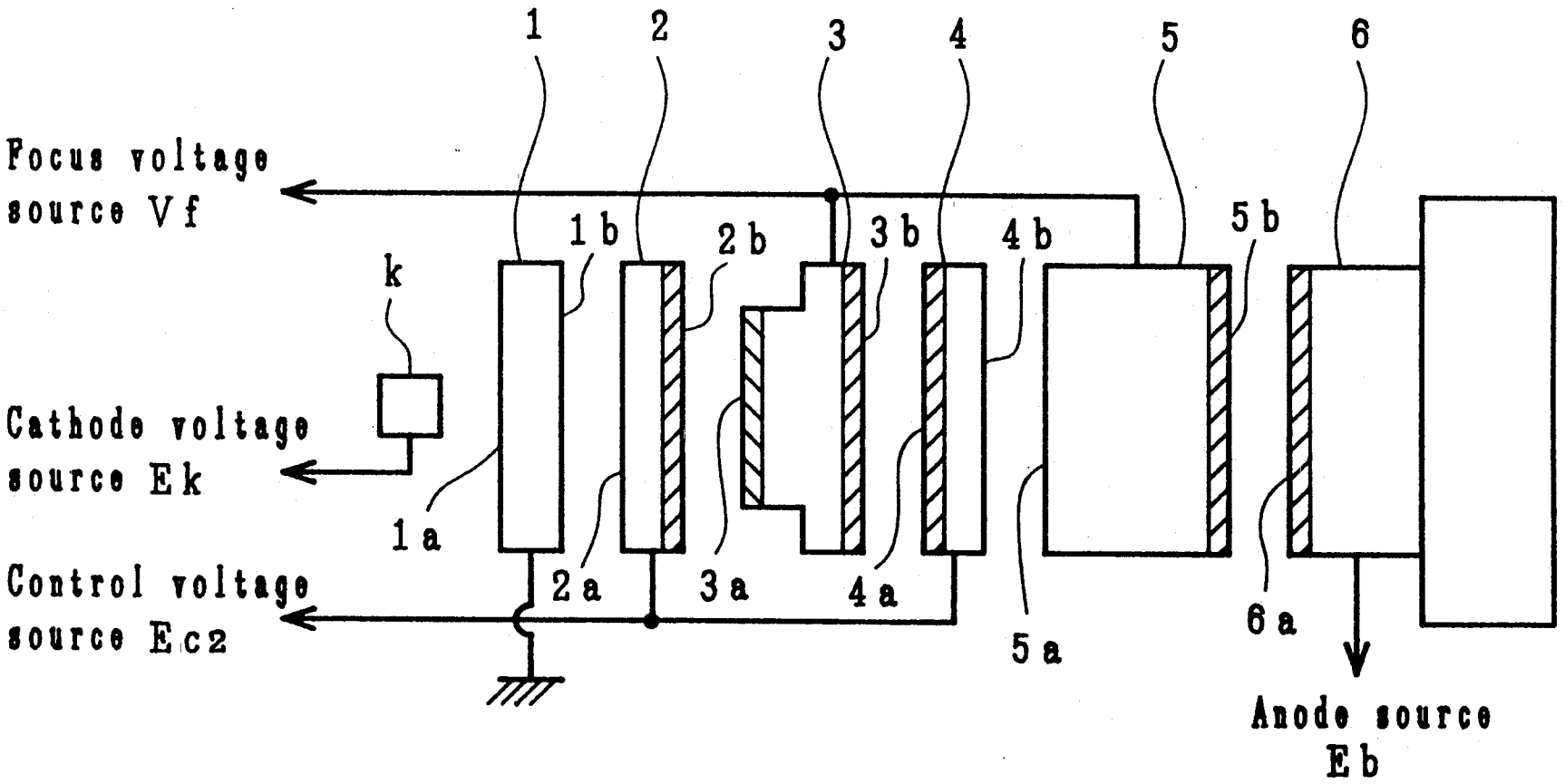
FIG. 19 is a schematic view showing an electrode scheme in the nineteenth embodiment of the present invention.

FIG. 19 is a schematic view showing an electrode scheme in the nineteenth embodiment of the present invention. This embodiment has electrode surfaces 2b, 3a, 3b, 4a, 5b and 6a endowed with structures for forming rotationally-asymmetric electric fields. It is applied to a case where, when the main lens is rendered rotationally asymmetric in order to increase the aperature of the main lens; the control of the uniformity over the whole screen and the suppression of moiré are executed in a small current range, and the control of the spot shapes of the electron beams and the control of the uniformity over the whole screen are executed in a large current range.

Figure 20:
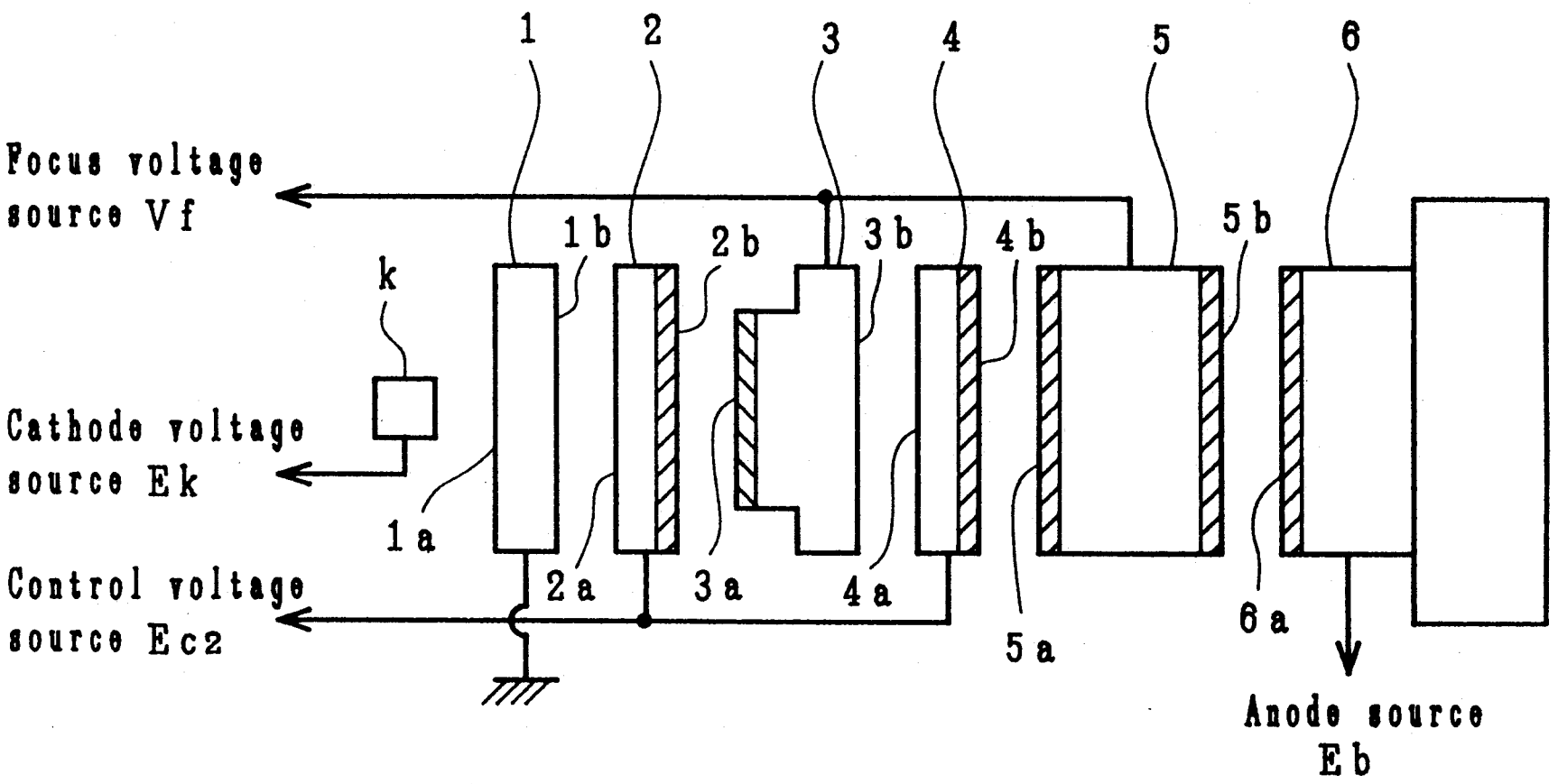
FIG. 20 is a schematic view showing an electrode scheme in the twentieth embodiment of the present invention.

FIG. 20 is a schematic view showing an electrode scheme in the twentieth embodiment of the present invention. This embodiment has electrode surfaces 2b, 3a, 4b, 5a, 5b and 6a endowed with structures for forming rotationally-asymmetric electric fields. It is applied to a case where the focus characteristics of the electron beams are more precisely controlled in any of the electron guns of FIGS. 15 through 19.

Figure 53A:
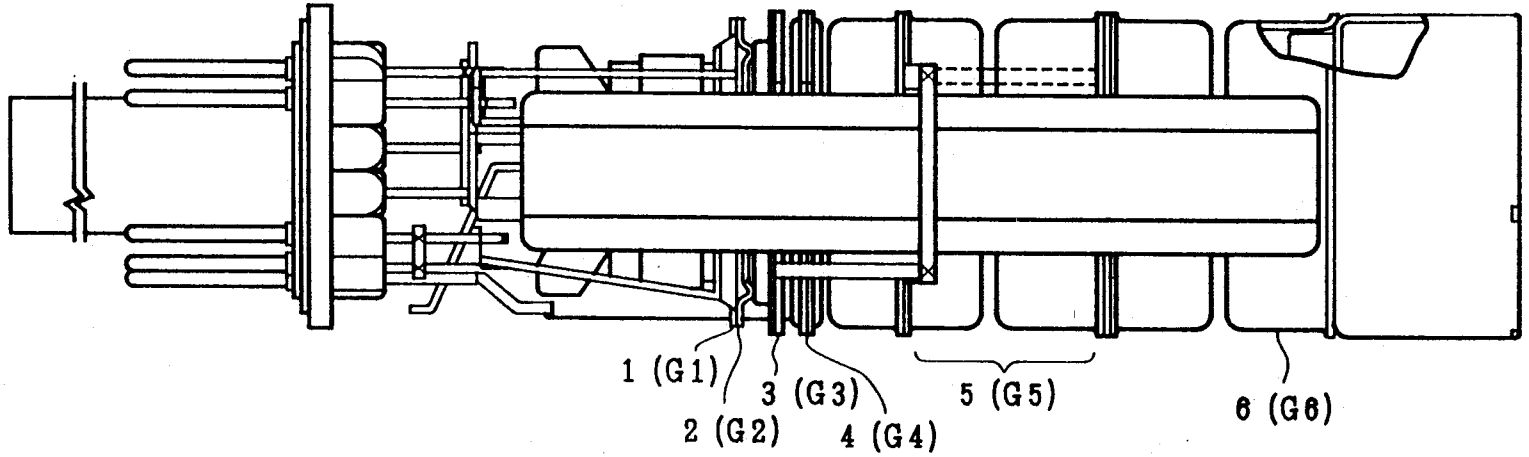
FIGS. 53*a* and 53*b* are views for explaining the electrode construction of an electron gun.
Figure 53B:
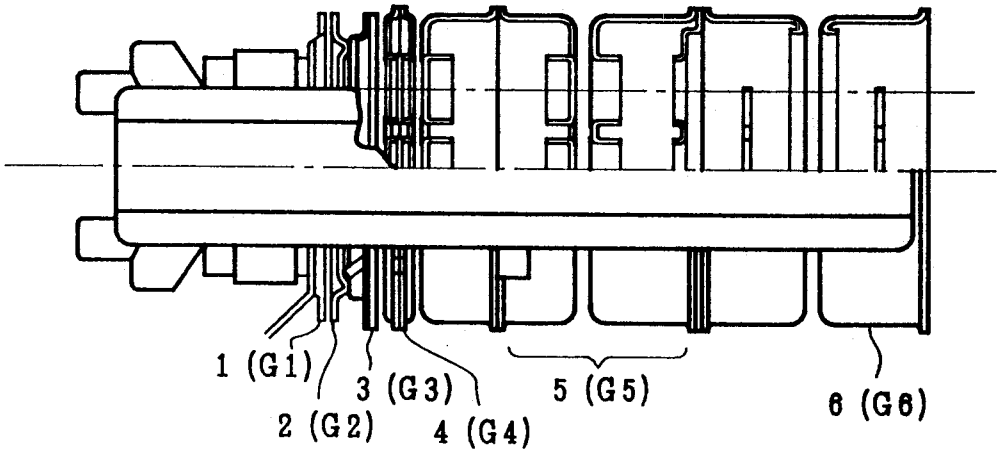

FIG. 21 lists the examples of the combinations of the electrodes of the electron gun shown in FIGS. 53a and 53b, for forming the rotationally-asymmetric lenses according to the present invention. Needless to say, however, various combinations other than the listed combinations are possible.

Figure 22:
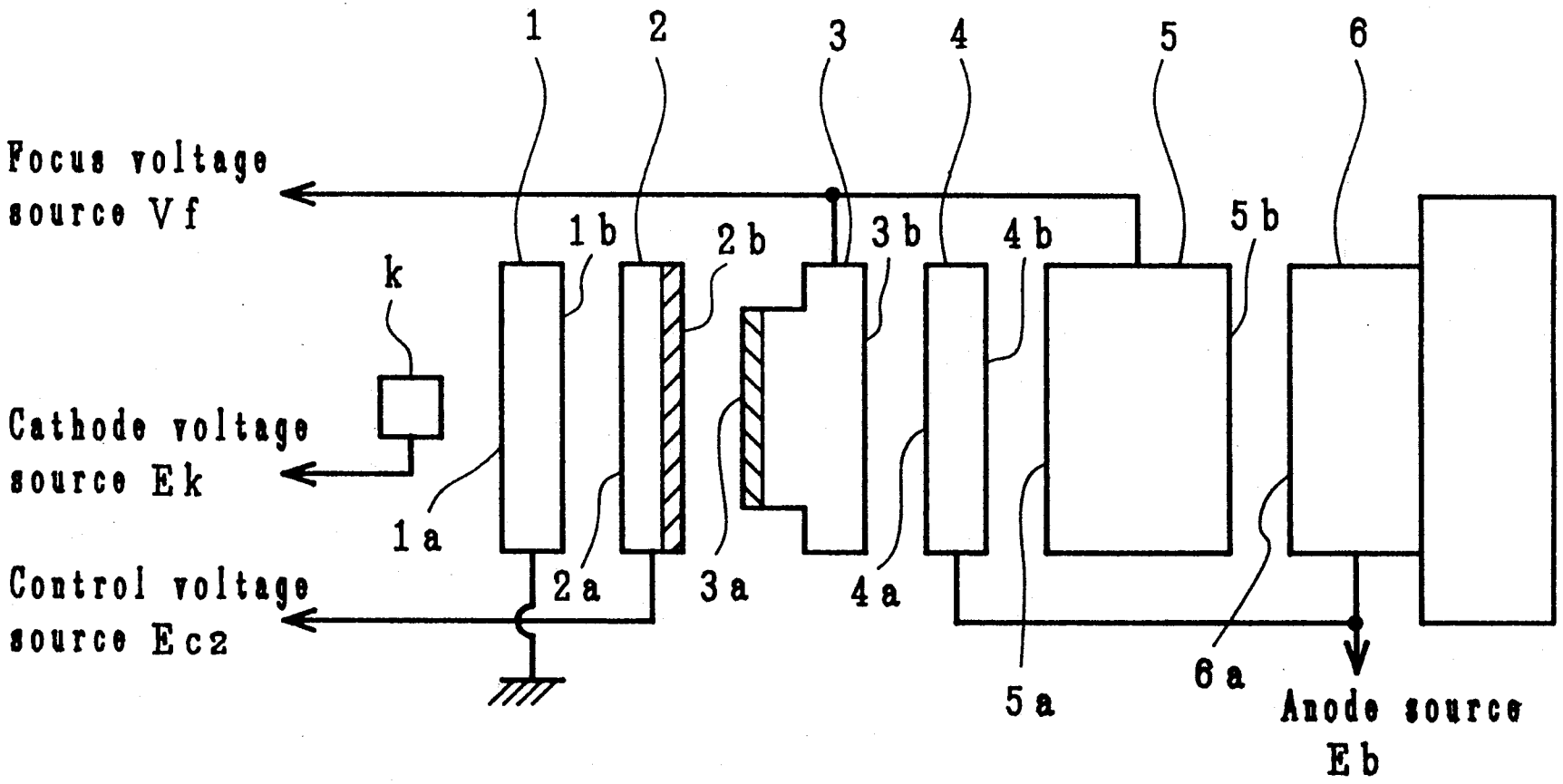
FIG. 22 is a schematic view showing an electrode scheme in the twenty-first embodiment of the present invention.

FIG. 22 shows the twenty-first embodiment in which the present invention is applied to a B-U type electron gun, and in which electrode surfaces 2b and 3a are endowed with electrode structures for forming rotationally-asymmetric electric fields.

Figure 38:
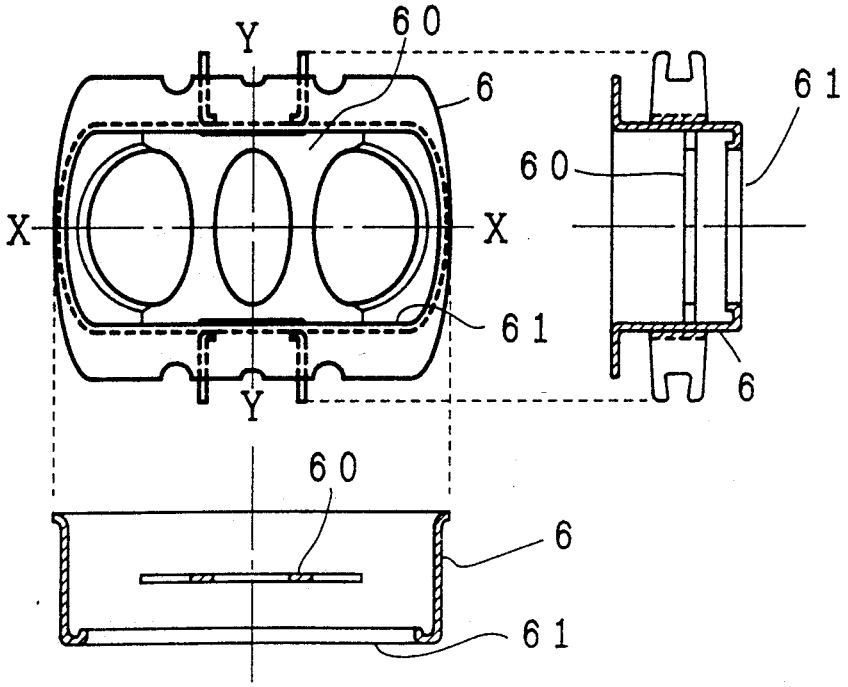
FIGS. 38 and 39 are explanatory views showing one example of the main lens of an electron gun.
Figure 39:
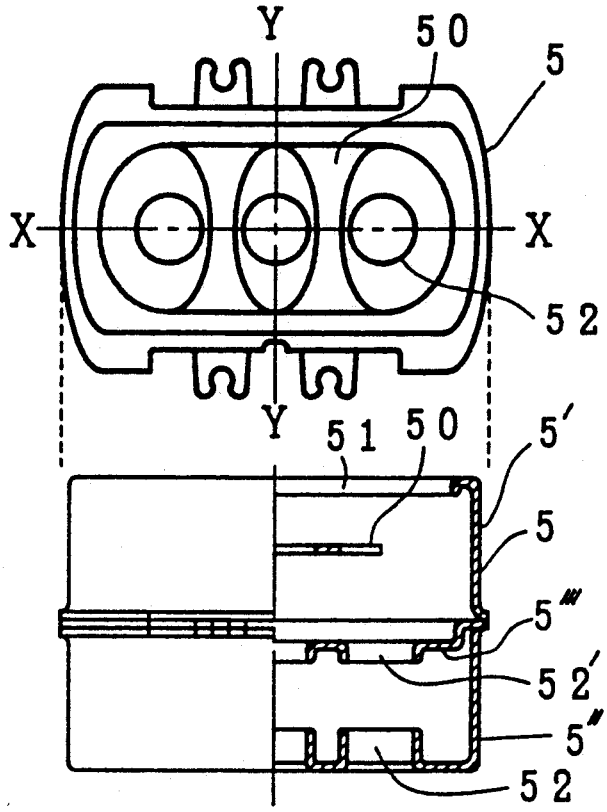

By the way, regarding the above embodiments in which the structures for forming the rotationally-asymmetric electric fields are bestowed on the electrodes G5 and G6, the practicable structural examples thereof are respectively shown in FIG. 39 and FIG. 38.

Figure 23A:
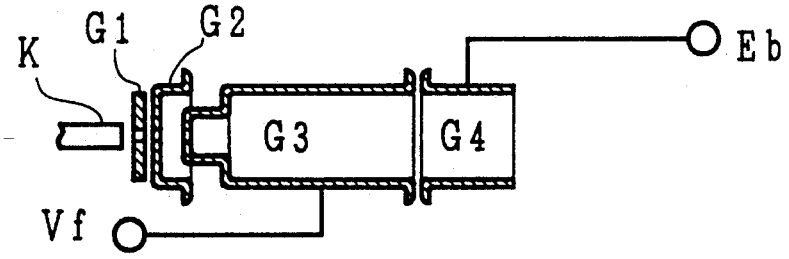
FIGS. 23A to 23F are views for explaining electron guns of several types to which the present invention is applied.
Figure 23B:
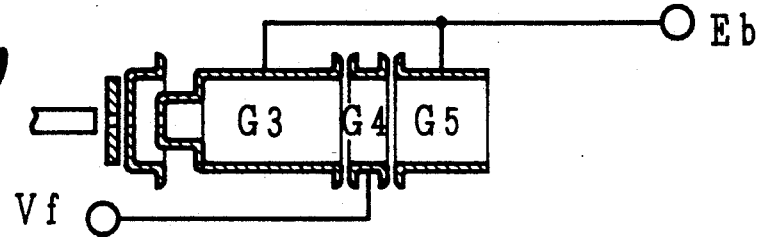
Figure 23C:
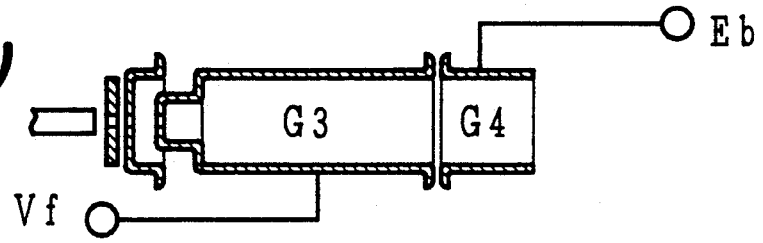
Figure 23D:
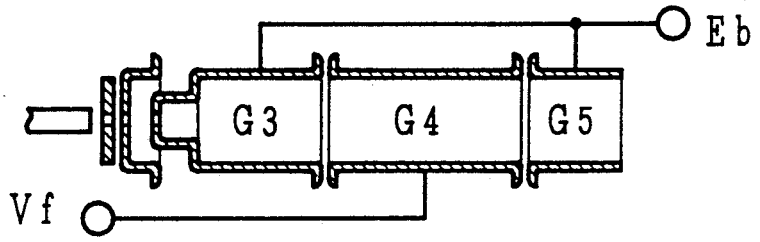
Figure 23E:
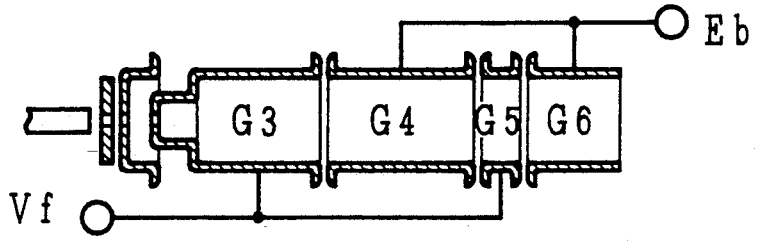
Figure 23F:
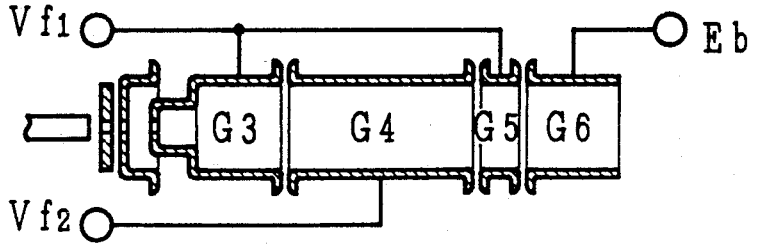
Figure 25:
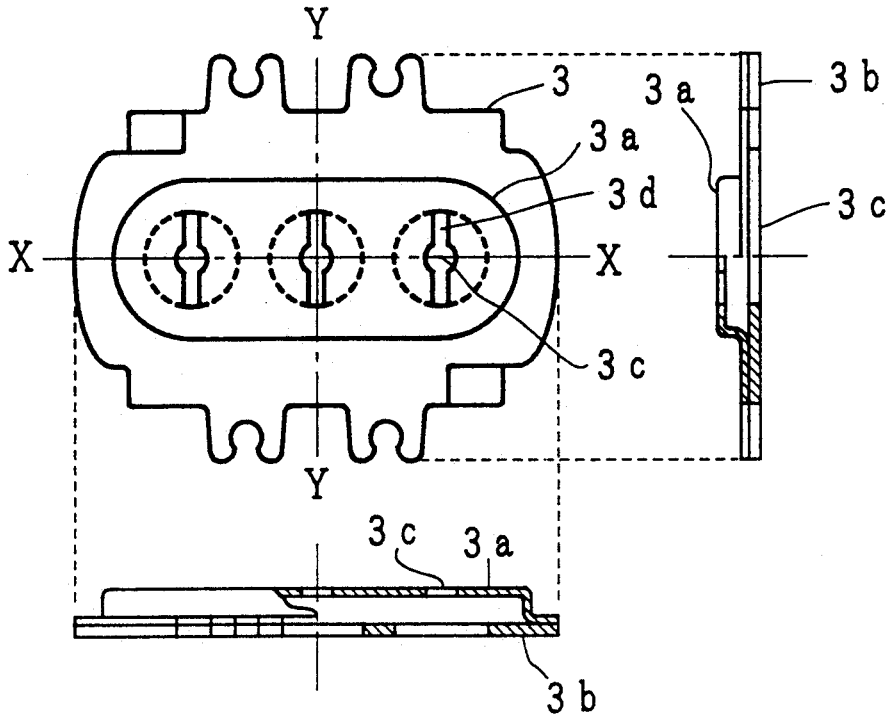
FIGS. 25, 26, 27, 28, 29, 30 and 31 are explanatory views each showing the practicable example of the structure of a third electrode for forming a rotationally-asymmetric electric field.
Figure 26:
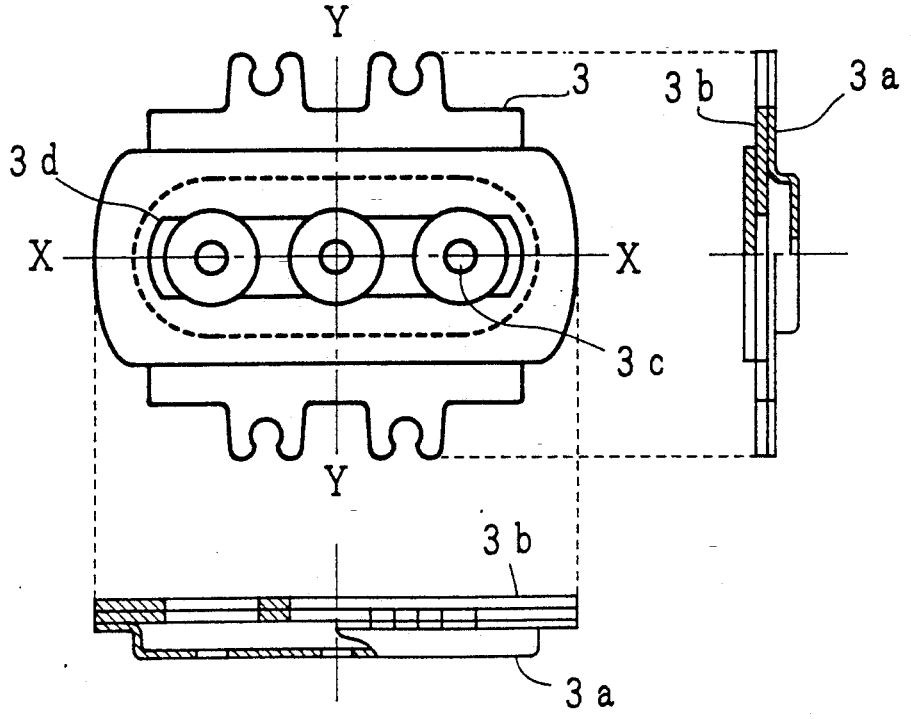
Figure 27:
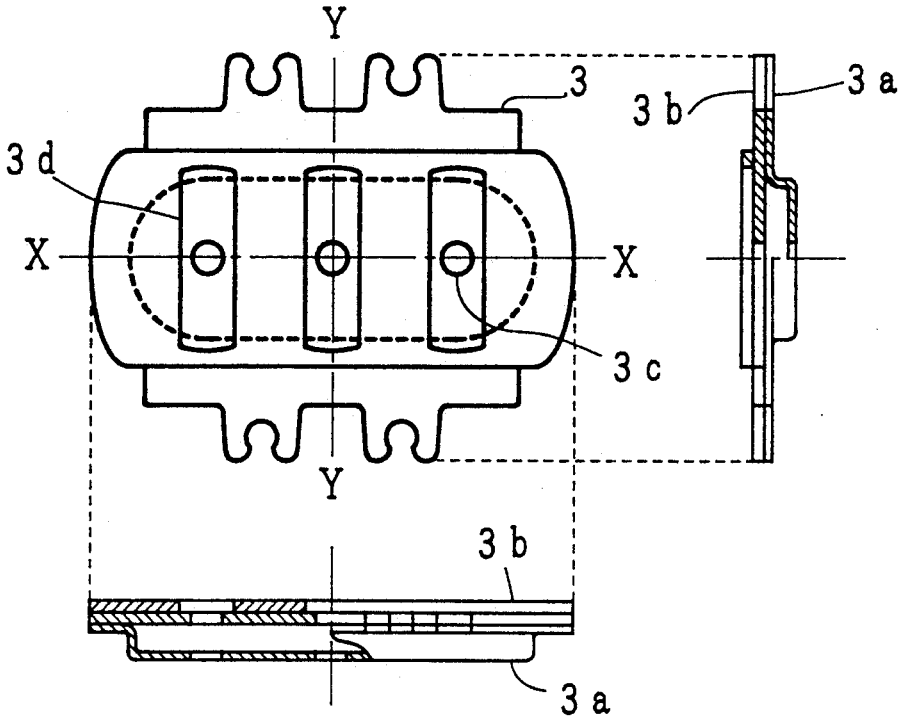
Figure 28:
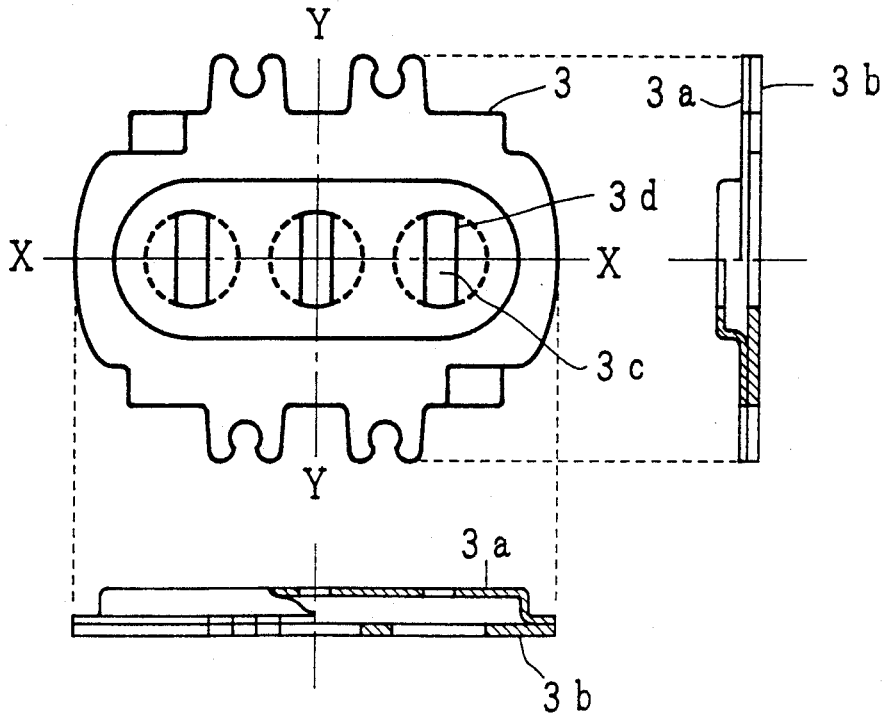
Figure 29:
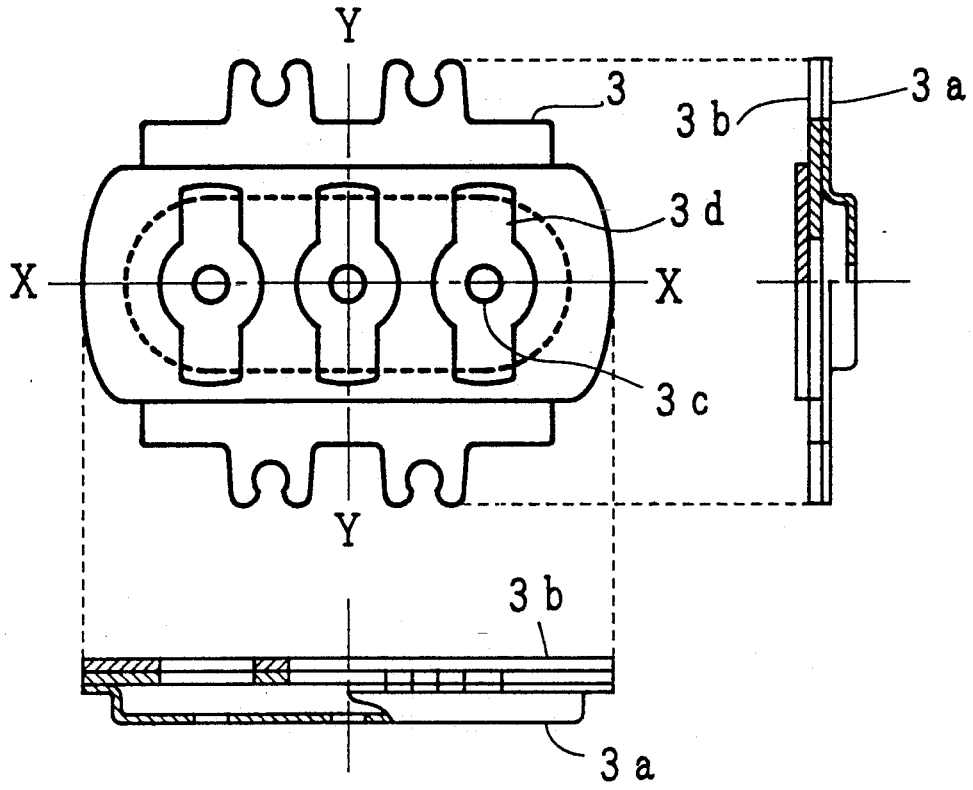
Figure 31:
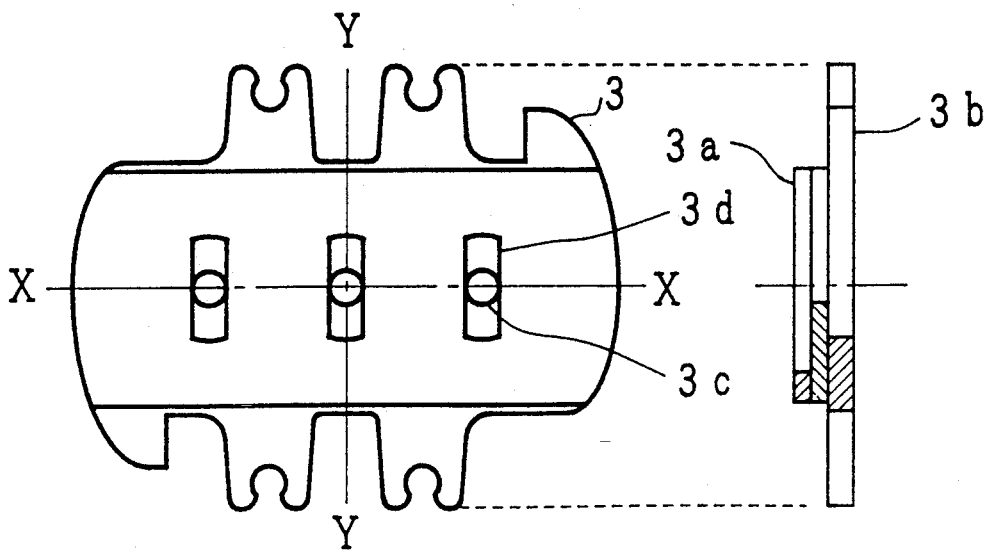
Figure 30:
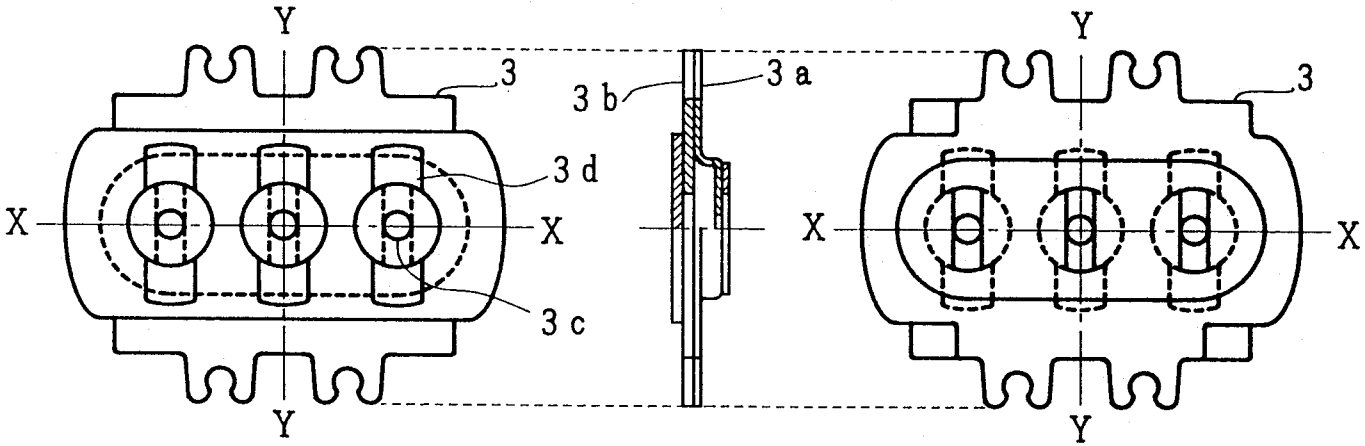

Although the various embodiments of the present invention have been described above, the invention is not restricted thereto. Concretely, the present invention can provide a cathode-ray tube whose focus characteristics are enhanced in the whole area of a screen and which exhibits a high resolution, in such a way that electrode structures for forming rotationally-asymmetric electric fields orthogonal to each other are bestowed on a plurality of electrodes in any of electron guns of various types such as the BPF type shown in FIG. 23a, the UPF type shown in FIG. 23b, the HI-OF type (high focus voltage BPF type) shown in FIG. 23c, the HI-UPF type (high focus voltage UPF type) shown in FIG. 23d, the B-U type (BPF-UPF hybrid type) shown in FIG. 23e, and the TPF type shown in FIG. 23f, and in any of electron guns of other various types such as the multistage focusing type.

FIG. 24 is a diagram for explaining the combinations of electrodes which are endowed with the structures for forming the rotationally-asymmetric electric fields, in typical ones of the electron guns shown in FIGS. 23a–23f.

Now, the structural examples of electron gun electrodes for forming the rotationally-asymmetric electric fields, different from the examples shown in FIGS. 1A–1E, will be described with reference to FIGS. 25 through 39 and FIGS. 54 through 56f.

Each of FIG. 25, FIG. 26, FIG. 27, FIG. 28, FIG. 29, FIG. 30 and FIG. 31 is an explanatory view showing the practicable example of the rotationally-asymmetric electric-field forming structure of the third electrode 3 (G3). Electron-beam apertures 3c, and one or more slits 3d to be provided around the electron-beam apertures 3c are formed by 2 to 4 electrode plates. The electron-beam apertures 3c and the slit or slits 3d are formed by the electrode plates separate from each other, and they are defined by the shapes of openings in the electrode plates, whereby an electric field to be generated is rendered the rotationally-asymmetric electric field.

Figure 32:
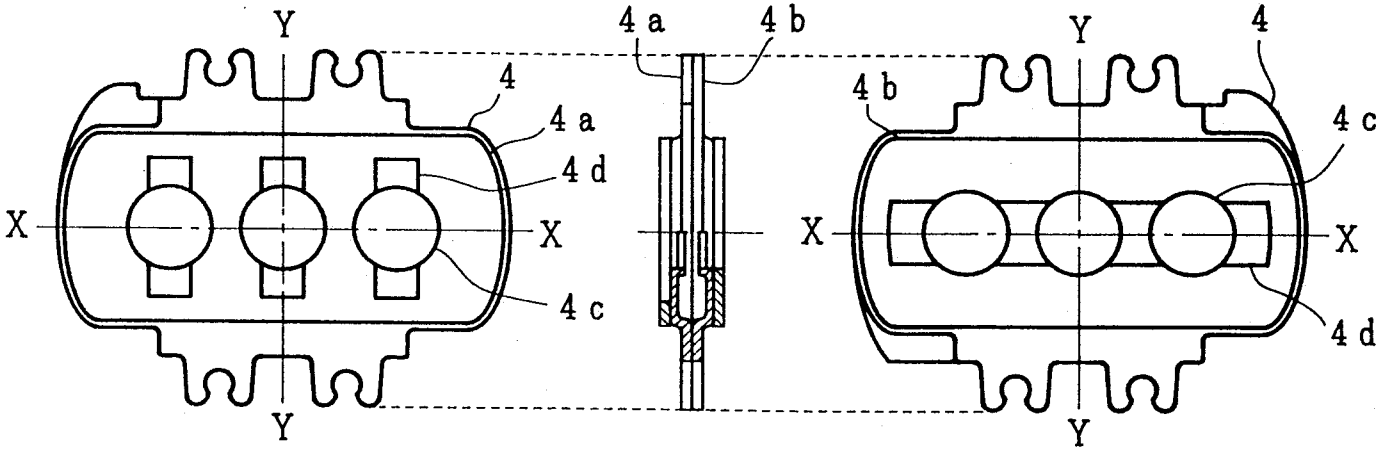
FIGS. 32, 33 and 34 are explanatory views each showing the practicable example of the structure of a fourth electrode for forming a rotationally-asymmetric electric field.
Figure 33:
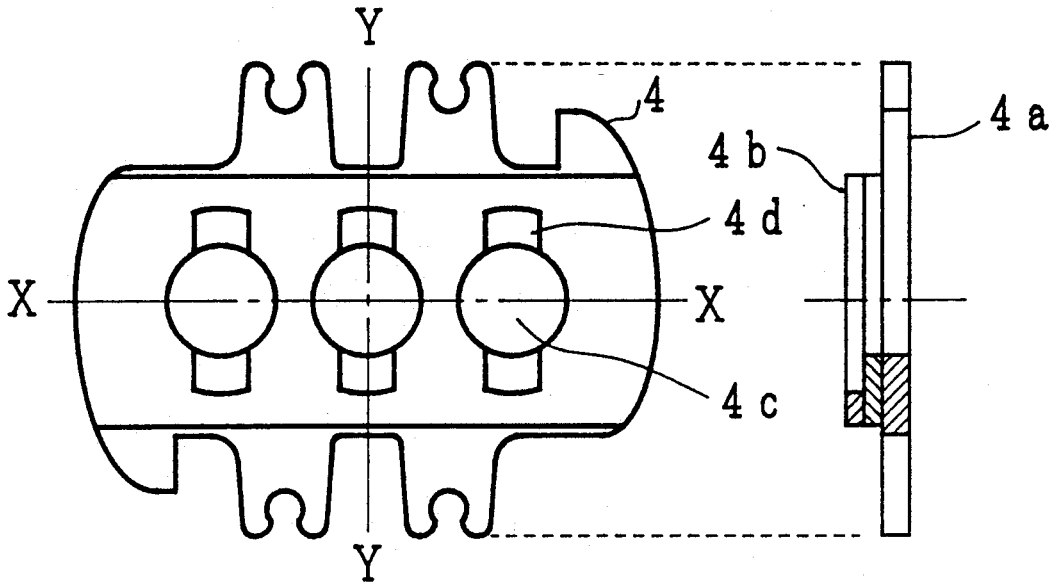
Figure 34:
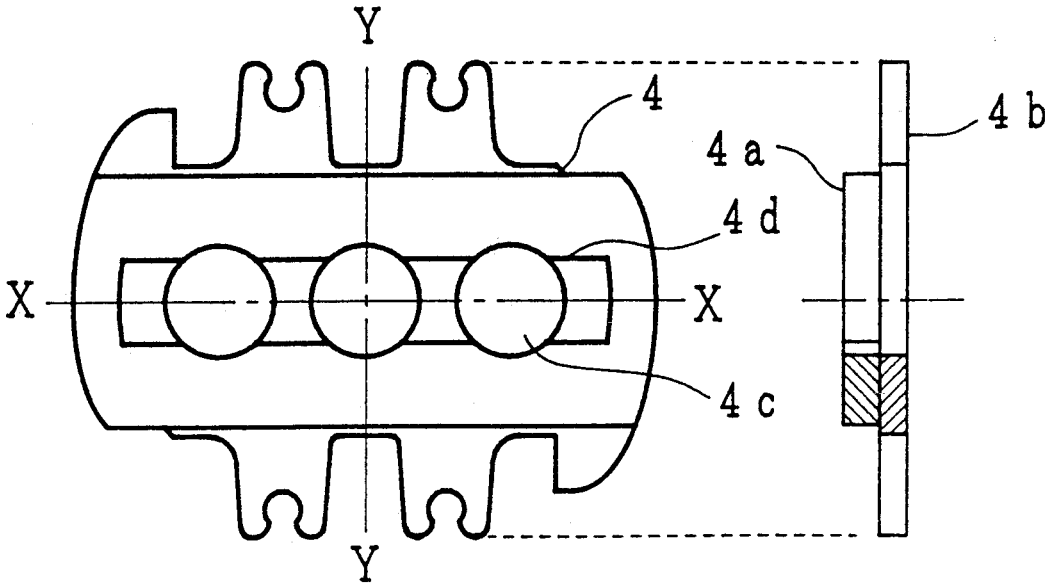

Each of FIG. 32, FIG. 33 and FIG. 34 is an explanatory view showing the practicable example of the rotationally-asymmetric electric-field forming structure of the fourth electrode 4 (G4). In the example of FIG. 32, each of the electrode surfaces 4a and 4b of the electrode G4 is constructed of two electrode plates which are respectively provided with circular openings 4c and one or more slits 4d, and the electrode plates totaling four are arranged so that the longer axes of the slits 4d in the electrode surfaces 4a and 4b may become orthogonal to each other. FIG. 33 and FIG. 34 illustrate the examples of schemes in the case where either of the electrode surfaces 4a and 4b is endowed with the rotationally-asymmetric electric-field forming structure. In each of these examples, circular electron-beam apertures 4c are provided in one of flat electrodes, while one or more slits 4d are provided in the other, and the rotationally-asymmetric electric field in a horizontal direction or a vertical direction is formed by the combination of such flat electrodes.

Figure 35:
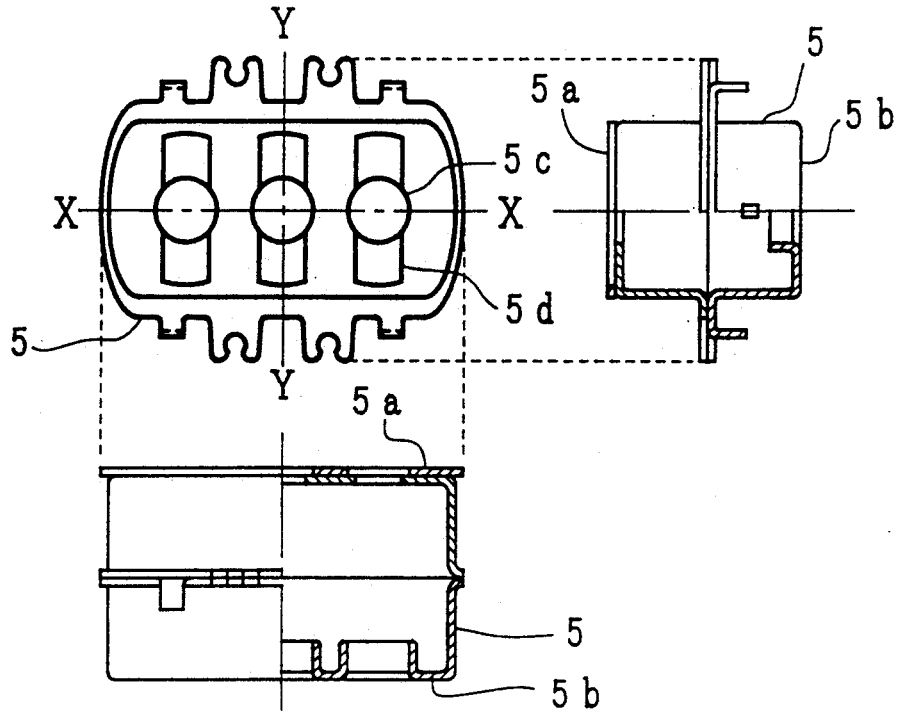
FIGS. 35, 36 and 37 are explanatory views each showing the practicable example of the structure of a fifth electrode for forming a rotationally-asymmetric electric field.
Figure 36:
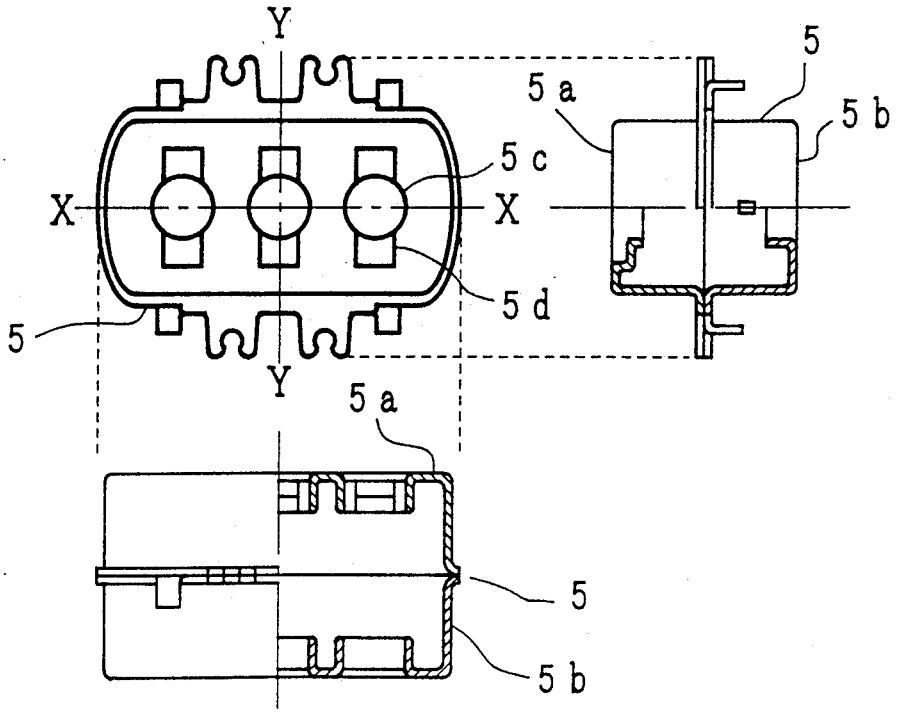
Figure 37:
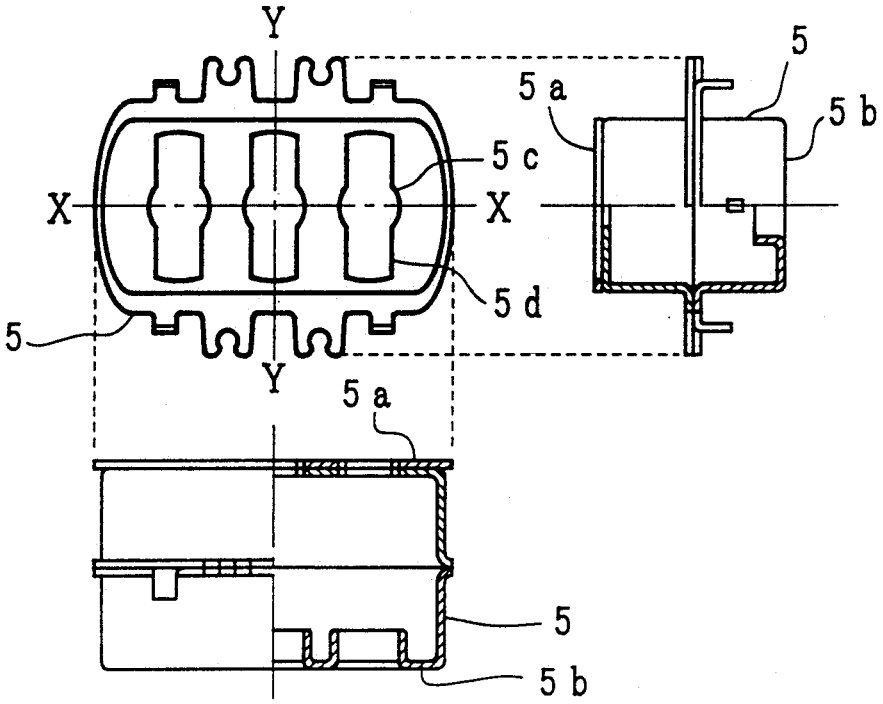

Each of FIG. 35, FIG. 36 and FIG. 37 is an explanatory view showing the practicable example of the rotationally-asymmetric electric-field forming structure of the fifth electrode 5 (G5). As means for bestowing the rotationally-asymmetric electric-field forming structure on the side of the surface 5a of the electrode G5, it is optional whether circular electron-beam apertures 5c and slits 5d are formed by electrode members separate from each other, or they are formed in a common electrode member.

Incidentally, FIGS. 38 and 39 are explanatory views showing the practicable example of a main lens in the electron gun of the eighth embodiment (FIG. 8) of the present invention as illustrated in FIGS. 53a and 53b. The electrode 6 (G6) in FIG. 38 includes an inner electrode 60 having openings corresponding to three electron beams, within a cylindrical electrode having an opening 61 of large diameter. On the other hand, the electrode 5 (GS) in FIG. 39 includes a first cylindrical electrode 5' having a large-diameter opening 51, a second cylindrical electrode 5" having three electron-beam apertures 52, a flat electrode 5''' having three electron-beam apertures 52', and an inner electrode 50 having openings corresponding to three electron beams. Herein, the lens formed by the electrodes G5 and G6 relieves the distortions of electron-beam spots in the whole area of a screen in such a way that those electron-beam apertures of the main-lens electric-field forming electrodes (G5, G6) which act on the side beams of the three electron gun portions of the in-line type are shaped horizontally asymmetric as shown in FIGS. 38 and 39.

Figure 54:
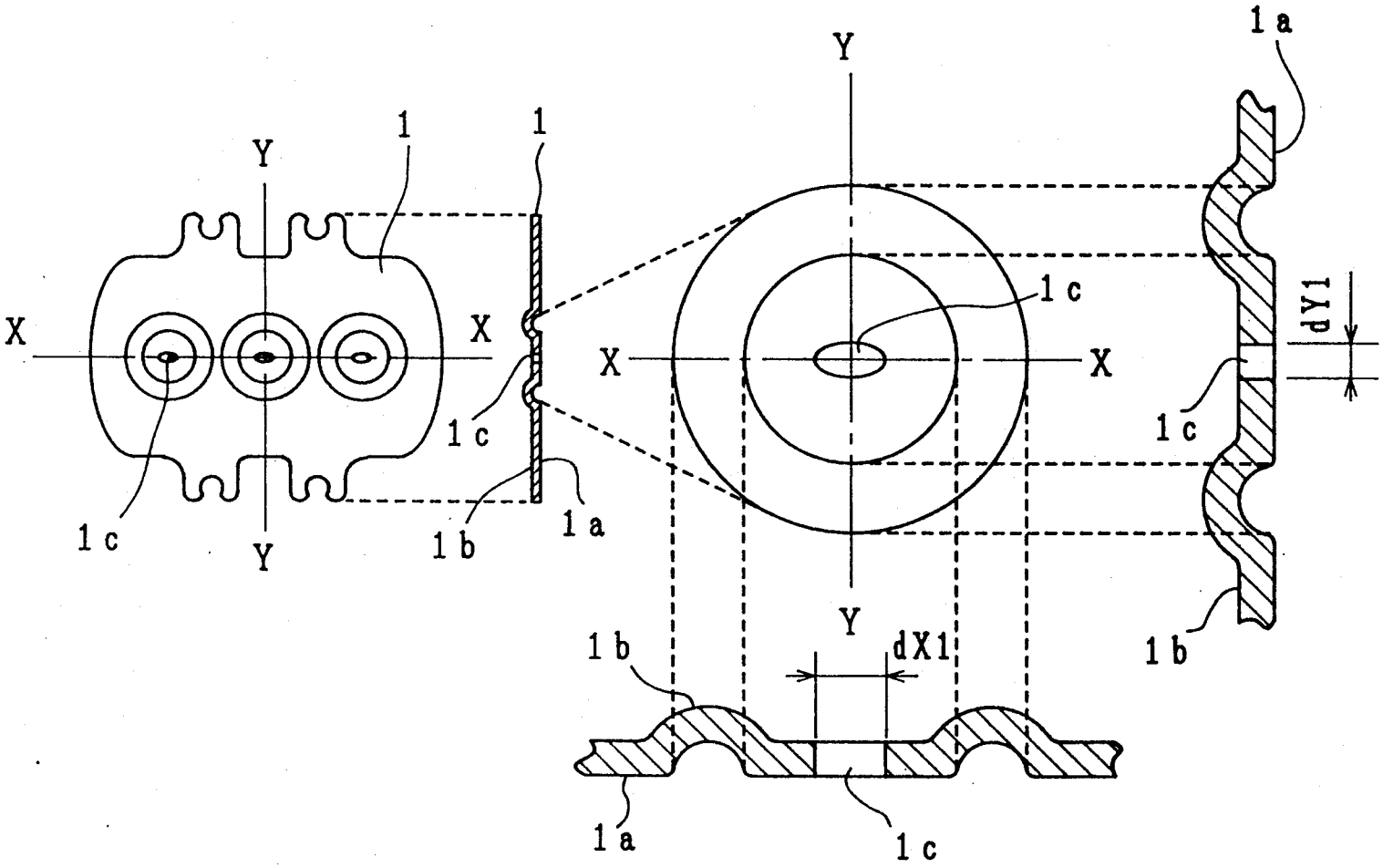
FIG. 54 is an explanatory view showing one practicable example of the detailed structure of a first electrode.

FIG. 54 is an explanatory view showing one practicable example of the detailed structure of the first electrode 1 (G1). In the prior art, each electron-beam aperture 1*c* is rotationally symmetric (circular), whereas in the illustrated embodiment, the horizontal diameter dX1 of each electron-beam aperture 1*c* is made longer than in the prior art, and the vertical diameter dY1 thereof is made shorter than in the prior art. Owing to such a design, the spot diameter of an electron beam in the vertical direction can be made sufficiently small especially in a small current range. Moreover, in order to prevent the open area of the electron-beam aperture 1*c* from decreasing, the horizontal diameter dX1 is lengthened in correspondence with the shortened component of the vertical diameter dY1, whereby the increase of loading on the cathode of the electron gun can be prevented, and the shortening of the lifetime of a cathode-ray tube can be suppressed.

Figure 55:
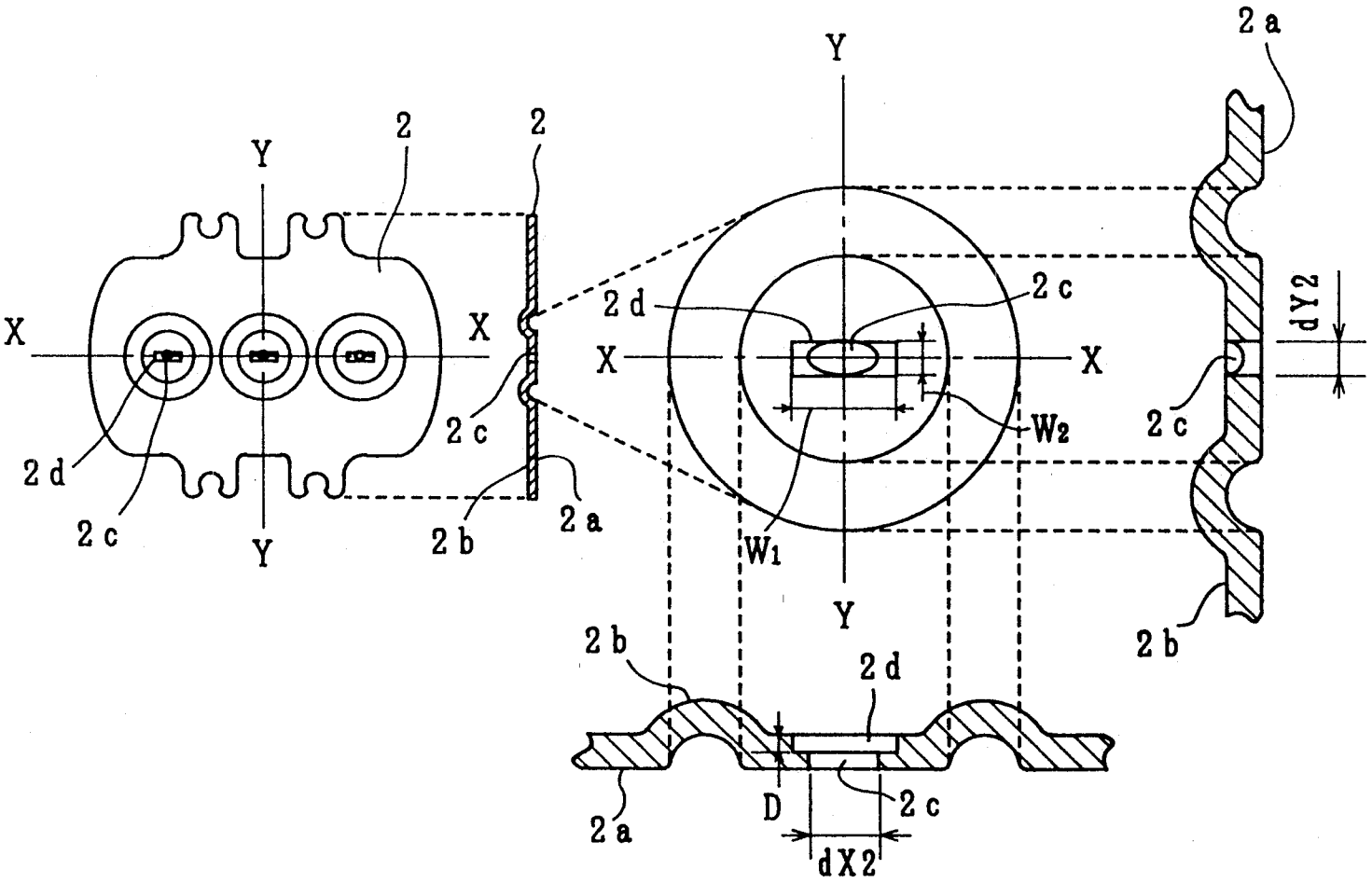
FIG. 55 is an explanatory view showing one practicable example of the detailed structure of a second electrode.
Figure 56A:
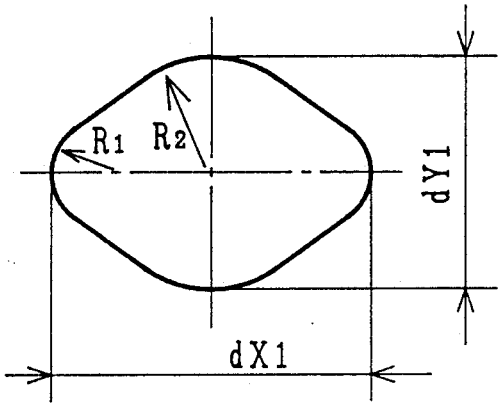
FIGS. 56*a* to 56*f* are diagrams showing several practicable examples of the electron-beam aperture of the first electrode.
Figure 56B:
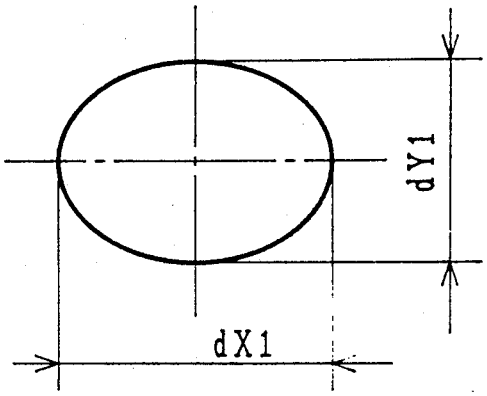
Figure 56C:
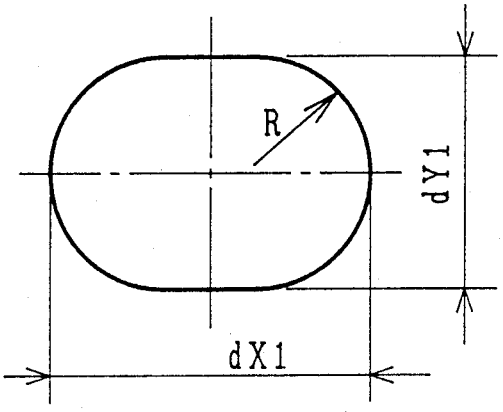
Figure 56D:
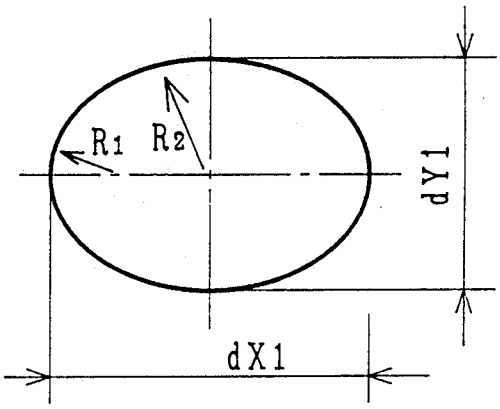
Figure 56E:
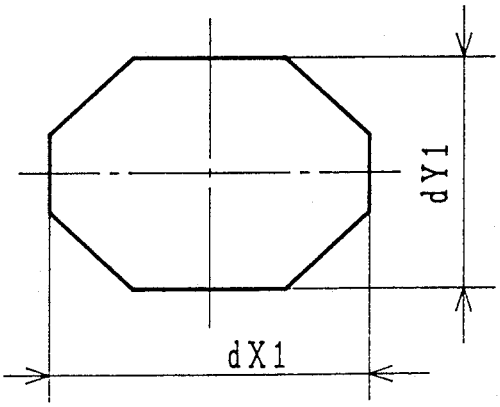
Figure 56F:
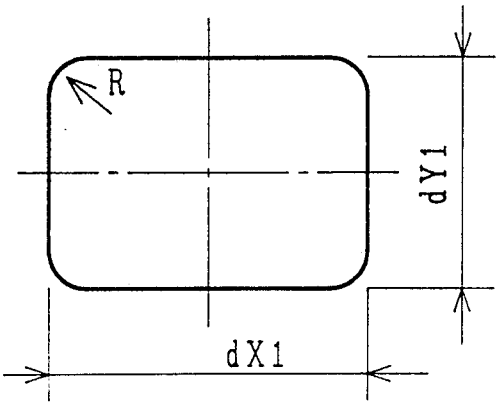

FIG. 55 is an explanatory view showing one practicable example of the detailed structure of the second electrode 2 (G2). Also here, in the prior art, each electron-beam aperture 2*c* is rotationally symmetric (circular), whereas in the illustrated embodiment, the horizontal diameter dX2 of each electron-beam aperture 2*c* is made longer than in the prior art, and the vertical diameter dY2 thereof is made shorter than in the prior art. This embodiment can produce effects similar to those of the embodiment in FIG. 54.

FIGS. 56*a*–56*f* are diagrams showing various practicable examples of the electron-beam aperture 1*c* of the first electrode 1 (G1). The shape of the aperture 1*c* may be in any design insofar as it is rotationally asymmetric (noncircular) and as the vertical diameter dY1 is shorter than the horizontal diameter dX1. That is, the shape may be determined by adjusting the open area of the aperture 1*c* so that the overall focus characteristics of the cathode-ray tube including the characteristics of the other electrodes may be compatible with the loading characteristics of the cathode. Needless to say, the illustrated examples are applicable also to the electron-beam aperture 2*c* of the second electrode 2 (G2).

Figure 57A:
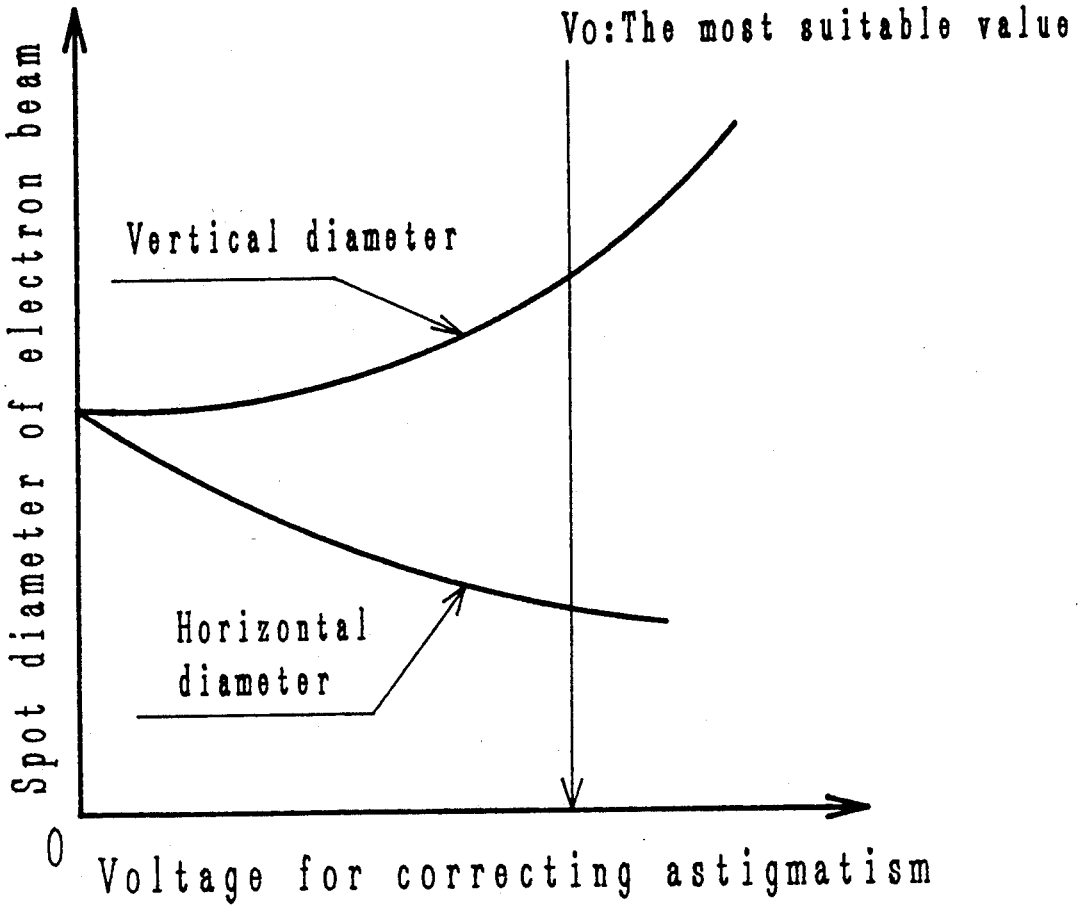
FIGS. 57*a* and 57*b* are explanatory diagrams each showing the relationships of electron-beam spot diameters with an astigmatism correction voltage.
Figure 57B:
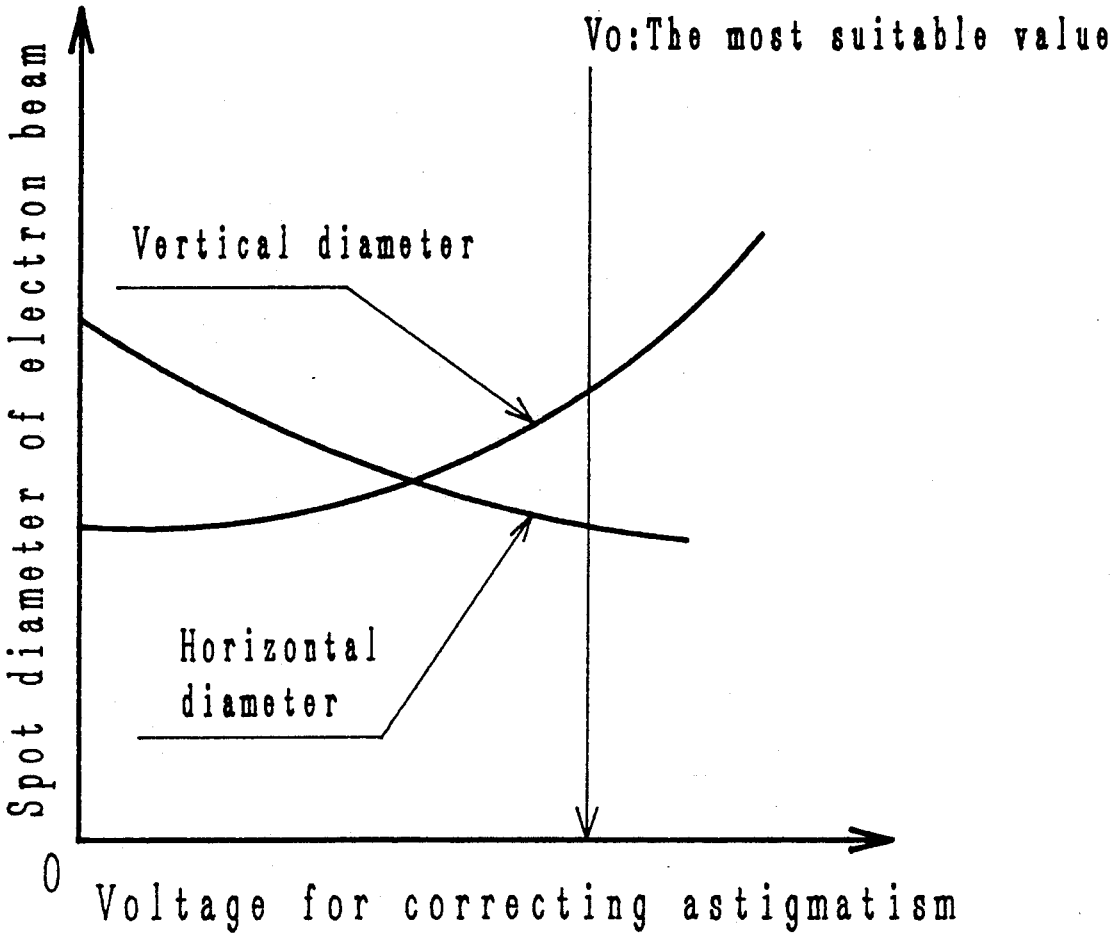

FIGS. 57*a*–57*b* are explanatory diagrams each showing variations in the spot diameters of an electron beam in the case where an astigmatism correction voltage is increased. FIG. 57*a* is depicted for the sake of comparison, and it corresponds to the prior-art case of employing the first electrode G1 whose electron-beam aperture is circular. On the other hand, FIG. 57*b* corresponds to the case where the first electrode G1 has the electrode structure of the embodiment in FIG. 54.

As seen from FIGS. 57*a* and 57*b*, regarding the electron-beam spot diameters at the optimum astigmatism correction voltage $V_o$ at which the focus characteristics become the most uniform in the whole screen, the vertical diameter in the present invention shown in FIG. 57*b* is contracted as compared with that in the prior art shown in FIG. 57*a*. Furthermore, in the present invention, the difference between the vertical diameter and the horizontal diameter is reduced. Thus, a resolution in the vertical direction is enhanced.

Now, as to an electron gun to which the present invention is applied, the variation of the cross-sectional shape of an electron beam at the entrances and exits of the electrodes of the electron gun will be described with reference to FIG. 40 and FIGS. 41*a* to 41*c*.

Figure 40:
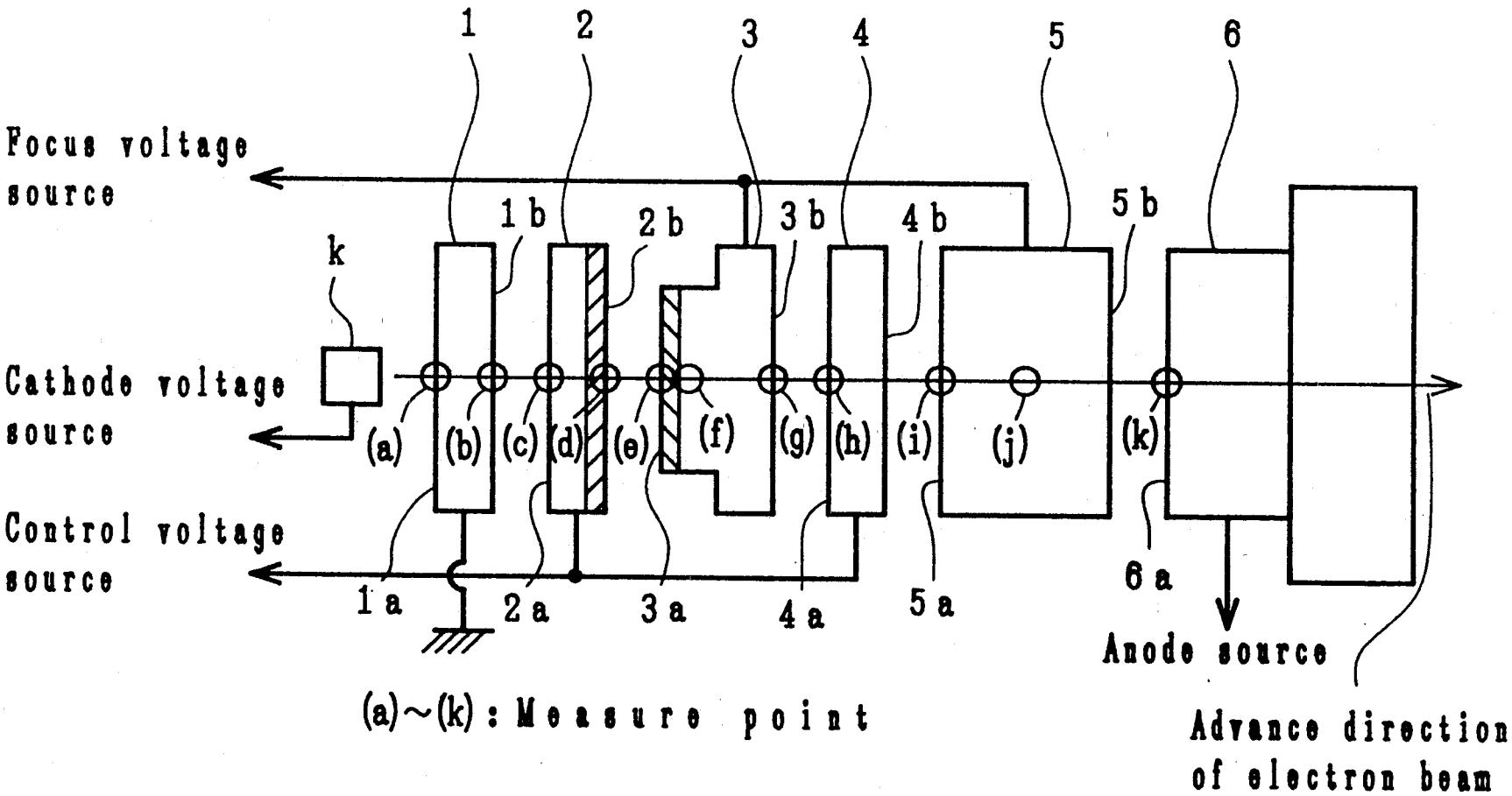
FIG. 40 is a schematic view of an electron gun in which structures for forming rotationally-asymmetric electric fields are bestowed on the exit of a second electrode and the of the third electrode.

FIG. 40 is a schematic view of the electron gun in which the rotationally-asymmetric electric-field forming structures are bestowed on the exit 2*b* of the second electrode 2 (G2) and the entrance 3*a* of the third electrode 3 (G3). In the figure, symbols (a) to (k) denote the measurement points of the cross-sectional shape of the electron beam.

This electron gun is endowed with focus characteristics with which the spot shape of the electron beam in a large current range is substantially circular at the central part of a screen, with which an appropriate focus voltage in a specified scanning direction (horizontal scanning direction) is higher than an appropriate focus voltage in a direction (vertical scanning direction) orthogonal to the specified scanning direction, and with which the spot shape of the electron beam in a small current range is longer in the orthogonal direction than in the specified scanning direction at the central part of the screen. Also, the cross-sectional shape of the electron-beam spot within the main lens of the electron gun demonstrates the distribution of an electron density higher in the orthogonal direction (the vertical scanning direction), in the vicinity of the optic axis of the electron beam, and the diameter of the electron beam lengthens in the specified scanning direction (horizontal scanning direction) at the outer peripheral part thereof.

Figure 41A:
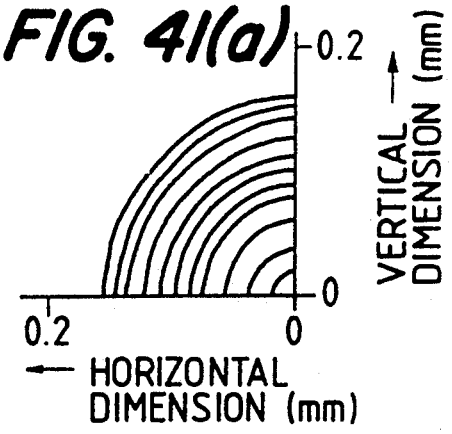
FIGS. 41A to 41K are for explaining the electron density distributions, namely, beam spot shapes of an electron beam at measurement points (a) thru (k) in FIG. 40, respectively.
Figure 41B:
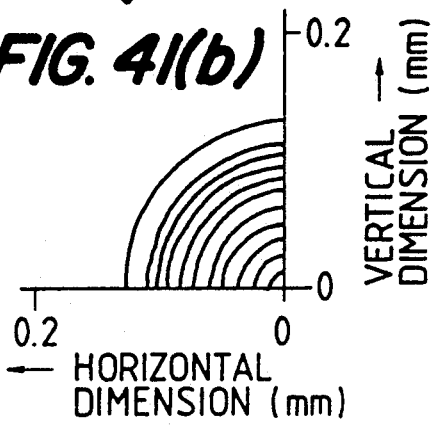
Figure 41C:
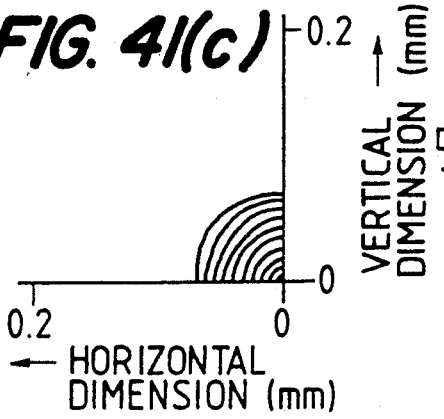
Figure 41D:
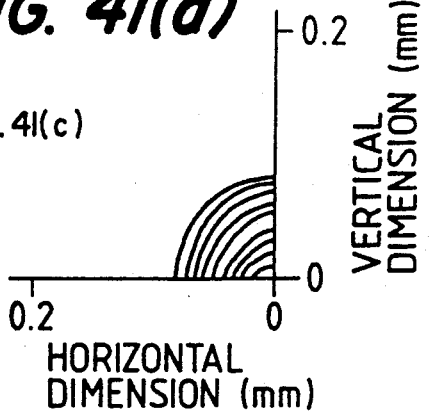
Figure 41E:
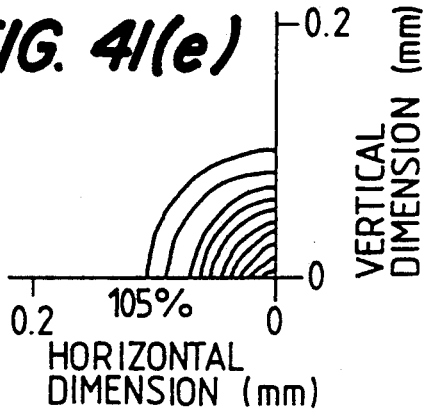
Figure 41F:
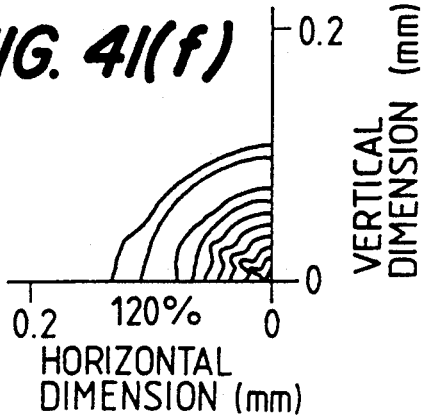
Figure 41G:
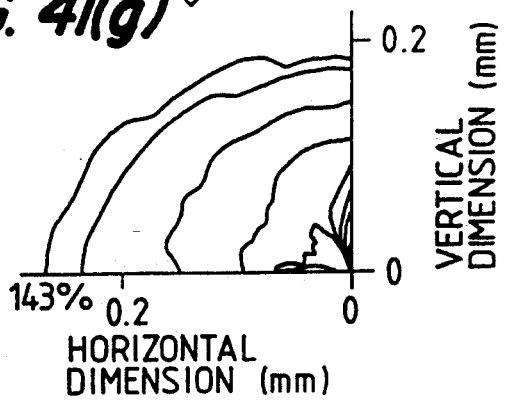
Figure 41H:
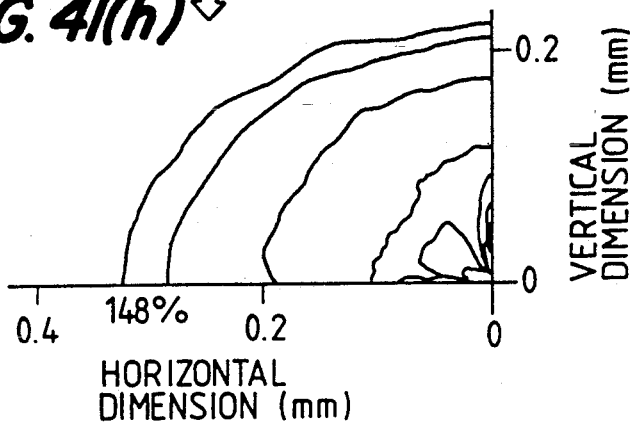
Figure 41I:
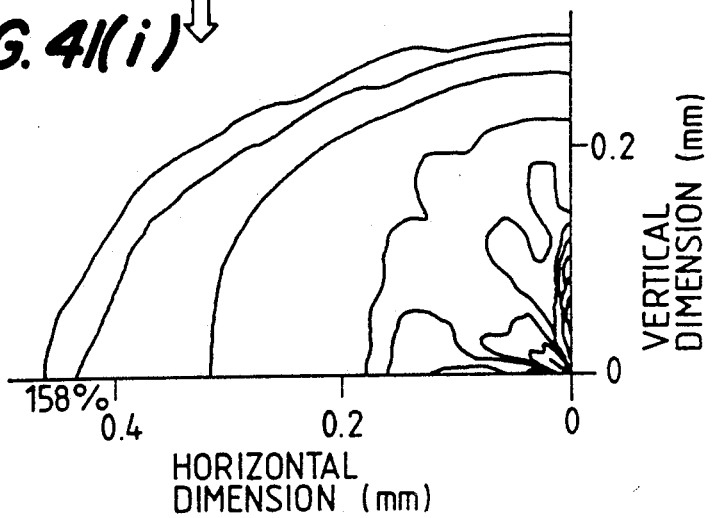
Figure 41J:
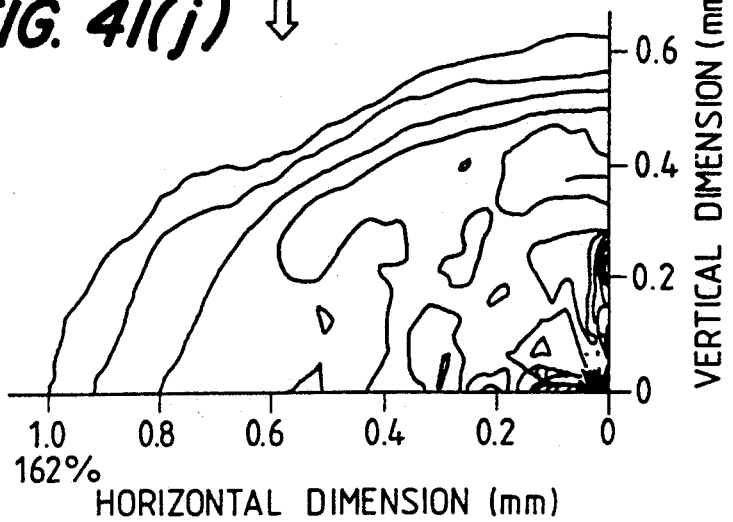
Figure 41K:
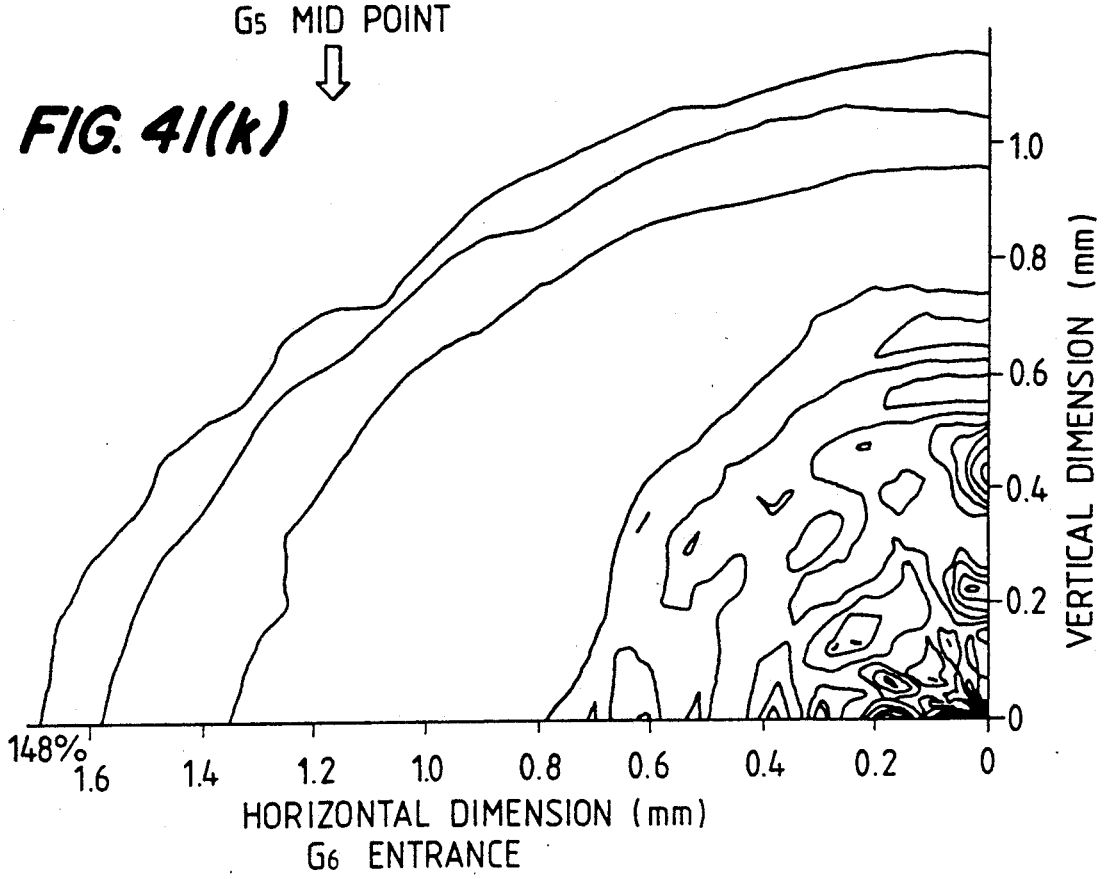

FIGS. 41*a* to 41*c* are diagrams for explaining the electron density distributions, namely, spot shapes of the electron beam at the measurement points (a) to (k) in FIG. 40, and they show measured results at the corresponding points, respectively. In each of symbols (a)–(k) in FIG. 41*a*–41*c* the axis of ordinates represents a vertical dimension, while the axis of abscissas represents a horizontal dimension. Arrows in the figures indicate the proceeding of the electron beam, and the electron beam proceeds toward the fluorescent screen (panel) along symbol (*a*) → symhol (b) → . . . symbol (k) in FIG. 41*a* to 41*c*

First, it is assumed that the electron beam projected from the cathode K of the electron gun (FIG. 40) presents a cross-sectional shape as shown in symbol (a) of FIG. 41*a*, at the entrance 1*a* of the electrode G1.

The exit 2*b* of the electrode G2 is provided with a slit which is long in the horizontal scanning direction, around the electron-beam aperture of this electrode or in the electron-beam aperture itself. Besides, on the side of the entrance 3*a* of the electrode G3, an electron-beam aperture which is circular is formed at the bottom of a slit long in the vertical scanning direction, as viewed in the proceeding direction of the beam. The electron beam emergent from the electrode G1 exhibits a circular section shown in symbol (c) when it enters the electrode G2. When the electron beam emergent from the electrode G2 enters the slit of the electrode G3, it is turned into a sectional shape shown in symbol (e). At the beam aperture entrance of the electrode G3, the sectional shape of the electron beam becomes as shown in symbol (h). When the electron beam emerges from the electrode G3, it presents a cross-sectional shape long in the horizontal direction as shown in symbol (g). As this beam passes through the electrodes G4, G5 and G6, the cross-sectional shape thereof changes as a shape in symbol (h) → a shape in symbol (i) → a shape in symbol (j) → a shape in symbol (k). Eventually, at the lens position formed by the electrodes G5 and G6 constituting the main lens, the electron beam becomes one whose electron density is high in the vertical scanning direction and whose sectional diameter is larger in the horizontal scanning direction than in the vertical scanning direction.

In this way, as stated before, the preferable focus characteristics and resolutions are attained over the whole screen and in all the current ranges of the electron beams.

By the way, although the present invention does not basically require the application of a dynamic focus voltage, the dynamic focusing as in the prior art can be further added to the construction of the present invention. As described above, according to the present invention, owing to rotationally-asymmetric electric-field generating structures which are formed in or around the electron-beam apertures of at least two of a plurality of electrodes constituting an electron gun, the cross section of an electron beam is brought into a horizontally-long state to pass a deflecting magnetic field, whereby the invention can provide an electron gun which can attain favorable focus characteristics and resolutions over the whole screen and in all the current ranges of electron beams without the appearance of moire, without applying a dynamic focus voltage as in the prior art, and a cathode-ray tube which adopts the electron gun.

What is claimed is:

1. An electron gun comprising a plurality of electrodes spaced along a beam path and forming a prefocusing lens, a preceding-stage main lens and a main lens, said preceding-stage main lens having a focusing action which in a specified direction is weaker than a focusing action thereof in a direction orthogonal to said specified direction, and at least one lens other than said preceding stage main lens has a focusing action which in the orthogonal direction is weaker than the focusing action thereof in said specified direction, wherein as to electrodes except ones constituting a main lens thereof, said electron gun comprises a first electrode forming an electrostatic lens exhibiting focus characteristics with which a spot of an electron beam in a large current range is shaped to be substantially circular at a central part of said fluorescent screen, and with which an appropriate focus voltage acting in a scanning direction of said electron beam is higher than an appropriate focus voltage acting in a direction orthogonal to said scanning direction; and a second electrode forming an electrostatic lens exhibiting focus characteristics with which a spot of an electron beam in a small current range has a diameter in the orthogonal direction larger than a diameter in said scanning direction at said central part of said fluorescent screen, wherein one of said first and second electrodes forms said preceding-stage main lens.

2. A cathode-ray tube comprising an electron gun including a plurality of electrodes, a deflection device, and a fluorescent screen, wherein said electron gun comprises a plurality of electrodes spaced along a beam path to form a prefocusing lens, a preceding-stage main lens and a main lens, including at least a first electrode forming an electrostatic lens exhibiting focus characteristics with which a spot of an electron beam in a large current range is shaped to be substantially circular at a central part of said fluorescent screen and with which an appropriate focus voltage acting in a scanning direction of said electron beam is higher than an appropriate focus voltage acting in a direction orthogonal to said scanning direction and at least a second electrode forming an electrostatic lens exhibiting focus characteristics with which a spot of an electron beam in a small current range has a diameter in the orthogonal direction larger than a diameter in said scanning direction at said central part of said fluorescent screen, wherein one of said first and second electrodes forms said preceding-stage main lens.

3. A cathode-ray tube as defined a claim 2, wherein said electron gun comprises an electrode for forming an electrostatic lens exhibiting focusing characteristics with which a cross-sectional shape of the electron beam at a position of a main lens of said electron gun demonstrates a higher electron density distribution in a direction substantially orthogonal to said scanning direction in the vicinity of an electron-beam axis of said electron gun, and with which a diameter of said cross-sectional shape in said scanning direction is larger than a diameter thereof in the orthogonal direction.

4. A cathode-ray tube as defined in claim 2, wherein said each electrostatic lens having said focus characteristics is formed by an electrode having a structure which generates a rotationally-asymmetric electric field.

5. A cathode-ray tube as defined in claim 4, wherein the electrode structure for generating said rotationally-asymmetric electric field is constructed by an electron-beam aperture of said electrode having rotationally-asymmetric shape, or/and by a portion surrounding said electron-beam aperture, having a rotationally-asymmetric shape.

6. A cathode-ray tube as defined in claim 4, wherein said rotationally-asymmetric electric field is generated by said electrode having an electrode structure which has a rotationally-asymmetric shape formed at, one of an entrance and exit of an electron-beam aperture of said electrode.

7. A cathode-ray tube as defined in claim 2, wherein said electron gun includes, at least, a first electrode, a second electrode, a third electrode, a fourth electrode, a fifth electrode and a sixth electrode; at least two of said first through sixth electrodes comprise structures each of which exerts a rotationally-asymmetric electric field on the electron beam passing through the corresponding electrode; and a control voltage is applied to said second and fourth electrodes, while a focus voltage is applied to said third and fifth electrodes.

8. A cathode-ray tube as defined in claim 7, wherein the electrode structures for generating the rotationally-asymmetric electric fields are formed on, one of a beam exit side of said second electrode and a beam entrance side of said third electrode.

9. A cathode-ray tube as defined in claim 7, wherein the electrode structures for generating the rotationally-asymmetric electric fields are formed on at least one of a beam entrance side of said third electrode, a beam exit side of said third electrode and a beam entrance side of said fifth electrode, and at least one of a beam entrance side of said first electrode, a beam exit side of said first electrode, a beam entrance side of said second electrode and a beam exit side of said second electrode.

10. A cathode-ray tube as defined in claim 7, wherein the electrode structures for generating the rotationally-asymmetric electric fields are formed on, at least, a beam exit side of said second electrode, a beam entrance side of said third electrode and a beam exit side of said third electrode.

11. A cathode-ray tube as defined in claim 7, wherein the electrode structures for generating the rotationally-asymmetric electric fields are formed on, at least, a beam exit side of said second electrode, a beam entrance side of said third electrode and a beam entrance side of said fifth electrode.

12. A cathode-ray tube as defined in claim 7, wherein the electrode structures for generating the rotationally-asymmetric electric fields are formed on, at least, a beam exit side of said second electrode, a beam entrance side of said third electrode, a beam exit side of said fifth electrode and a beam entrance side of said sixth electrode.

13. A cathode-ray tube comprising an electron gun including a cathode and a plurality of electrodes for producing an electron beam, a deflection device for deflecting the electron beam, and a fluorescent screen on which the electron beam is scanned, wherein said electron gun comprises a plurality of electrodes spaced along a beam path to form a prefocusing lens, a preceding-stage main lens and a main lens, including at least a first electrode for forming an electrostatic lens exhibiting focus characteristics with which a spot of the electron beam in a large current range is shaped to be substantially circular at a central part of said fluorescent screen, and with which an appropriate focus voltage acting in a scanning direction of said electron beam is higher than an appropriate focus voltage acting in a direction orthogonal to said scanning direction; and a second electrode for forming an electrostatic lens exhibiting focus characteristics with which a spot of the electron beam in a small current range has a diameter in the orthogonal direction larger than a diameter in said scanning direction at said central part of said fluorescent screen, wherein one of said first and second electrodes forms said preceding-stage main lens, and wherein, of said plurality of electrodes, one closest to said cathode of said electron gun has an electron-beam aperture having a size in said orthogonal direction which is smaller than the size thereof in said scanning direction to compensate said spot of the electron beam in the small current range to acquire a circular spot on said fluorescent screen.

* * * * *